United States Patent [19]

Sohei et al.

[11] Patent Number: 5,064,753

[45] Date of Patent: Nov. 12, 1991

[54] HEAT-DEVELOPING PHOTOGRAPHIC MATERIAL

[75] Inventors: Goto Sohei; Okauchi Ken; Kohno Junichi; Iwagaki Masaru, all of Tokyo, Japan

[73] Assignee: Konica Corporation, Tokyo, Japan

[21] Appl. No.: 576,158

[22] Filed: Aug. 30, 1990

Related U.S. Application Data

[63] Continuation of Ser. No. 336,216, Jun. 15, 1989, abandoned, which is a continuation-in-part of Ser. No. 60,390, May 7, 1987, abandoned.

[30] Foreign Application Priority Data

Sep. 17, 1985 [JP] Japan ..... 60-205129
Sep. 28, 1985 [JP] Japan ..... 60-215948
Sep. 17, 1986 [JP] Japan ..... PCT/JP86/00483

[51] Int. Cl.[5] ..... G03C 1/035; G03C 1/494

[52] U.S. Cl. ..... 430/567; 430/617; 430/619

[58] Field of Search ..... 430/567, 619, 617

[56] References Cited

U.S. PATENT DOCUMENTS 4,565,778 1/1986 Miyamoto et al. ..... 430/569
4,639,414 1/1987 Sakaguchi et al. ..... 430/569
4,656,124 4/1987 Komamura ..... 430/620
4,678,741 7/1987 Yamada et al. ..... 430/567
4,728,602 3/1988 Shibahara et al. ..... 430/569

FOREIGN PATENT DOCUMENTS 58-215644 12/1983 Japan .
59-182446 10/1984 Japan .
60-138538 7/1985 Japan .
60-140335 7/1985 Japan .
60-143331 7/1985 Japan .
60-2950 9/1985 Japan .
2156091 10/1985 United Kingdom .

OTHER PUBLICATIONS

Patent Abstracts of Japan, vol. 10, No. 348 (P-519) [2404], 11/22/86; JPA 61-148442, 7/7/86.

*Primary Examiner*—Charles L. Bowers, Jr.
*Assistant Examiner*—Mark R. Buscher
*Attorney, Agent, or Firm*—Jordan B. Bierman

[57] ABSTRACT

The present invention relates to a heat-developable light-sensitive material, or a light-sensitive material that produces image by development through dry heat treatment. The present invention provides a heat-developable light-sensitive material that achieves high sensitivity while experiencing a reduced degree of thermal fogging by employing core/shell type silver halide grains that contain 4–40 mol % of silver iodide and which have a lower silver iodide content in the surface layer than in the internal phase.

8 Claims, No Drawings

HEAT-DEVELOPING PHOTOGRAPHIC MATERIAL

This application is a continuation of application Ser. No. 07/366,216 filed Jun. 15, 1989, now abandoned, which is a continuation of application Ser. No. 07/060,390, filed May 7, 1987, now abandoned.

TECHNICAL FIELD

The present invention relates to a heat-developable light-sensitive material and, more particularly, to a heat-developable light-sensitive material that features high sensitivity and low thermal fogging.

TECHNICAL BACKGROUND

Efforts are being made to achieve exposure of heat-developable light-sensitive materials with low-irradiance light sources such as LED, CRT, FOT and semiconductor lasers. Research is also being undertaken with a view to shortening the time required for image formation. In particular, light-sensitive materials such as thermally developable ones which are adapted for rapid access are the subject of extensive studies including efforts to produce high-speed heat-developable light-sensitive materials which require shorter exposure times.

Heat-developable light-sensitive materials can be rendered highly sensitive by increasing the content of silver iodide in the light-sensitive silver halide but, as it turns out, the increased silver iodide content causes enhanced thermal fogging. In order to suppress thermal fogging, the use of thermal fog preventing agents has been proposed and compounds included within this class are: the mercury compounds shown in U.S. Pat. No. 3,589,903; the N-halogeno compounds shown in West German Patent No. 2,402,161; the peroxides shown in West German Patent No. 2,500,508; the sulfur compounds shown in West German Patent No. 2,617,907; the palladium compounds shown in U.S. Patent No. 4,102,312; the sulfinic acids shown in Japanese Patent Publication No. 28417/1978, the mercaptotetrazole compounds shown in Research Disclosure Nos. 169077 and 169079; and the 1,2,4-triazole shown in U.S. Pat. No. 4,137,079. However, none of these anti-foggants are completely satisfactory for various reasons such as high toxicity to humans and low efficacy.

The present inventors made concerted efforts to solve these problems and, as a result, they found that a heat-developable light-sensitive material that satisfies both the requirements for high sensitivity and small thermal fogging can be attained by employing a silver halide emulsion that comprises light-sensitive silver halide grains of the core/shell type that contain a specified amount of silver iodide and which have a lower silver iodide content in the surface layer than in the bulk or internal phase.

DISCLOSURE OF THE INVENTION

The principal object, therefore, of the present invention is to provide a heat-developable light-sensitive material that features high sensitivity and low thermal fogging.

This object of the present invention can be attained by a heat-developable light-sensitive material wherein the light-sensitive silver halide emulsion employed comprises light-sensitive silver halide grains of the core/shell type that contain 4–40 mol% of silver iodide and which have a lower silver iodide content in the surface layer than in the bulk.

The silver halide light-sensitive grains employed in the present invention have a silver iodide content of 4–40 mol%, preferably 4–20 mol%. Even if the content of silver iodide in the emulsion grains is less than 4 mol%, the advantage of low thermal fogging is retained but then the light-sensitive material employed as the final product has undesirably low photographic sensitivity. If the silver iodide content exceeds 40 mol%, it is difficult to attain silver halide grains which are uniform in silver iodide content and the additional disadvantage of increased thermal fogging will result.

The light-sensitive silver halide grains used in the present invention are also characterized by their core/shell structure wherein the surface layer (such as in the form of a shell) has a lower silver iodide content than the internal phase or bulk (such as in the form of a core). If the silver iodide content in the surface layers of the core/shell type silver halide grains is higher than or equal to that in the internal phase, disadvantages such as increased thermal fogging will occur.

There is no particular limitation on the types of silver halides other than silver iodide in the core of the light-sensitive silver halide grains but preferable examples are silver iodobromide and silver chloroiodobromide. The difference in silver iodide content between the surface layer and internal phase of a silver halide grain may be abrupt, such as to provide a distinct boundary, or diffuse, such as to create a gradual transition from one phase to the other.

The silver iodide containing core of the light-sensitive silver halide grains may be prepared by the methods described in various references such as: P. Glafkides, Chimie et Physique Photographique, Paul Montel, 1967; G.F. Duffin, Photographic Emulsion Chemistry, The Focal Press, 1966; and V.L. Zelikman et al., Making and Coating Photographic Emulsion, The Focal Press, 1964.

An emulsion of the core/shell type silver halide grains used in the present invention may be prepared by first making cores from monodispersed light-sensitive silver halide grains, then coating a shell over each of the cores. The term "monodispersed silver halide emulsion" as used in the present invention means an emulsion wherein the silver halide grains present have such a size distribution that the size variance with respect to the average particle size is not greater than the level specified below. An emulsion made of a light-sensitive silver halide that consists of silver halide grains that are uniform in shape and which have small variance in grain size (this type of emulsion is hereinafter referred to as a monodispersed emulsion) has a virtually normal size distribution and allows its standard deviation to be readily calculated. If the spread of size distribution (%) is defined by (standard deviation/average grain size)$\times$100, then the "monodispersed" light-sensitive silver halide grains used in the present invention preferably have a spread of distribution which is not more than 15%, more preferably 10% or less.

Monodispersed silver halide grains with desired sizes that serve as cores can be formed by performing the double-jet method with the pAg being held at a constant level. A silver halide emulsion comprising highly monodispersed light-sensitive silver halide grains may be prepared by employing the method described in Unexamined Published Japanese Patent Application No. 48521/1979. In a preferred embodiment of this method, an aqueous solution of potassium iodobromide and gelatin and an aqueous solution of ammoniacal silver nitrate are added to an aqueous gelatin solution containing silver halide seed grains, with the speed of addition being varied as a function of time. The desired silver halide emulsion comprising highly monodispersed silver halide grains serving as cores can be attained by appropriately selecting such factors as the time function of addition speed, pH, pAg and temperature.

A shell is then allowed to grow continuously on each of the thus prepared monodispersed core grains in accordance with the method employed in making the monodispersed emulsion. As a result, a silver halide emulsion comprising the monodispersed core/shell type silver halide grains suitable for use in the present invention is attained.

The shell coat on the core grains in the core/shell type light-sensitive silver halide used in the present invention has a thickness which preferably ranges from 0.05 to 90%, more preferably from 1 to 80%, of the size of the silver halide grains.

The core/shell light-sensitive type silver halide grains used in the present invention should have an overall silver iodide content of 4–40 mol%. However, the silver iodide content in the core grains is preferably within the range of 4–20 mol%, with less than 10 mol% being particularly preferable. For the silver halide composition of the shell, the silver iodide content is preferably within the range of 0–6 mol%.

While it suffices for the core/shell type light-sensitive silver halide grains used in the present invention to have a lower silver iodide content in the surface layer (shell) than in the internal phase (core), the silver iodide content of the surface layer is preferably at least 2 mol% lower than the silver iodide content of the internal phase.

The average size of the light-sensitive silver halide grains used in the present invention is not limited to any particular value but is preferably within the range of 0.01–5.0 μm, with the range of 0.05–2.0 μm being more preferable.

The average size of the light-sensitive silver halide grains is expressed by the average diameter if the grains are spherical and by the average of the diameters of equivalent circles for the projected images if the grains are cubic or in other non-spherical shapes. The average grain size ($\bar{r}$) is defined by the following equation:

$$r = \frac{\Sigma niri}{\Sigma ni}$$

where ri is the size of an individual particle and ni signifies the number of particles present.

The grain size as defined above may be determined by any of the methods commonly employed in the art for particle size measurement. Representative methods are described by R. P. Loveland in "Particle Size Analysis" in ASTM Symposium on Light Microscopy, pp. 94–122, 1955, and in The Theory of the Photographic Process, C. E. Kenneth Mees and T. H. James, third edition, Chapter 2, The Macmillan Company, 1966. Particle size measurements may be expressed in terms of the projected areas of grains or approximations of their diameters. These will provide reasonably accurate results if the grains of interest are substantially uniform in shape.

The light-sensitive silver halide emulsion comprising the light-sensitive silver halide grains used in the present invention may be chemically sensitized by any of the methods known in the art of photographic technology.

Another method may be employed in order to prepare light-sensitive silver halides suitable for use in the present invention and this involves allowing a light-sensitive silver halide to form in part of the organic silver salts to be described later in this specification that are to be incorporated into a reaction system together with light-sensitive silver salt forming components. The light-sensitive silver salt forming components and the light-sensitive silver halide grains described above may be used in combination in various methods. They are preferably used in amounts of 0.001–50 g, more preferably 0.1–10 g, per square meter of one layer.

In the pages that follow, the core/shell type light-sensitive silver halide grains that have a silver iodide content of 4–40 mol% and which have a lower silver iodide content in the surface layer than in the internal phase will be referred to as the light-sensitive silver halide grains of the present invention.

The shape of the light-sensitive silver halide grains of the present invention is in no way limited; they may be normal crystals(such as cubes, tetradecahedrons and octahedrons), twined or tabular. If desired, a mixture of these crystals may be employed. For the purpose of achieving a maximum sensitivity, tabular crystals are advantageous.

The term "tabular silver halide grains" means silver halide grains which have a pair of substantially parallel crystal faces that are substantially larger than the other crystal faces of the grains. The diameters of these substantially largest crystal faces are referred to as the particle size of a tabular silver halide grain in this specification and in order for a certain silver halide grain to be designated a tabular grain, it must have an aspect ratio (the ratio of its particle size to its thickness) of 5 or more.

The particle size and thickness of a tabular silver halide grain should represent the diameter of an equivalent circle for the projected image of the particle as seen with an electron microscope. The tabular silver halide grains in an emulsion sample can be identified by measuring the thicknesses and particle sizes of the individual grains shown in an electron micrograph having highlights and shadows. The thus measured thickness and particle size may be used to calculate the aspect ratio of the tabular silver halide grain of interest and the aspect ratios of all of the silver halide grains present in the sample may be averaged to obtain their mean aspect ratio. Obviously, the mean aspect ratio signifies the average of the aspect ratios of the individual tabular silver halide grains of interest. Whether the average of the individual aspect ratios or the average of the thicknesses and particle sizes of the tabular silver halide grains is employed is of no great importance in determining the mean aspect ratio of the grains of interest.

It suffices that the tabular silver halide grains have aspect ratios of 5 or more, but preferable tabular grains are those which have a mean aspect ratio within the range of 5–20. It is also preferable that the tabular silver halide grains have a mean aspect ratio of 5–20 for at least 50%, more preferably at least 70%, of the total projected images of the grains.

The tabular silver halide grains preferably have particle sizes within the range of 0.05–4.0 μm, more preferably between 0.1 and 3.0 μm. These grains are preferably thinner than 0.3 μm, more preferably thinner than 0.2 μm.

In a preferable embodiment of the present invention, organic silver salts of the types described later in this specification are employed. Such organic silver salts, when incorporated in a heat-developable light-sensitive material, cooperate with reducing agents to exhibit physical dissolution effects during silver image formation, to thereby contribute to improvement in developability and sensitivity. When the silver halide grains of the present invention are tabular in shape, they are advantageously incorporated in amounts of 0.05–3 moles per mole of the organic silver salt.

A particularly advantageous heat-developable light-sensitive material that produces high maximum density and which undergoes a small degree of fogging can be attained in accordance with the present invention by incorporating at least one of the compounds of the following general formulas (I) to (V) in a silver halide emulsion layer and/or at least one hydrophilic colloidal layer which is adjacent said silver halide emulsion layer:

$$[R_1—OH)_n \quad (I)$$

wherein $R_1$ is a straight-chained, branched or cyclic n-valent hydrocarbon or ether residue having 3–10 carbon atoms; and n is an integer of 3–10;

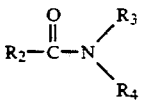

(II)

where $R_2$, $R_3$ and $R_4$ are each a hydrogen atom, an alkyl group having 1–12 carbon atoms, or an aryl or heterocyclic group having 6–12 carbon atoms;

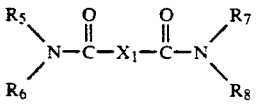

(III)

where $R_5$, $R_6$, $R_7$ and $R_8$ are each a hydrogen atom, an alkyl group having 1–12 carbon atoms, or an aryl or heterocyclic group having 6–12 carbon atoms, and $X_1$ is a simple linkage or a divalent group;

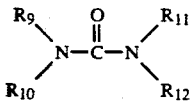

(IV)

where $R_9$, $R_{10}$, $R_{11}$ and $R_{12}$ are each a hydrogen atom, an alkyl group having 1–12 carbon atoms, an acyl group or an aryl group having 6–12 carbon atoms, provided that one of $R_9$ and $R_{10}$ may combine with one of $R_{11}$ and $R_{12}$ to form a ring; and

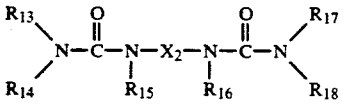

(V)

where $R_{13}$, $R_{14}$, $R_{16}$, $R_{17}$ and $R_{18}$ are each a hydrogen atom, an alkyl group having 1–12 carbon atoms, an acyl group or an aryl group having 6–12 carbon atoms; and $X_2$ is a simple linkage or a divalent group.

In formula (I), $R_1$ signifies a straight-chained, branched or cyclic n-valent hydrocarbon or ether residue having 3–10 carbon atoms. Illustrative compounds represented by formula (I) are those which are generally known as polyhydric alcohols and saccharides.

Typical examples of the compounds represented by formula (I) are specifically listed below for illustrative purposes only:

(1) glycerin
(2) 1,2,4-butanetriol
(3) pentaerythritol
(4) trimethylolpropane
(5) diglycerin
(6) trimethylolethane
(7) 1,2,6-hexanetriol
(8) D-xylitol
(9) D-mannitol
(10) 3-methyl-1,3,5-pentanetriol
(11) D-sorbitol
(12) 1,2,7,8-octanetetrol
(13) meso-erythritol
(14) adonitol
(15) dulcitol
(16) 1,2,4-cyclohexanetriol.

In formula (II), $R_2$, $R_3$ and $R_4$ each signifies a hydrogen atom, an alkyl group having 1–12 carbon atoms, or an aryl or heterocyclic group having 6–12 carbon atoms. Such alkyl, aryl and heterocyclic groups may have a substituent.

In formula (III), $R_5$, $R_6$, $R_7$ and $R_8$ each signifies a hydrogen atom, an alkyl group having 1–12 carbon atoms, or an aryl or heterocyclic group having 6–12 carbon atoms. Such alkyl, aryl and heterocyclic groups may have a substituent.

In formula (III), $X_1$ signifies a simple linkage or a divalent group. Examples of a divalent group include: alkylene groups such as methylene, ethylene, 1-hydroxyethylene and octylene groups; alkenylene groups such as vinylene and 2-butene groups; and arylene groups such as a phenylene group.

Typical examples of the compound represented by formulas (II) and (III) are specifically listed below for illustrative purposes only:

(17) acetamide
(18) propionamide
(19) n-butylamide
(20) i-butylamide
(21) benzamide
(22) benzylamide
(23) malonamide
(24) dimethylformamide
(25) dimethylacetamide
(26) cystinediamide
(27) 2-chloropropionam:ide
(28) t-butylamide
(29) hexaneamide
(30) nicotinic acid amide
(31) imidazole-2-carboxyamide
(32) succinamide
(33) maleamide
(34) decanediamide
(35) oxamide
(36) malamide
(37) alanineamide
(38) phthalamide
(39) laurylamide.

In formula (IV), $R_9$, $R_{10}$, $R_{11}$ and $R_{12}$ each signifies a hydrogen atom, an alkyl group having 1–12 carbon atoms, acyl group or an aryl group having 6–12 carbon atoms. Such alkyl, acyl and aryl groups may have a substituent.

In formula (V), $R_{13}$, $R_{14}$, $R_{15}$, $R_{16}$, $R_{17}$ and $R_{18}$ each signifies a hydrogen atom, an alkyl group having 1–12 carbon atoms, an acyl group or an aryl group having 6–12 carbon atoms. Such alkyl, acyl and aryl groups have a substituent.

In formula (V), $X_2$ signifies a simple linkage or a divalent group. Examples of a divalent group include: alkylene groups such as methylene, ethylene and propylene groups; and arylne groups such as a phenylene group.

Typical examples of the compounds represented by formulas (IV) and (V) are specifically listed below for illustrative purposes only:

(40) urea
(41) 1-methylurea
(42) 1,3-dimethylurea
(43) 1,3-diethylurea
(44) ethylene urea
(45) 1,3-diisopropylurea
(46) 1,1-dimethylurea
(47) 1,3-dibutylurea
(48) 1,3-dimethoxyethylurea
(49) tetramethylurea
(50) phenylurea
(51) diphenylurea
(52) tetraethylurea
(53) propylene diurea
(54) trimethylurea
(55) triethylurea
(56) acetylurea
(57) 1,3-dimethylolurea
(58) ethylurea
(59) biurea
(60) 1,1-diethylurea.

All of the compounds represented by formulas (I) to (V) are readily available either on the commercial market or through synthesis by one skilled in the art.

The compounds of formulas (I) to (V) are used as hot solvents for the heat-developable light-sensitive material of the present invention. These compounds (which are hereunder referred to as the hot solvents of the present invention) may be incorporated in heat-developable light-sensitive layers containing light-sensitive silver halide or in non-sensitive layers free from any light-sensitive silver halide such as subbing layers, intermediate layers and protective layers.

If the hot solvents of the present invention are incorporated in heat-developable light-sensitive layers, their amount preferably ranges from 5 to 500 wt% of the binder present in the light-sensitive layer, with the range of 10–300 wt% being more preferable. Most preferably, the hot solvents of the present invention are used in amounts ranging from 50 to 200 wt% of the binder in the light-sensitive layer. If the hot solvents of the present invention are incorporated in non-sensitive layers, their amount preferably ranges from 5 to 500 wt% of the binder present in the non-sensitive layer, with the range of 10–300 wt% being more preferable. The most preferable range is from 50 to 200 wt% of the binder.

The hot solvents of the present invention are preferably incorporated in heat-developable light-sensitive layers.

The hot solvents of the present invention may be used individually or in combination with themselves. If desired, they may be used in combination with compounds which serve as hot solvents outside the scope of the present invention. In the last-mentioned case, the hot solvents of the present invention must be present in amounts of at least 50 wt% of the total amount of the hot solvents used.

The hot solvents of the present invention may be incorporated in coating solutions by various methods such as incorporation after being dissolved in water or a water-miscible solvent (e.g., methanol, ethanol, acetone or tetrahydrofuran), incorporation after grinding with a ball mill or a sand mill, and incorporation after being dissolved in an oil to make an oil-in-water emulsion.

A particularly advantageous heat-developable light-sensitive material that features both high maximum density and high sensitivity can be attained in accordance with the present invention by incorporating in a silver halide emulsion layer not only the light-sensitive silver halide grains of the present invention (i.e., the core/shell type light-sensitive silver halide grains that have a silver iodide content of 4–40 mol% and which have a lower silver iodide content in the surface layer than in the internal phase) but also known tabular light-sensitive silver halide grains having aspect ratios of 5 or more.

Most of the photographic characteristics such as fog, sensitivity, tone gradation and maximum density of both silver-image forming black-and-white heat-developable light-sensitive materials and full color providing materials depend on the nature of light-sensitive silver halide employed. The use of tabular silver halide grains with a view to providing improved developability is shown in Unexamined Published Japanese Patent Application Nos. 142539/1984 and 18055/1984 and Japanese Patent Application No. 198841/1984. This is effective in providing high density but if tabular silver halide grains are used alone satisfactory maximum densities cannot be attained. This problem can be solved by using the light-sensitive silver halide grains of the present invention in combination with tabular silver halide grains. The morphology of the tabular silver halide grains is the same as described in connection with the tabular light-sensitive silver halide grains of the present invention. The tabular silver halide grains which may be used in combination with the light-sensitive silver halide grains of the present invention have particle sizes ranging from 0.1 to 4.0 μm, more preferably from 0.5 to 3.0 μm. The thickness of these tabular grains is preferably smaller than 0.3 μm, more preferably smaller than 0.2 μm. The silver halide composition of the tabular silver halide grains to be used in combination with the light-sensitive silver halide grains of the present invention is preferably silver iodobromide or silver chloroiodobromide, with the silver iodide content ranging from 0 to 40 mol%, more preferably from 0 to 10 mol%.

The tabular silver halide grains to be used in combination with the light-sensitive silver halide grains of the present invention may be prepared by a known method wherein silver halide grains and allowed to grow by simultaneous addition of a silver nitrate solution and a halide solution into a reactor having an atmosphere the pBr of which is maintained at a comparatively low level of 0.6–2.0, preferably 0.8–1.5 (pBr is a concentration of bromide ions as defined by the common logarithm of the reciprocal of the number of gram ions of bromide in a 1,000 ml solution). The desired tabular grains can be formed by adding the silver nitrate and halide solutions at controlled rates while the pBr is controlled during the growth of silver halide grains so as to avoid the formation of any new crystal nuclei. If desired, appropriate solvents for silver halide may be employed in the preparation of tabular silver halide grains. For details of the preparation of tabular silver halide grains, reference may be made to Unexamined Published Japanese Patent Application Nos. 108526/1983, 111933/1983 and 111934/1983.

If tabular silver halide grains are used in combination with the light-sensitive silver halide grains of the present invention, their amount preferably ranges from 10 to 80 mol% of the light-sensitive silver halide grains of the present invention, with the range of 20–50 mol% being more preferable.

Whether a heat-developable light-sensitive material is of the full color type or the black-and-white type which involves the formation of silver image, image formation is usually achieved by performing heat development either after or simultaneously with exposure. Since heat development is typically conducted at temperatures of 80° C. or higher, the resulting effects on silver halides are by no means insignificant. One of the most notable effects exerted by heat development is desensitization and the present inventors learned that an exposed heat-developable light-sensitive material that was thermally developed at a temperature of 80° C. or higher achieved a lower sensitivity than a control that was developed at 40° C. or below with a processing solution commonly employed in the practice of the wet process. Desensitization on account of heat development was particularly pronounced with a heat-developable light-sensitive material containing a sensitizing dye. These phenomena are considered to have resulted from the fact that part of the latent image forming on the silver halide grains in the exposed light-sensitive material was thermally bleached during heat development. However, no established theory is available for explaining the mechanism behind these phenomena.

Addition of sensitizing dyes to silver halides serves to provide them with high sensitivity to visible and infrared light by spectral sensitization and is essential to heat-developable light-sensitive materials. Therefore, efforts to avoid the desensitization that results from heat development are particularly needed in the field of heat-developable light-sensitive materials.

This need can be satisfied by a heat-developable light-sensitive material that contains at least one compound represented by the following general formula (VI) in combination with at least one compound represented by the following general formula (VII) in a silver halide emulsion layer containing the light-sensitive silver halide grains of the present invention. The material achieves high sensitivity and yet experiences a small degree of densitization as a result of thermal development:

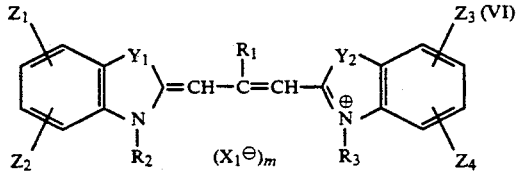

wherein $R_1$ is a hydrogen atom, an alkyl group, anaryl group or a heterocyclic group; $R_2$ and $R_3$ are each an alkyl group; $Y_1$ and $Y_2$ are each an oxygen atom, a sulfur atom or a selenium atom; $Z_1$, $Z_2$, $Z_3$ and $Z_4$ are each a hydrogen atom, a halogen atom, a hydroxyl group, an alkoxy group, an acyl group, an alkoxycarbonyl group, an alkoxycarbonylamino group, an acylamido group, an aryl group, an alkyl group or a cyano group, provided that $Z_1$ and $Z_2$ (and/or $Z_3$ and $Z_4$) may combine with each other to form a ring; $X_1\ominus$ is an anion; and m is 0 or 1;

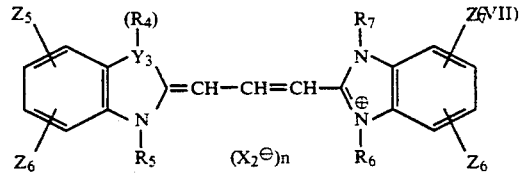

where $R_4$, $R_5$, $R_6$ and $R_7$ are each a hydrogen atom, an alkyl group, an aryl group or an alkenyl group; $Y_3$ is a nitrogen atom, a sulfur atom or a selenium atom, provided that $R_4$ is absent if $Y_3$ is a sulfur atom or a selenium atom; $Z_5$, $Z_6$, $Z_7$ and $Z_8$ are each a hydrogen atom, a halogen atom, a hydroxyl group, an alkoxy group, an acyl group, an acylamido group, an acyloxy group, an alkoxycarbonyl group, an aryloxycarbonyl group, a carbamoyl group, an alkoxycarbonylamino group, an aryl group, an alkyl group, a cyano group, a sulfonyl group or a heterocyclic group, provided that $Z_5$ and $Z_6$ (and/or $Z_7$ and $Z_8$) may combine with each other to form a ring; $X_2\ominus$ is an anion; and n is 0 or 1.

The compounds of formulas (VI) and (VII) serve as sensitizing dyes in the present invention and are hereinafter referred to as the sensitizing dyes of the present invention.

The alkyl group which is signified by $R_1$ in formula (VI) is preferably a lower alkyl group such as methyl, ethyl or propyl, with ethyl being particularly preferable. The aryl group which is also signified by $R_1$ in formula (VI) is illustrated by a phenyl group, and examples of the heterocyclic group which is another candidate for $R_1$ include furyl and thiofuryl groups.

The alkyl group which is signified by each of $R_2$ and $R_3$ in formula (VI) is preferably a lower alkyl group which is illustrated by methyl, ethyl, butyl or a substituted group such as sulfoethyl, carboxypropyl or sulfobutyl, with sulfopropyl being particularly preferable.

The halogen atom which is signified by each of $Z_1$, $Z_2$, $Z_3$ and $Z_4$ is chlorine, bromine, iodine or fluorine and it is preferable that at least one of $Z_1$ and $Z_2$ and at least one of $Z_3$ and $Z_4$ are a chlorine atom. Examples of the other candidates for $Z_1$, $Z_2$, $Z_3$ and $Z_4$ are as follows: alkoxy groups such as methoxy, ethoxy, propoxy and butoxy; acyl groups such as acetyl; acylamido groups such as acetamido and propionamido; alkoxycarbonyl groups such as ethoxycarbonyl and propoxycarbonyl; alkoxycarbonylamino groups such as ethoxycarbonylamino, propoxycarbonylamino and butoxycarbonylamino; aryl groups such as phenyl and tolyl; and alkyl groups which are preferably lower alkyl groups such as methyl, ethyl and propyl.

In formula (VI), $Z_1$ and $Z_2$ (and/or $Z_3$ and $Z_4$) may combine with each other to form a ring such as a benzene ring, and it is preferable that the combination of $Z_1$ and $Z_2$ and that of $Z_3$ and $Z_4$ both make a benzene ring. This benzene ring may have a substituent. Examples of the anion signified by $X_1\ominus$ in formula (VI) include chloride, bromide, iodide, thiocyanate, sulfamate, methyl sulfate, ethyl sulfate, perchlorate and p-toluenesulfonate.

The alkyl group which is represented by each of $R_4$, $R_5$, $R_6$ and $R_7$ in formula (VII) is preferably a lower alkyl group such as methyl, ethyl, butyl and a substituted group such as sulfoethyl, carboxypropyl or sulfobutyl.

An example of the aryl group which is represented by each of $R_4$, $R_5$, $R_6$ and $R_7$ in formula (VII) is a phenyl group. The alkenyl group which is the other candidate for these groups is illustrated by an allyl group. The alkenyl and aryl groups may have substituents such as sulfo, alkoxy, acyloxy and aminocarbonyl, with sulfo being optionally in the form of salts thereof.

Examples of the candidates for each of $Z_5$, $Z_6$, $Z_7$ and $Z_8$ in formula (VII) are as follows: halogen atoms such as chlorine, bromine, iodine and fluorine; alkoxy groups such as methoxy, ethoxy, propoxy and butoxy; acyl groups such as acetyl; acylamido groups such as acetamido and propionamido; acyloxy groups such as acetoxy and propionoxy; alkoxycarbonyl groups such as ethoxycarbonyl and propoxycarbonyl; aryloxycarbonyl groups such as phenoxycarbonyl; carbamoyl groups such as aminocarbonyl and diethylcarbonyl; alkoxycarbonylamino groups such as ethoxycarbonylamino, propoxycarbonylamino and butoxycarbonylamino; aryl groups such as phenyl and tolyl; alkyl groups which are preferably lower ones such as methyl, ethyl and propyl; sulfonyl groups such as alkylsulfonyl, aminosulfonyl, morpholinosulfonyl and piperidinosulfonyl; and heterocyclic groups such as benzo xazole. In formula (VII), $Z_5$ and $Z_6$ (and/or $Z_7$ and $Z_8$) may combine with each other to form a ring such as a benzene ring, which may optionally have a substituent. Examples of the anion signified by $X_2\ominus$ in formula (VII) include chloride, bromide, iodide, thiocyanate, sulfamate, methyl sulfate, ethyl sulfate, perchlorate and p-toluenesulfonate.

Among the compounds represented by formula (VI), those which are represented by the following general formula (VI') are particularly preferable, and among the compounds represented by formula (VII), those which are represented by the following general formula (VII') are particularly preferable:

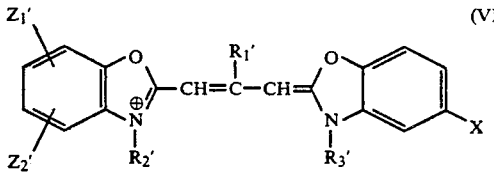

(VI')

where $R_1'$ is an alkyl group; $R_2'$ and $R_3'$ each signifies an alkyl group, provided that at least one of $R_2'$ and $R_3'$ is an alkyl group having a sulfo group or a sulfo-containing group; $Z_1'$ and $Z_2'$ are each a hydrogen atom, a halogen atom, an aryl group, an alkyl group or an alkoxy group, provided that $Z_1'$ and $Z_2'$ may combine with each other to form a ring; and X is a halogen atom;

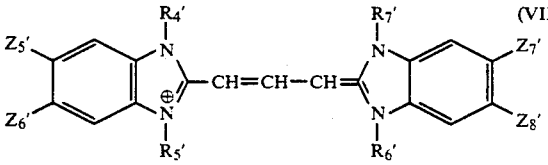

(VII')

where $R_4'$, $R_5'$, $R_6'$ and $R_7'$ each signifies an alkyl group, an aryl group or an alkenyl group, provided that at least one of $R_5'$ and $R_6$ is an alkyl group having a sulfo group or a sulfo-containing group; $Z_5'$, $Z_6'$, $Z_7'$ and $Z_8'$ each signifies a halogen atom, an acylamido group, an acyloxy group, an alkoxycarbonyl group, an aryloxycarbonyl group, an aminocarbonyl group, a sulfonyl group, a cyano group, an alkyl group, an aryl group or a heterocyclic group.

In formula (VI'), $R_1'$ signifies an alkyl group, preferably a lower alkyl group; $R_2'$ and $R_3'$ each signifies an alkyl group which may have a substituent such as sulfo, carboxy or alkoxy, with each of the acid groups optionally being in the form of salts thereof. At least one of $R_2'$ and $R_3'$ is an alkyl group having a sulfo group or a sulfo-containing group.

In formula (VI'), $Z_1'$ and $Z_2'$ each signifies a hydrogen atom, a halogen atom, an aryl group, an alkoxy group or an alkyl group, and $Z_1'$ and $Z_2'$ may combine with each other to form a ring. Preferably one of $Z_1'$ and $Z_2'$ is a hydrogen atom with the other being a halogen atom. In formula (VI'), X signifies a halogen atom.

In formula (VII'), $R_4'$, $R_5'$, $R_6'$ and $R_7'$ each signifies an alkyl group, an aryl group or an alkenyl group, with alkyl and aryl groups optionally having a substituent such as sulfo, alkoxy, acyloxy or aminocarbonyl (the sulfo group may be in the form of salts thereof). At least one of $R_5'$ and $R_6'$ is an alkyl group having a sulfo group or a sulfo-containing group.

In formula (VII'), $Z_5'$, $Z_6'$, $Z_7'$ and $Z_8'$ each signifies a halogen atom, an acyl group, an acylamido group, an acyloxy group, an alkoxycarbonyl group, an aryloxycarbonyl group, an aminocarbonyl group, a sulfonyl group, a cyano group, an alkyl group, an aryl group or a heterocyclic group.

Typical examples of the compounds that are represented by formulas (VI) and (VII) and which may be used as the sensitizing dyes of the present invention are listed below for illustrative purposes only:

Illustrative compounds of formula (VI):

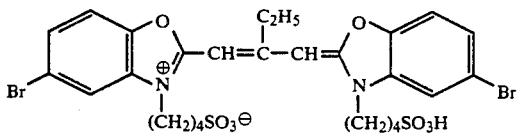

(VI-1)

-continued
(VI-2)
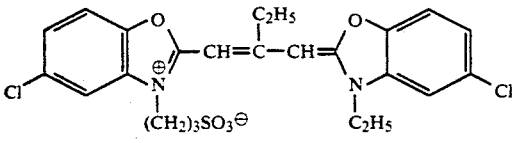
(VI-3)
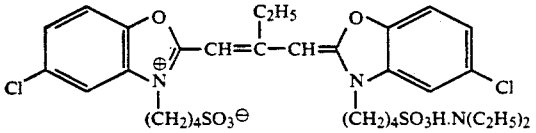
(VI-4)
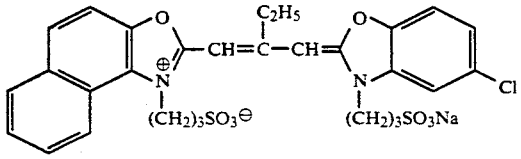
(VI-5)
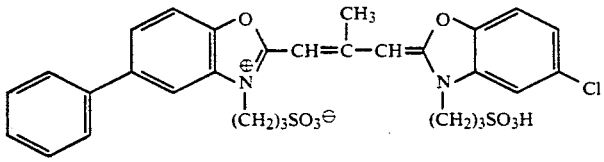
(VI-6)
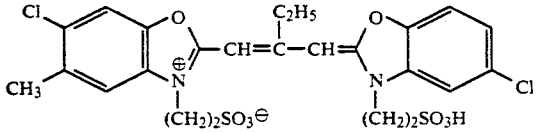
(VI-7)
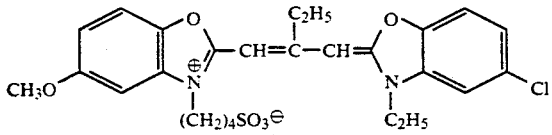
(VI-8)
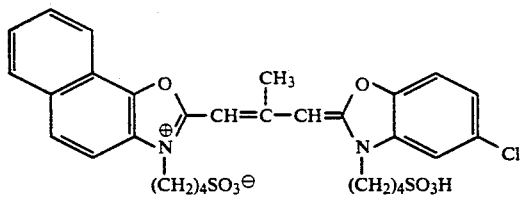
(VI-9)
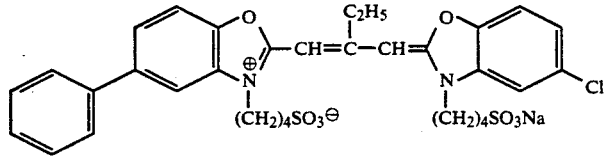
(VI-10)
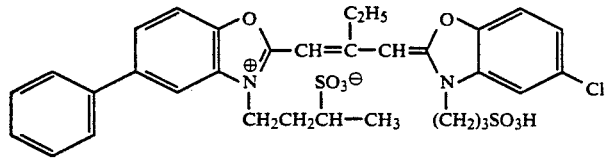

-continued
(VI-11)
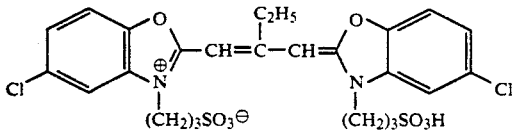
(VI-12)
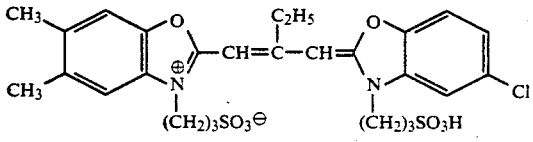
(VI-13)
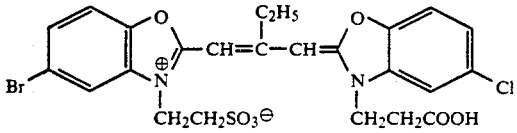
(VI-14)
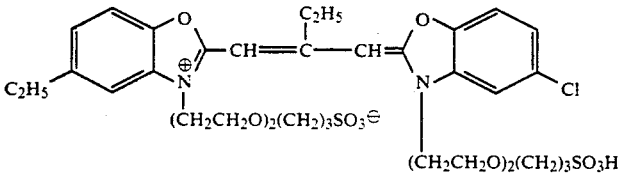
Illustrative compounds of formula (VII):
(VII-1)
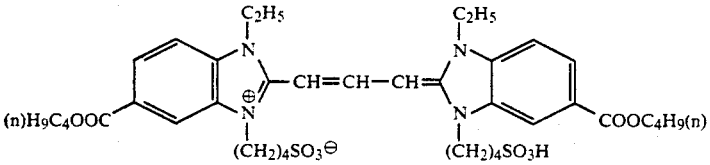
(VII-2)
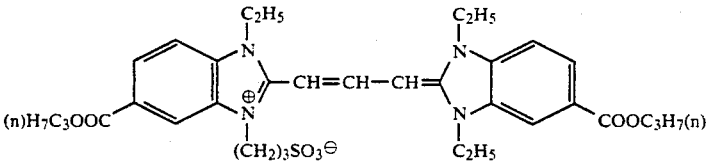
(VII-3)
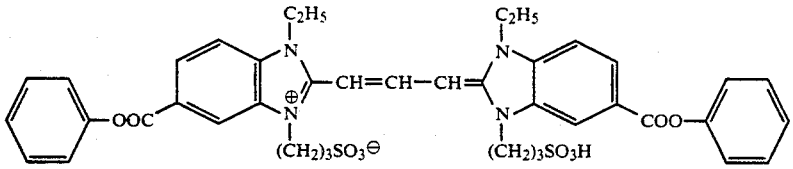
(VII-4)
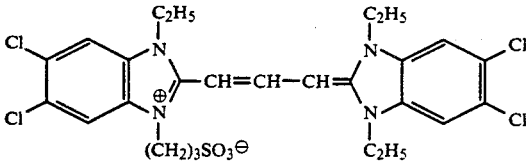
(VII-5)
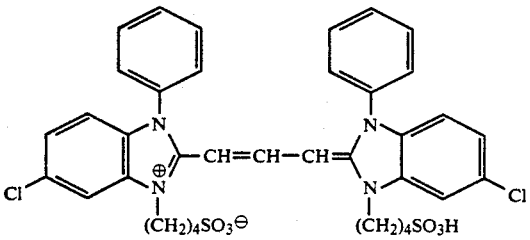

-continued
(VII-6)
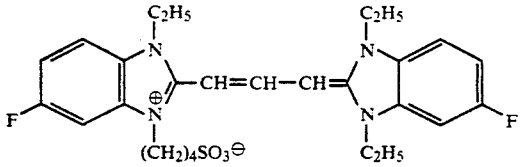
(VII-7)
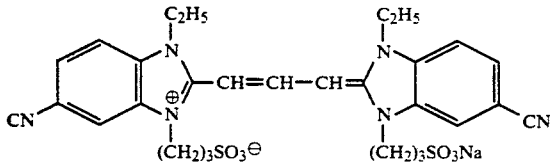
(VII-8)
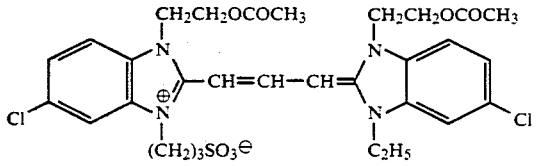
(VII-9)
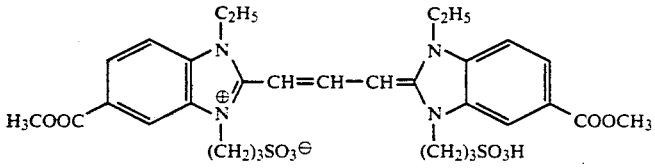
(VII-10)
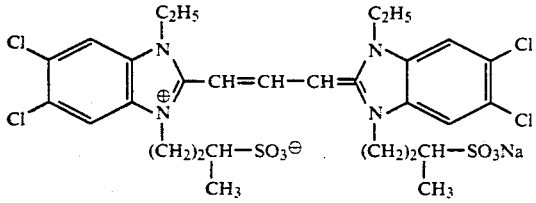
(VII-11)
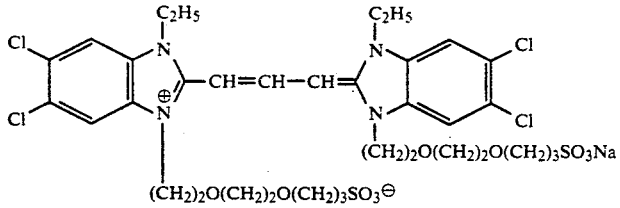
(VII-12)
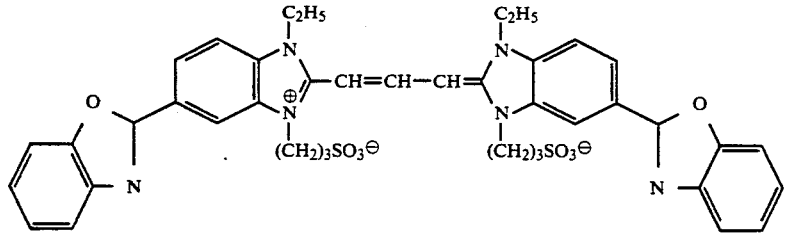
(VII-13)
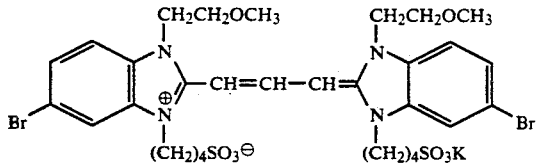

-continued
(VII-14)
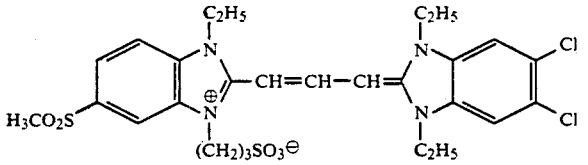
(VII-15)
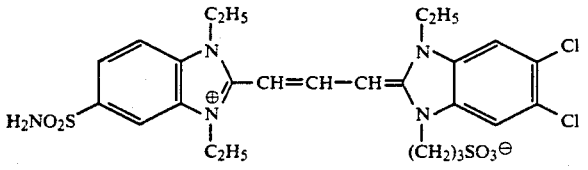
(VII-16)
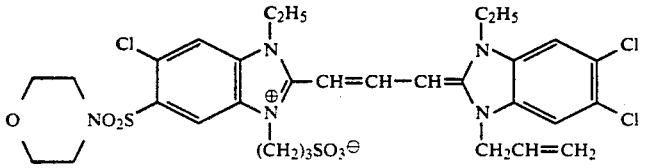
(VII-17)
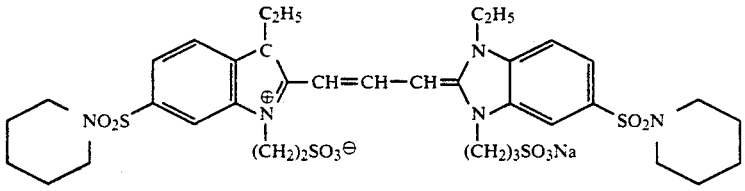
(VII-18)
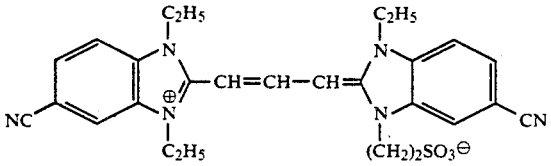
(VII-19)
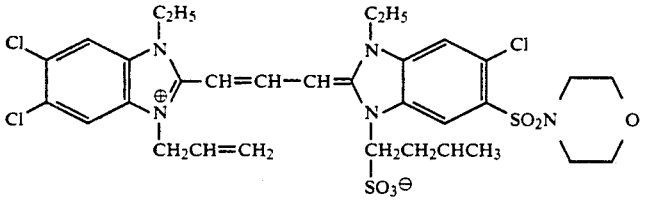
(VII-20)
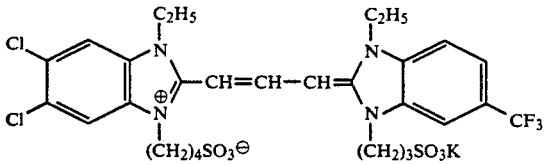
(VII-21)
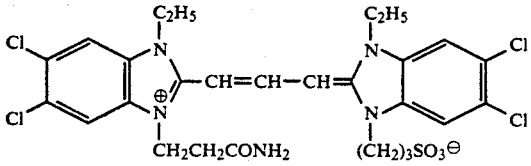
(VII-22)
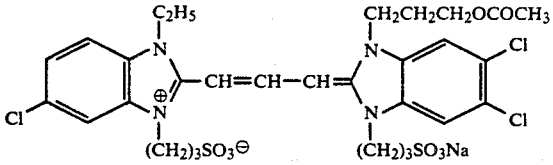

-continued
(VII-23)
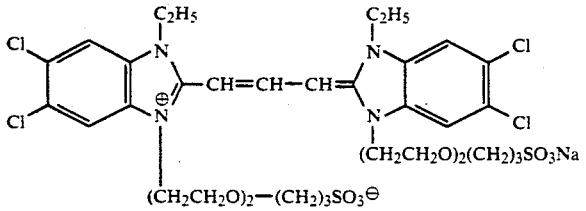
(VII-24)
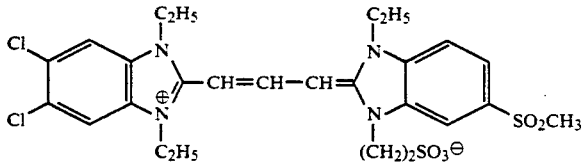
(VII-25)
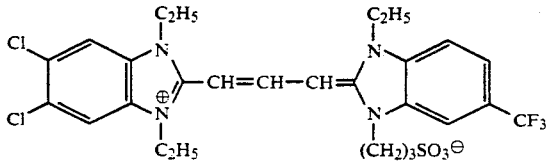
(VII-26)
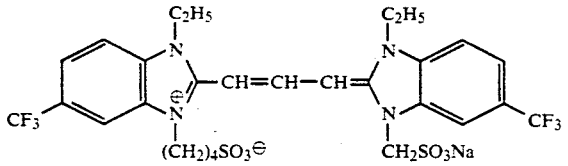
(VII-27)
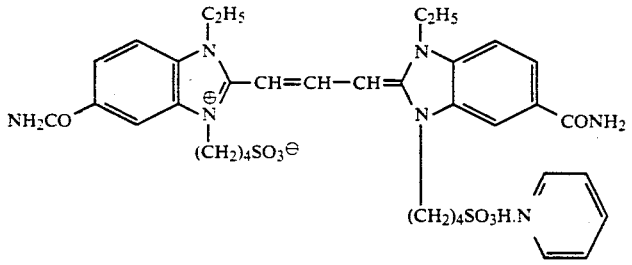
(VII-28)
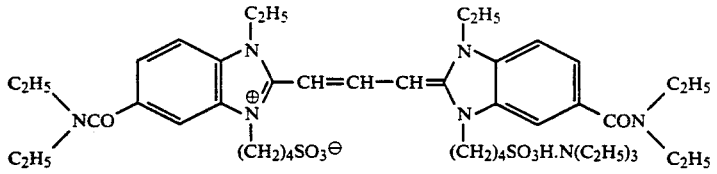
(VII-29)
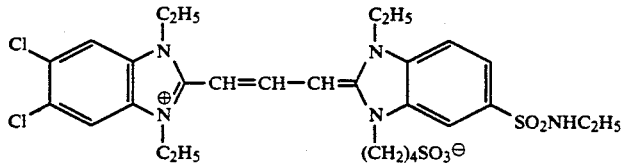
(VII-30)
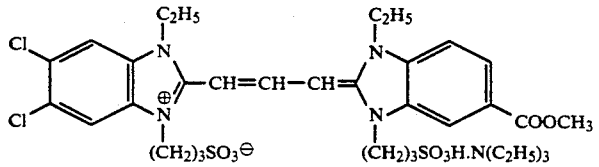

-continued
(VII-31)
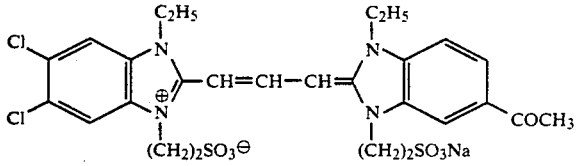
(VII-32)
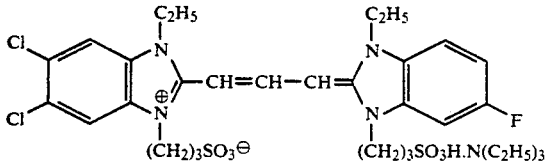
(VII-33)
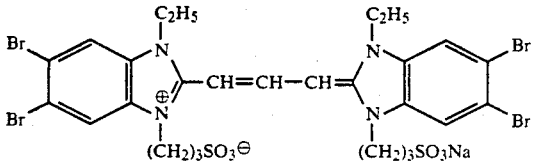
(VII-34)
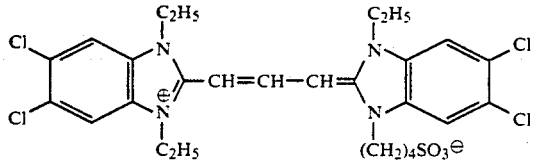
(VII-35)
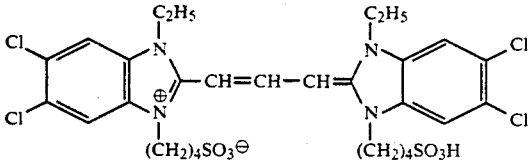
(VII-36)
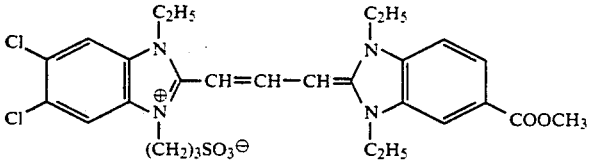
(VII-37)
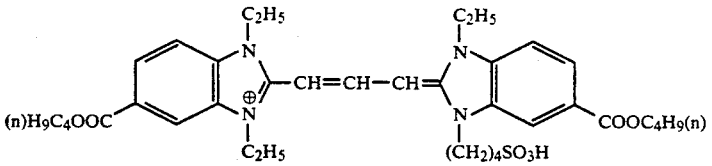
(VII-38)
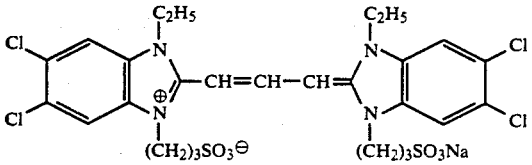
(VII-39)
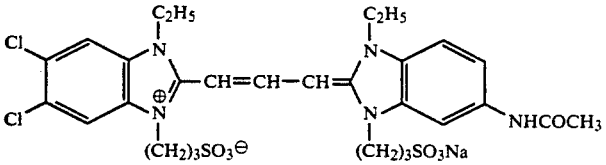

-continued

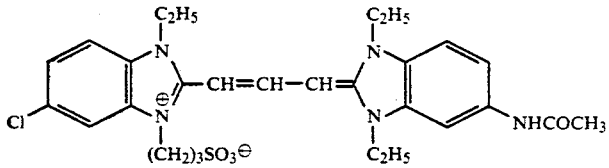

(VII-40)

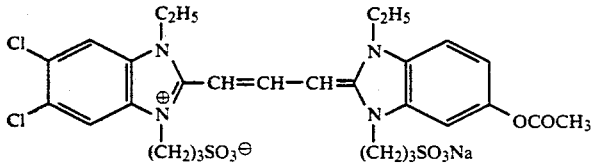

(VII-41)

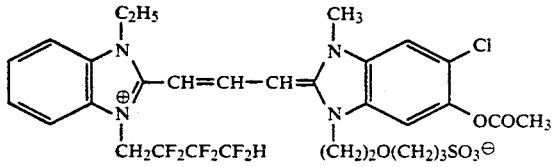

(VII-42)

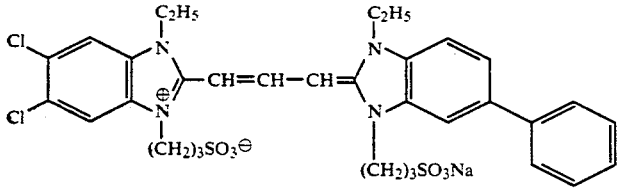

(VII-43)

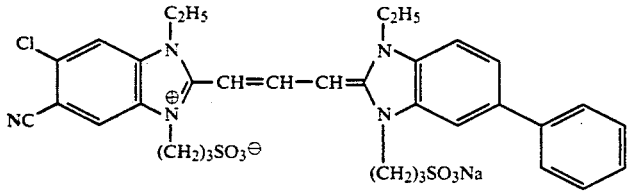

(VII-44)

The sensitizing dyes of the present invention which are represented by formulas (VI) and (VII) may be synthesized by any of the known methods and those skilled in the art will be capable of readily synthesizing such compounds with reference being made to, for example, F.M. Hamer, "The Cyanine Dyes and Related Compounds", Interscience Publisher, New York, 1964. It should be mentioned here that all of the sensitizing dyes suitable for use in the present invention can be synthesized in accordance with the methods shown in this reference.

In the present invention, a silver halide emulsion comprising the light-sensitive silver halide grains of the present invention described above is spectrally sensitized by addition of the sensitizing dyes of the present invention. The timing of the addition of these sensitizing dyes is not critical; they may be added before, during or after completion of the chemical ripening of the silver halide emulsion (this chemical ripening is also known as the second ripening) or at any suitable point of time that precedes the coating of the emulsion. If the sensitizing dyes of the present invention are used in combination with themselves, they may be added either at a time or at different times, the former method being preferable.

The sensitizing dyes of the present invention may be incorporated in the silver halide emulsion by any of the methods commonly employed in the photographic industry. In one method which is described in U.S. Pat. No. 3,469,987, a compound which serves as the sensitizing dye of the present invention is first dissolved in an organic solvent and the resulting solution is dispersed in a hydrophilic colloid, the dispersion being subsequently added to the emulsion. If desired, compounds which serve as the sensitizing dyes of the present invention may be dissolved individually in either the same solvent or different solvents and the resulting solutions may be added to the emulsion either separately or after being mixed together.

Preferable examples of the solvent in which the sensitizing dye of the present invention is dissolved are watermiscible organic solvents such as methyl alcohol, ethyl alcohol and acetone.

Each of the compounds of formulas (VI) and (VII) which serve as the sensitizing dyes of the present invention is preferably incorporated in a silver halide emulsion in an amount of $1\times10^{-5}$ to $2.5\times10^{-2}$ moles, more preferably from $1.0\times10^{-4}$ to $1.0\times10^{-3}$ mole, per mole of the light-sensitive silver halide. If a compound of formula (VI) is used in combination with a compound of formula (VII), the ratio of the amount of the compound (VII) to that of the compound (VI) is preferably within the range of 0.1 : 1 to 10 : 1.

The sensitizing dyes of the present invention may be used in combination with compounds that serve as sensitizing dyes that are outside the scope of the present invention or with compounds that serve as supersensitizers.

A particularly advantageous heat-developable light-sensitive material that provides high sensitivity and which yet undergoes a significantly reduced degree of thermal fogging can be attained by incorporating at least one compound represented by the following general formula (VIII) and at least one compound represented by the following general formula (IX) in a silver halide emulsion layer containing the light-sensitive silver halide grains of the present invention;

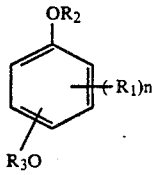

(VIII)

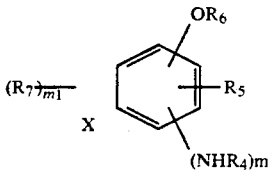

(IX)

In formula (VIII), $R_1$ signifies a halogen atom (preferably, chlorine , bromine or iodine), an alkyl group (preferably an alkyl group having 1–24 carbon atoms such as methyl, ethyl, butyl, t-amyl, t-octyl, n-dodecyl, n-pentadecyl, heptadecyl, octadecyl or cyclohexyl, or an aryl-, preferably phenyl-, substituted alkyl group such as benzyl or phenethyl), an aryl group (e.g., phenyl, naphthyl, tolyl or mesityl), an acyl group (e.g., acetyl, tetradecanoyl, pivaloyl, or substituted or unsubstituted benzoyl), an alkyloxycarbonyl group (e.g., methoxycarbonyl or benzyloxycarbonyl), an aryloxycarbonyl group (e.g., phenoxycarbonyl, p-tolyloxycarbonyl or α-naphthoxycarbonyl), an alkylsulfonyl group (e.g., methylsulfonyl), an arylsulfonyl group (e.g., phenylsulfonyl or alkylphenylsulfonyl), an alkylamino group (e.g., ethylamino or t-octylamino), an arylamino group (e.g., anilino or a substituted anilino, with an illustrative substituent being a halogen atom, an alkyl group, an amido group or an imido group), a carbamoyl group (e.g., substituted or unsubstituted alkylcarbamoyl, methylcarbamoyl, butylcarbamoyl, tetradecylcarbamoyl, N-methyl-N-dodecylcarbamoyl, optionally substituted phenoxyalkylcarbamoyl such as 2,4-di-t-phenoxybutylcarbamoyl, substituted or unsubstituted phenylcarbamoyl such as 2-dodecyloxyphenylcarbamoyl), an acylamino group (e.g., n-butylamido, laurylamido, optionally substituted β-phenoxyethylamido, phenoxyacetamido, substituted or unsubstituted benzamido, methanesulfonamidoethylamido or β-methoxyethylamido), an alkoxy group (preferably an alkoxy group having 1–18 carbon atoms such as methoxy, ethoxy or octadecyloxy), a sulfamoyl group (e.g., methylsulfamoyl, n-dodecylsulfamoyl, substituted or unsubstituted phenylsulfamoyl such a dodecylphenylsulfamoyl), an alkylsulfonylamino group (e.g., methylsulfonylamino), an arylsulfonylamino group (e.g., tolylsulfonylamino), a sulfonic acid group or a salt thereof, a carboxylic acid group or a salt thereof, a nitro group or a hydroxyl group; if $R_1$ is in plurality, they may combine with each other to form a saturated or unsaturated 5- or 6-membered ring; $R_2$ and $R_3$ are each a hydrogen atom or a protective group that will be eliminated upon decomposition (which is preferably a protective group that will be eliminated under alkaline conditions, such as

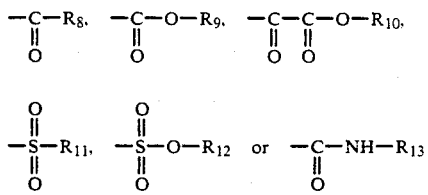

where $R_8$ to $R_{13}$ are each an alkyl group, a cycloalkyl group, an alkenyl group or an aryl group, which may be substituted by a halogen atom such as chlorine, bromine or fluorine); and n is an integer of 1 to 4.

Examples of the compounds represented by formula (VIII) are listed below for illustrative purposes only:

Illustrative compounds of formula (VIII)

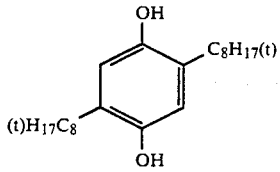

(VIII-1)

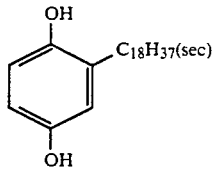

(VIII-2)

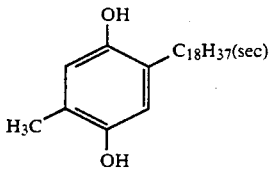

(VIII-3)

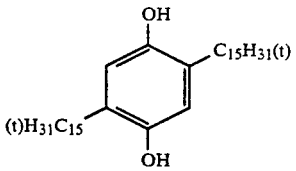

(VIII-4)

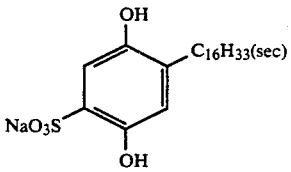

(VIII-5)

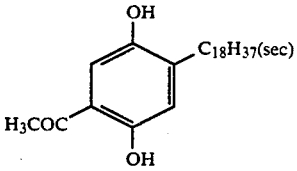

(VIII-6)

-continued
Illustrative compounds of formula (VIII)
(VIII-7)
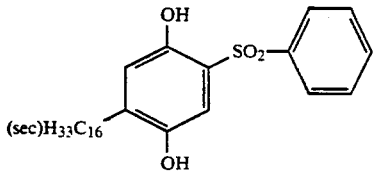
(VIII-8)
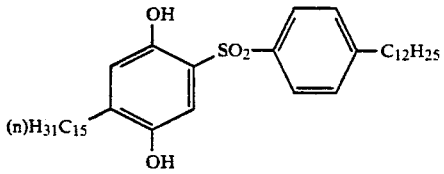
(VIII-9)
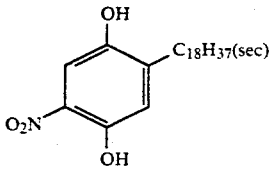
(VIII-10)
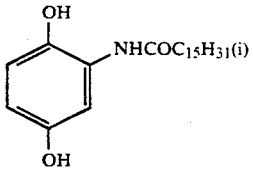
(VIII-11)
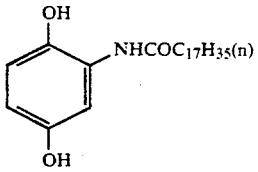
(VIII-12)
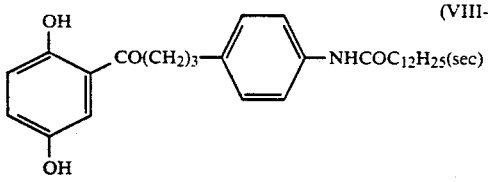
(VIII-13)
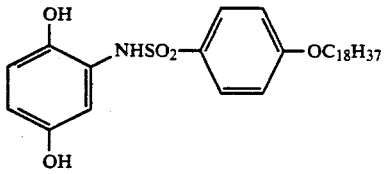
(VIII-14)
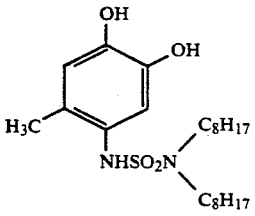
-continued
Illustrative compounds of formula (VIII)
(VIII-15)
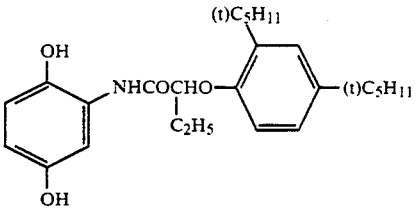
(VIII-16)
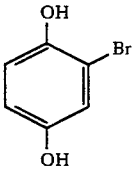
(VIII-17)
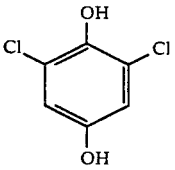
(VIII-18)
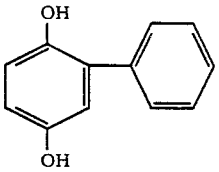
(VIII-19)
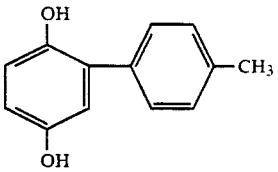
(VIII-20)
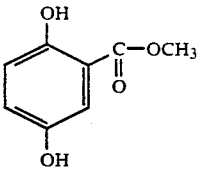
(VIII-21)
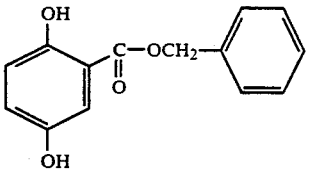
(VIII-22)
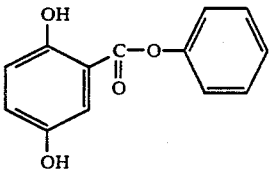

-continued

Illustrative compounds of formula (VIII)

(VIII-23)

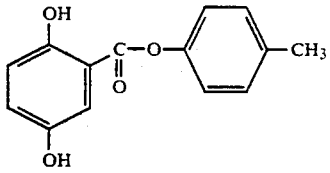

(VIII-24)

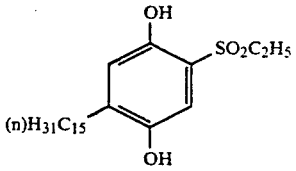

(VIII-25)

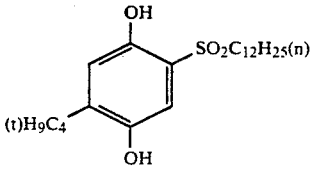

(VIII-26)

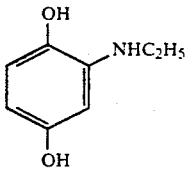

(VIII-27)

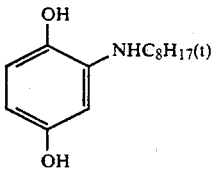

(VIII-28)

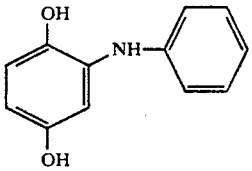

(VIII-29)

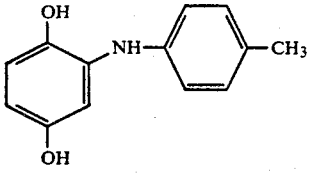

(VIII-30)

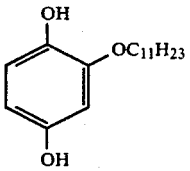

(VIII-31)

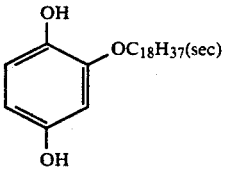

-continued

Illustrative compounds of formula (VIII)

(VIII-32)

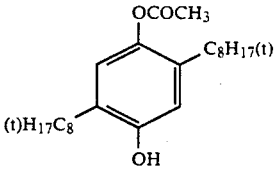

(VIII-33)

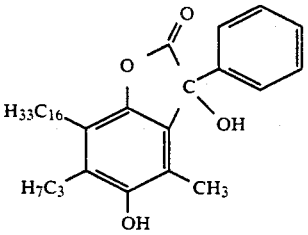

(VIII-34)

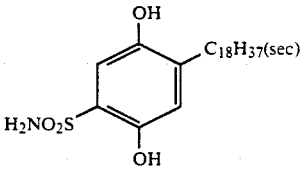

(VIII-35)

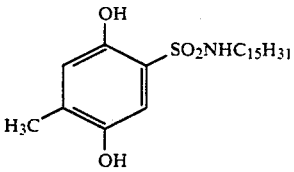

(VIII-36)

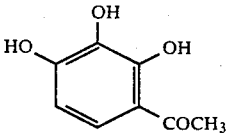

(VIII-37)

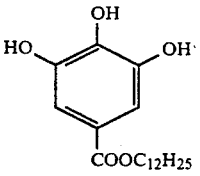

In formula (IX), $R_4$ signifies a hydrogen atom, an alkyl group (e.g., methyl, i-propyl, n-pentadecyl or trifluoromethyl), an aryl group (e.g., phenyl, tolyl or naphthyl), an acyl group (e.g., octylcarbonyl, trifluoromethylcarbonyl, acetyl, stearoyl, cyclohexanecarbonyl or tricarbonyl), an alkylsulfonyl group (e.g., methylsulfonyl), an arylsulfonyl group (e.g., phenylsulfonyl, p-tolylsulfonyl, or p-dodecyloxyphenylsulfonyl), an alkylaminosulfonyl group (e.g., ethylaminosulfonyl, propylaminosulfonyl or t-octylaminosulfonyl), or an arylaminosulfonyl group (e.g., anilinosulfonyl); $R_5$ is a hydrogen atom, a halogen atom (preferably $C_1$, Br or I), an alkyl group (preferably an alkyl group having 1–24 carbon atoms such as methyl, ethyl, butyl, t-amyl, t-octyl, n-dodecyl, n-pentadecyl or cyclohexyl, or an aryl-, preferably phenyl-, substituted alkyl group such as benzyl or phenethyl), an aryl group (e.g., phenyl, naphthyl, tolyl or mesityl), an alkoxy group (e.g., methoxy or benzyloxy), an acylamino group (e.g., n-butylamido, laurylamido, optionally substituted β-phenoxyethylamido, phenoxyacetamido, substituted or unsubstituted benzamido, methanesulfonamidoethylamido or β-methoxyethylamido), or a sulfamoyl group (e.g., an alkylsulfamoyl group such as methylsulfamoyl or n-dodecylsulfamoyl, or an arylsulfamoyl group such as substituted or unsubstituted phenylsulfamoyl which is illustrated by dodecylphenylsulfamoyl); $R_6$ is a hydrogen atom or a protective group that will be eliminated upon decomposition which may be the same as the protective group mentioned for each of $R_2$ and $R_3$ in formula (VIII); X signifies $(R_5)_2$ or the atomic group necessary for forming a condensed carbon ring, and if X is $(R_5)_2$, $R_5$ may be the same or different; $R_7$ signifies a group having not less than 7 carbon atoms, such as n-heptyl, tolyl or n-pentadecyl; m is an integer of 0 to 2; and $m_1$ is 0 or 1.

Examples of the compounds represented by formula (IX) are listed below for illustrative purposes only:

Illustrative compounds of formula (IX)

(IX-1)

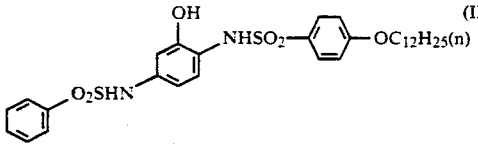

(IX-2)

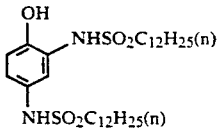

(IX-3)

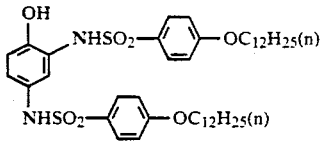

(IX-4)

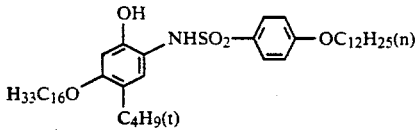

(IX-5)

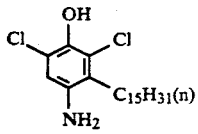

(IX-6)

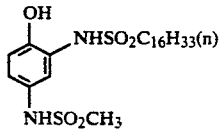

(IX-7)

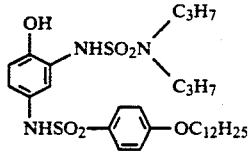

-continued

Illustrative compounds of formula (IX)

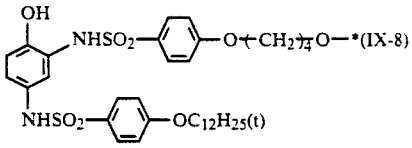

(IX-8)

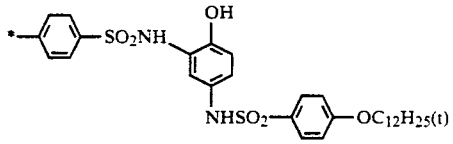

(IX-9)

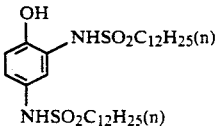

(IX-10)

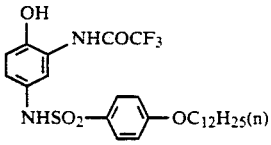

(IX-11)

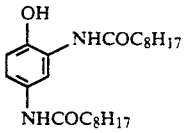

(IX-12)

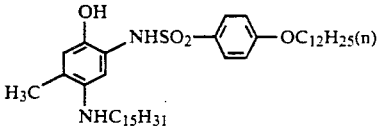

(IX-13)

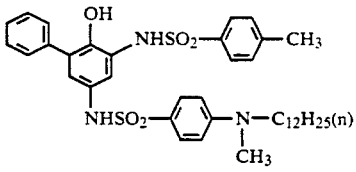

(IX-14)

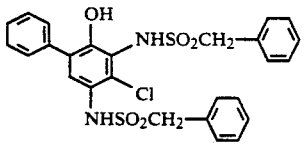

(IX-15)

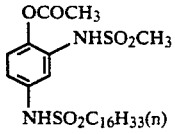

(IX-16)

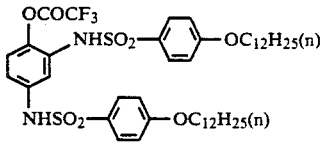

-continued

Illustrative compounds of formula (IX)

(IX-17)

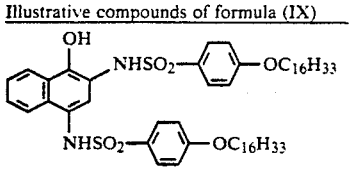

(IX-18)

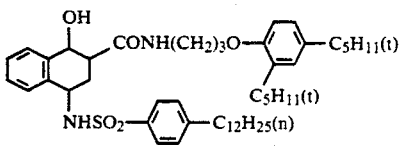

(IX-19)

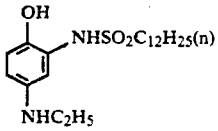

The compounds of formulas (VIII) and (IX) (hereunder referred to as the hydroxybenzene derivatives of the present invention) can be synthesized by any of the methods described in the following references: Methoden der Organishen Chemie, Houben-Weyl, Band V 1/1C, Phenole Teil 1, George Thime Verlag, Stuttgard, 1976; U.S. Pat. Nos. 4,205,987, 4,447,523, Unexamined Published Japanese Patent Application Nos. 188646/1984, 192246/1984, 192247/1984, 195238/1984, 195239/1984, 202465/1984, 204039/1984, 204040/1984 and 232341/1984.

The hydroxybenzene derivatives of the present invention may be added in varying concentrations depending upon such factors as the object of using a specific light-sensitive material, the type of the dye-providing material used, the site at which it is incorporated, and the conditions of heat development. In the general case, the derivatives are employed in amounts ranging from 0.001 to 0.5 moles, preferably from 0.005 to 0.2 moles, per mole of the silver halide used.

The hydroxybenzene derivatives of the present invention may be incorporated in at least one of the silver halide emulsion layers that make up the heat-developable light-sensitive material of the present invention and which contain a light-sensitive silver halide. The hydroxybenzene derivatives of the present invention may be used either independently or in combination with themselves. They may also be used in combination with at least one of the hydroquinone compounds that are outside the scope of the present invention or precursors thereof. This method is effective in improving the dispersion stability of the hydroxybenzene derivatives of the present invention.

The hydroxybenzene derivatives of the present invention may be incorporated in silver halide emulsion layers in the heat-developable light-sensitive material after they are dispersed in hydrophilic colloids. Dispersion in hydrophilic colloids may be achieved by any of the known methods among which the following are advantageous:

(1) the hydroxybenzene derivative of the present invention is dissolved in a substantially water-insoluble high-boiling point solvent and the solution is dispersed in a hydrophilic protective colloid to form very small particles of the derivative; in order to assist in the dissolution of the derivative, the water-insoluble high- melting point solvent may be used in combination with a low-melting point organic solvent or a water-miscible organic solvent, and these additional solvents may be removed by a suitable method such as washing with water or drying after coating;

(2) the hydroxybenzene derivative of the present invention is first dissolved in a water-miscible organic solvent, then a fillable polymer latex and a sufficient amount of water to render the hydroxybenzene derivative in the solution insoluble are slowly added so as to incorporate the hydroquinone and/or precursor thereof into the fillable polymer latex particles; and (3) the hydroxybenzene derivative of the present invention is reduced to fine particles by a suitable mechanical means such as a sand grinder or a colloid mill, the fine particles being then dispersed in a hydrophilic colloid.

These are not the sole methods that can be employed for the purpose of incorporating the hydroxybenzene derivatives of the present invention in silver halide emulsion layers and various other methods may of course be used.

The present inventors previously proposed the preparation of a low-fog, heat-developable light-sensitive material by employing a polymer-type dye-providing material having a weight average molecular weight within a specified range, and filed a patent application on Oct. 24, 1985 with the title of invention being "a heat-developable light-sensitive material". This material experienced a reasonably low level of fogging but the level attained was still short of the goal of the ideal heat-developable light-sensitive material.

The present inventors later found that the goal could be attained by employing the above described polymer-type dye-providing material in the heat-developable light-sensitive material of the present invention. A heat-developable light-sensitive material having at least the light-sensitive silver halide of the present invention, a dye-providing material, a reducing agent and a binder on a support features a particularly low level of thermal fogging if said dye-providing material is a polymer with a weight average molecular weight of at least 30,000 that has a recurring unit derived from a monomer that is represented by the following general formula (X) or (XI):

$$(Q—X_nCp_1 \quad (X)$$

$$(Q—Cp_2—X_nDye \quad (XI)$$

where Q is an ethylenically unsaturated group or a group having an ethylenically unsaturated group; $Cp_1$ and $Cp_2$ each signifies an organic group that reacts with the oxidized product of a reducing agent to form or release a diffusible dye; X is a divalent linkage which is bound to the active site of $Cp_1$ or $Cp_2$; n is 0 or 1; and Dye stands for a diffusible dye residue.

The polymer with a weight average molecular weight of at least 30,000 that has a recurring unit derived from a monomer that is represented by the formula (X) or (XI) is hereunder simply referred to as the dye-providing polymer of the present invention.

The dye-providing polymer of the present invention preferably has a weight average molecular weight of 30,000–5,000,000, more preferably from 100,000 to 2,000,000.

For the purposes of the present invention, weight average molecular weight measurement is conducted by gel permeation chromatography (GPC) using the following equipment and conditions:

GPC : HLC-802A (Toyo Soda Manufacturing Co., Ltd.)

Column : TSK gel (Toyo Soda Manufacturing Co., Ltd.) with one unit of GMH (Mw for exclusion limit, $4\times10^8$; column size, $7.51\times600$ mm)

Solvent :THF

Flow rate : 1 ml/min

Column temperature : 38° C.

Detector : UV-8 Model II (Toyo Soda Manufacturing Co., Ltd.) detection wavelength at 254 nm Calibration curve : prepared with TSK standard polystyrene (Toyo Soda Manufacturing Co., Ltd.)

If any part of the monomer represented by formula (X) or (XI) remains unreacted in the dye-providing polymer of the present invention, its residual amount is preferably not more than 5 wt% of the total polymer, with 0.5 wt% or less being more preferable. The content of such residual monomer is also measureable with the GPC method specified above.

In formulas (X) and (XI), Q represents an ethylenically unsaturated group or a group having an ethylenically unsaturated group and is preferably represented by the following formula (XII):

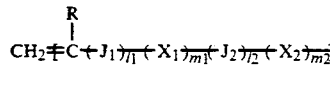

(XII)

where R is a hydrogen atom, a carboxyl group or an alkyl group (e.g., methyl or ethyl), said alkyl group optionally having a substituent such as a halogen atom (e.g., F or Cl) or a carboxyl group; the carboxyl group represented by R and the one as a substituent may form a salt; $J_1$ and $J_2$ are each a divalent linkage such as —NHCO—, —CONH—, —COO—, —OCO—, —SCO—, —COS—, —O—, —S—, —SO—or —$SO_2$—; $X_1$ and $X_2$ are each a divalent hydrocarbon group such as alkylene, arylene, aralkylene, alkylenearylene or arylenealkylene; illustrative alkylene groups are methylene, ethylene and propylene, an illustrative arylene group is phenylene, an illustrative aralkylene group is phenylmethylene, an illustrative alkylarylene group is methylenephenylene, and an illustrative arylenealkylene group is phenylenemethylene; k, $l_1$, $m_1$, $l_2$ and $m_2$ are each 0 to 1.

In formulas (X) and (XI), $Cp_1$ and $Cp_2$ each signifies what is generally known as a "coupler residue" and preferable examples thereof are represented by the following formulas:

[1]

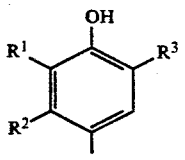

[2]

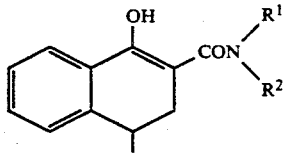

-continued

[3]

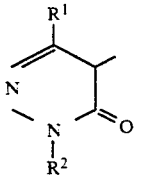

[4]

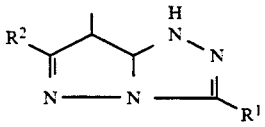

[5]

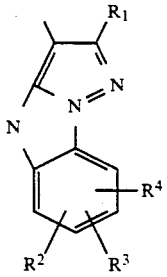

[6]

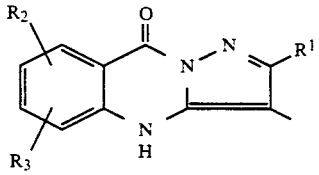

[7]

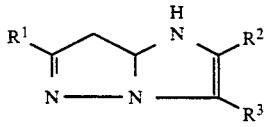

[8]

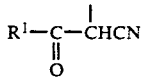

[9]

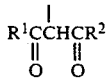

[10]

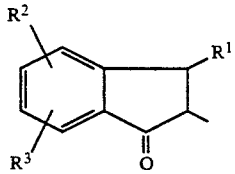

In formulas (1) to (10), $R_1$ to $R_4$ each signifies a hydrogen atom, a halogen atom, an alkyl group, a cycloalkyl group, an aryl group, an acyl group, an alkyloxycarbonyl group, an aryloxycarbonyl group, an alkylsulfonyl group, ar arylsulfonyl group, a carbamoyl group, a sulfamoyl group, an acyloxy group, an amino group, an alkoxy group, an aryloxy group, a cyano group, a ureido group, an alkylthio group, an arylthio group, a carboxy group, a sulfo group or a heterocyclic group; these groups may have substituents such as a hydroxyl group, a carboxyl group, a sulfo group, an alkoxy group, a cyano group, a nitro group, an alkyl group, ar aryl group, an aryloxy group, an acyloxy group, an acyl group, a sulfamoyl group, a carbamoyl group, an imido group and a halogen atom.

Selection of the substituents in $Cp_1$ and $Cp_2$ depends on the specific object of using $Cp_1$ and $Cp_2$ and at least one substituent on $Cp_2$ is an ethylenically unsaturated group or a group having an ethylenically unsaturated group, which are signified by Q.

Preferable examples of the divalent linkage signified by X in formulas (X) and (XI) are represented by the following general formulas (11) to (35):

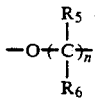
[11]

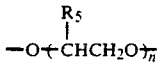
[12]

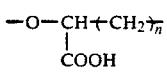
[13]

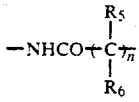
[14]

$-NHCONH-$ [15]

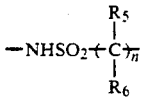
[16]

$-NHSO_2NH-$ [17]

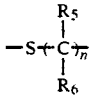
[18]

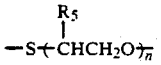
[19]

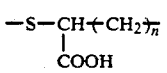
[20]

$-N=N-$ [21]

Where $R_5$ and $R_6$ each signifies a hydrogen atom or an alkyl group (e.g., methyl or ethyl), and n is 0, 1 or 2;

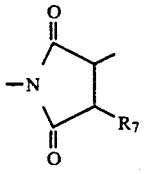
[22]

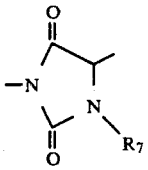
[23]

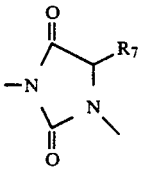
[24]

-continued

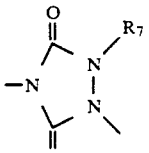
[25]

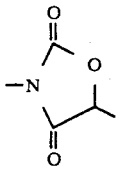
[26]

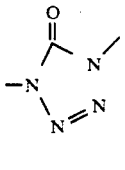
[27]

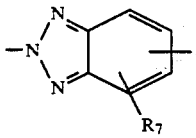
[28]

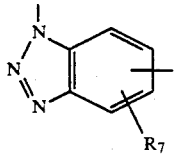
[29]

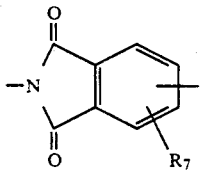
[30]

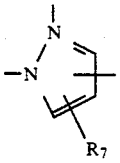
[31]

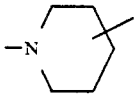
[32]

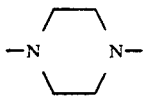
[35]

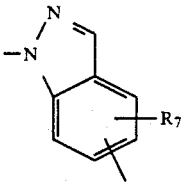
[34]

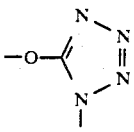
[35]

where $R_7$ signifies a hydrogen atom, a halogen atom, an alkyl group, a cycloalkyl group, an aryl group, an acyl group, an alkyloxycarbonyl group, an aryloxycarbonyl group, an alkylsulfonyl group, an arylsulfonyl group, a carbamoyl group, a sulfamoyl group, an acyloxy group, an amino group, an alkoxy group, an aryloxy group, a cyano group, a ureido group, an alkylthio group, an arylthio group, a carboxyl group, a sulfo group or a heterocyclic residue; these groups may have substituents such as a hydroxyl group, a carboxyl group, a sulfo group, an alkoxy group, a cyano group, a nitro group, an alkyl group, an aryl group, an aryloxy group, an acyloxy group, an acyl group, a sulfamoyl group, a carbamoyl group, an imido group and a halogen atom.

In formulas (X) and (XI), Dye signifies a dye residue that leaves upon reaction with the oxidized product of a reducing agent. Examples of such dye residue include an azo dye, an azomethine dye, an anthraquinone dye, a naphthoquinone dye, a styryl dye, a nitro dye, a quinoline dye and a phthalocyanine dye. Illustrative yellow, magenta and cyan dyes are represented by the following general formulas (36) to (70):

Yellow dyes

-continued
[36]
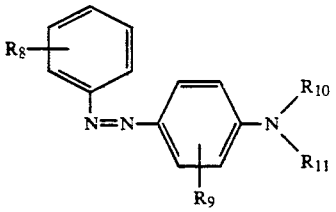
[37]
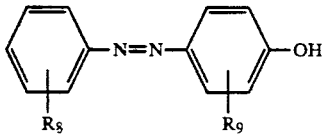
[38]
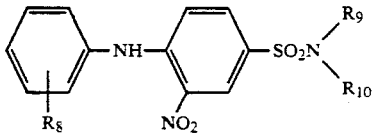
[39]
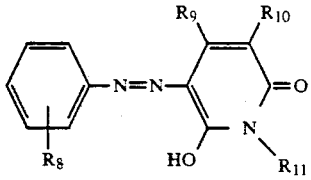
[40]
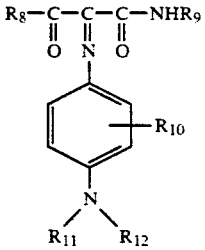
[41]
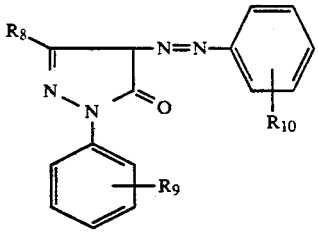
[42]
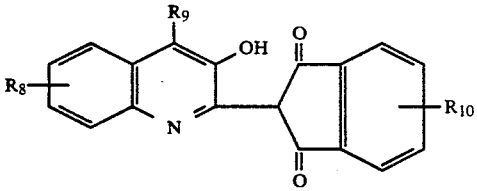
[43]
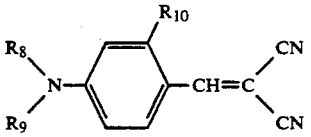
-continued
[44]
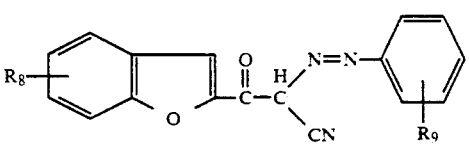
[45]
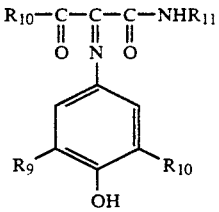
Magenta dyes
[46]
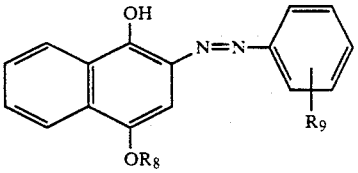
[47]
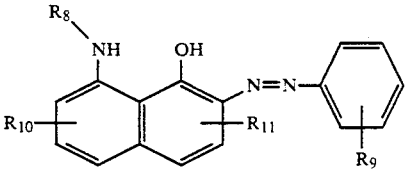
[48]
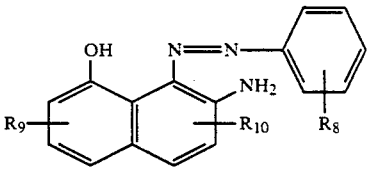
[49]
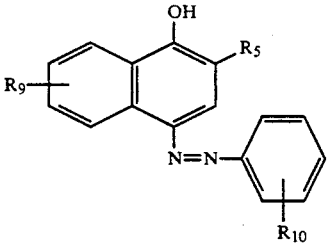
[50]
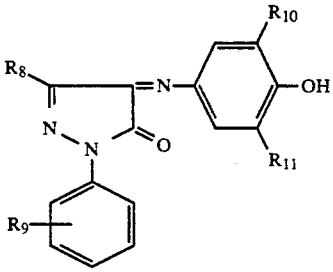

-continued
[51]
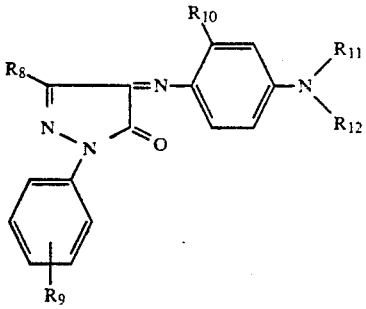
[52]
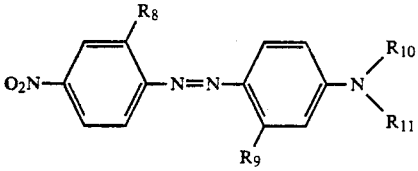
[53]
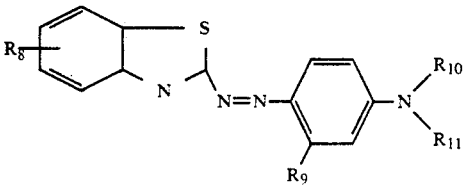
[54]
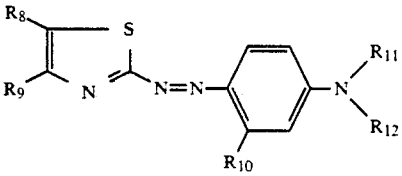
[55]
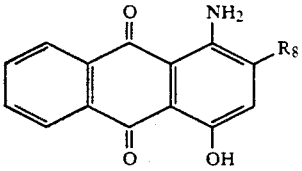
[56]
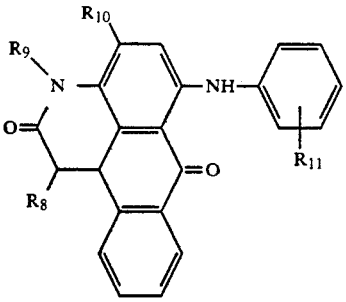
[57]
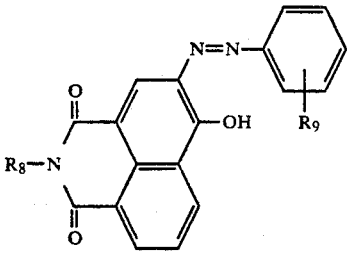
Cyan dyes
-continued
[58]
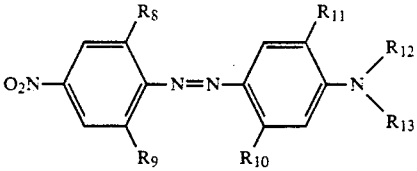
[59]
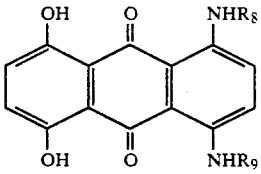
[60]
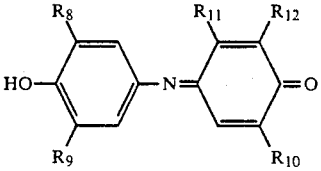
[61]
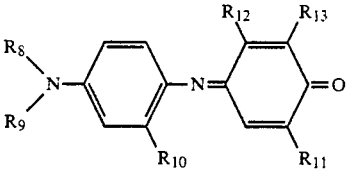
[62]
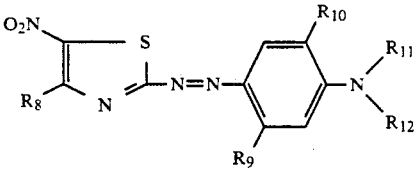
[63]
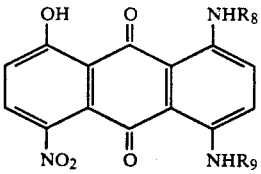
[64]
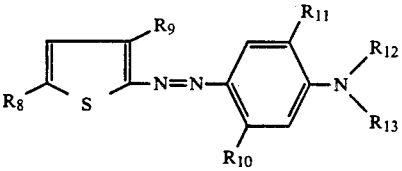
[65]
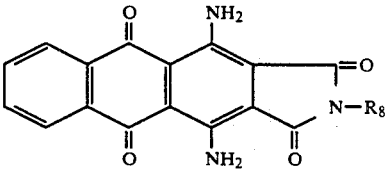

-continued

[66]

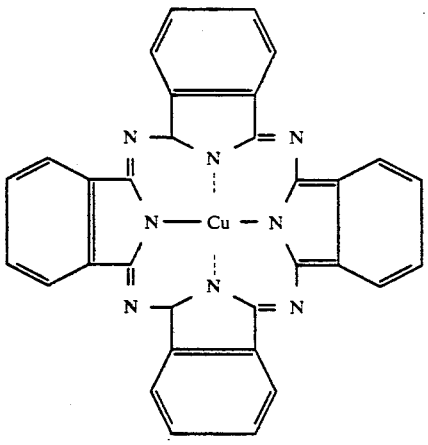

[67]

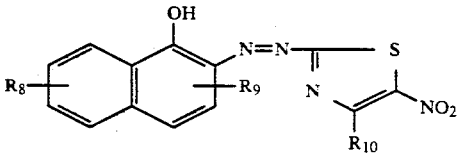

[68]

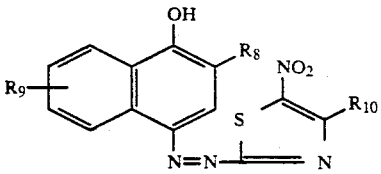

[69]

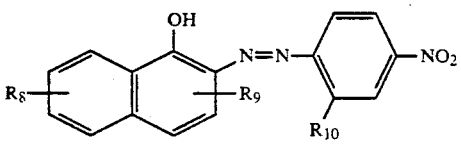

[70]

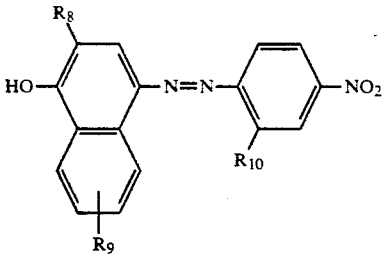

In formulas (36) to (70), $R_6$ to $R_{13}$ each signifies a hydrogen atom, an alkyl group, a cycloalkyl group, an aralkyl group, an alkoxy group, an aryloxy group, an aryl group, an acylamino group, an acyl group, a cyano group, a hydroxyl group, an alkylsulfonylamino group, an arylsulfonylamino group, an alkylsulfonyl group, a hydroxyalkyl group, a cyanoalkyl group, an alkoxycarbonylalkyl group, a nitro group, a halogen atom, a sulfamoyl group, an N-substituted sulfamoyl group, a carbamoyl group, an N-substituted carbamoyl group, a sulfamido group, an N-substituted sulfamido group, a hydroxyalkoxy group, an alkoxyalkoxy group, a carboxyl group, an amino group, a substituted amino group, an alkylthio group, an arylthio group, a hydroxamic acid group, an imido group, a sulfo group, a phosphoric acid group, a quaternary ammonium group, a ureido group and a heterocyclic group.

Other preferable dyes are chelatable ones that are represented by the following general formulas (71) and (72):

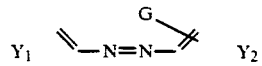

(71)

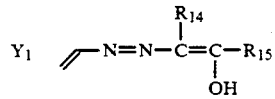

(72)

where $Y_1$ signifies the atomic group necessary for forming aromatic rings (e.g., benzene or naphthalene ring) or heterocyclic rings (e.g., pyridine, pyrazole or pyrazolotriazole ring), at least one of which is composed of 5–7 atoms and wherein at least one of the sites adjacent to the carbon atom bound to the azo bond is either (a) a nitrogen atom or (b) a carbon atom substituted by a nitrogen atom, an oxygen atom or a sulfur atom; $Y_2$ signifies the atomic group necessary for forming aromatic rings (e.g., benzene or naphthalene ring) or heterocyclic rings (e.g., pyridine, pyrazole or pyrazolotriazole ring), at least one of which is composed of 5–7 atoms G is a chelate-forming group (e.g., amino, hydroxyl, carboxy, alkoxy or thioalkoxy); and $R_{14}$ and $R_{15}$ have the same meanings as $R_6$ to $R_{13}$.

The spectral absorption of these dyes residues may be shifted temporarily to shorter wavelength in order to regenerate the desired image color during heat development or transfer step.

More preferable examples of the compound represented by formula (X) are those which have the following general formulas (73) to (78):

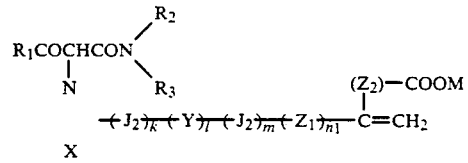

(73)

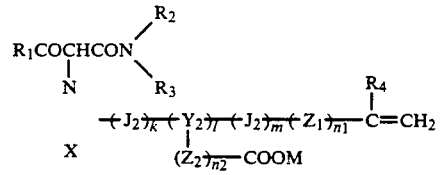

(74)

where $R_1$ signifies an optionally substituted alkyl, aryl or heterocyclic group; $R_2$ and $R_3$ each signifies a hydrogen atom or an optionally substituted alkyl, aryl or heterocyclic group; $R_4$ is a hydrogen atom or an optionally substituted alkyl group; X signifies the atomic group necessary for forming an optionally substituted nitrogen-containing heterocyclic group; $J_1$ and $J_2$ each signifies a divalent linkage; $Y_1$ signifies a divalent hydrocarbon group; $Y_2$ is a divalent hydrocarbon group substituted by $-(Z_2)n_2COOM$; $Z_1$ and $Z_2$ each signifies an alkylene group; M signifies a hydrogen atom, $NH_4$ group or a monovalent metallic atom; k, l, m, $n_1$ and $n_2$ each signifies 0 or 1;

(75)

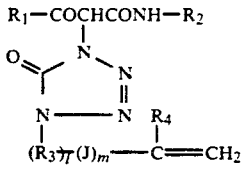

where $R_1$ is an alkyl group; $R_2$ is an alkyl or aryl group; $R_3$ is a divalent hydrocarbon group; $R_4$ is an alkyl group or a hydrogen atom; J is a divalent linkage; l is 0 or 1; and m is 0 or 1;

(76)

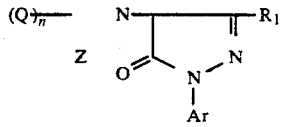

where Q is an ethylenically unsaturated group or a group having an ethylenically unsaturated group; Z signifies the atomic group necessary for forming a nitrogen-containing heterocyclic group (which may have a polymerizable ethylenically unsaturated bond within the ring) together with a nitrogen atom; $R_1$ is an alkyl group, an aryl group, an alkylamino group, an anilino group, an acylamino group or a ureido group; Ar is an aryl group or a heterocyclic group; and n is 0 or 1;

(77)

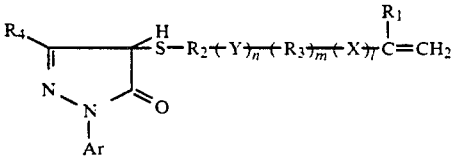

where $R_1$ is a hydrogen atom, a lower alkyl group having 1–4 carbon atoms or a chlorine atom; $R_2$ and $R_3$ each signifies a substituted or unsubstituted alkylene, arylene or aralkylene group, the alkylene group being either straight-chained or branched; X is —CONH— or —COO—; Y is —O—, —S—, —SO—, —$SO_2$—, —CONH— or —COO—; Ar is a substituted or unsubstituted phenyl group; $R_4$ is a substituted or unsubstituted anilino, acylamino or ureido group; l, m and n each signifies 0 or 1;

(78)

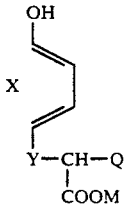

where X signifies the atomic group necessary for forming a benzene or naphthalene ring, which may have a substituent; Y is an oxygen or sulfur atom; Q is an ethylenically unsaturated group or a group having an ethylenically unsaturated group; M is a hydrogen atom, $NH_4$ group or a monovalent metallic atom.

Specific examples of the compound of formula (X) are listed below for illustrative purposes only:

M-1

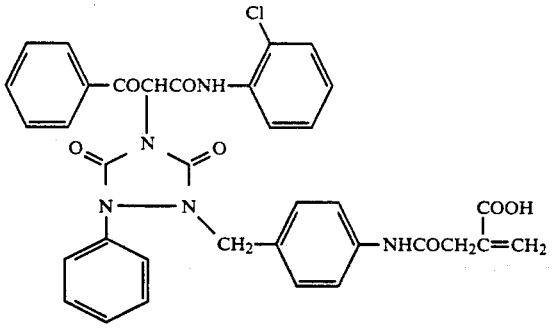

M-2

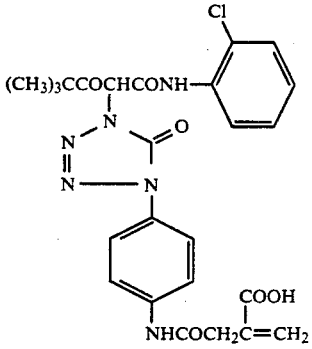

-continued
M-3
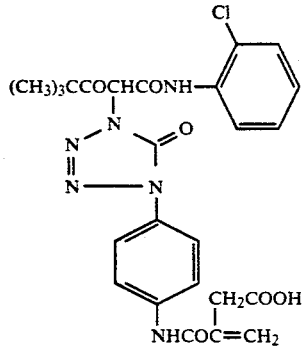
M-4
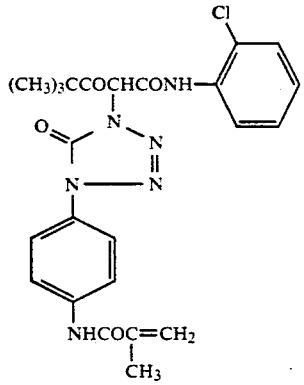
M-5
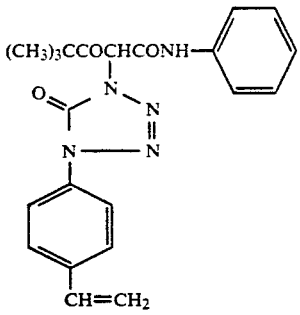
M-6
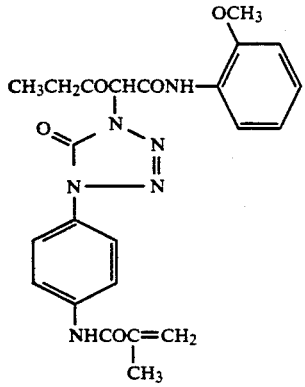

-continued
M-7
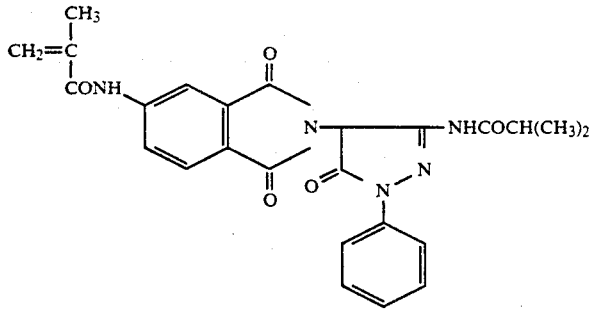
M-8
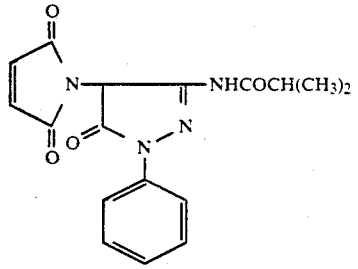
M-9
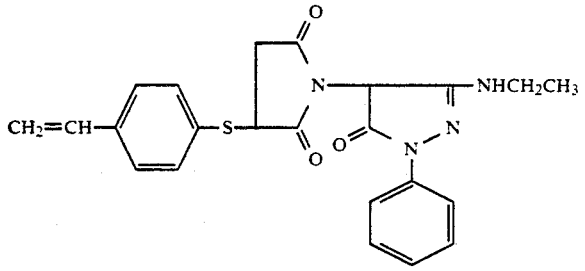
M-10
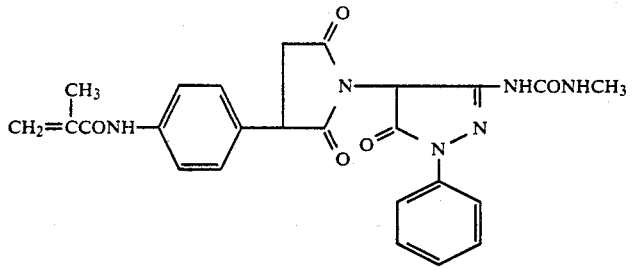
M-11
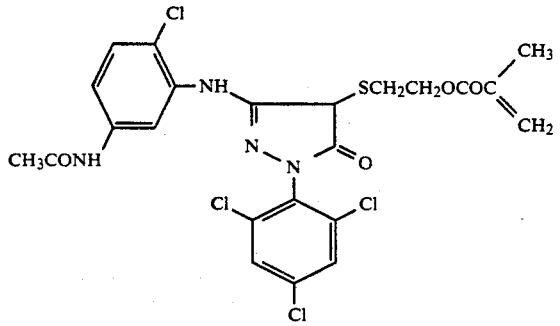

-continued
M-12
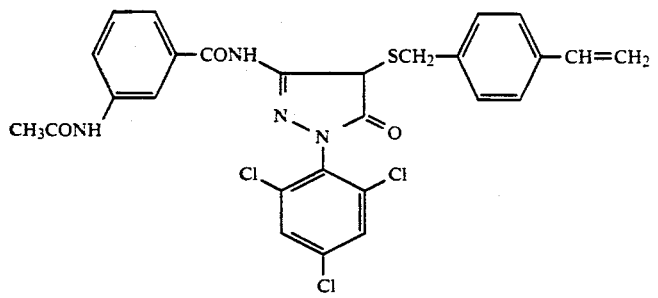
M-13
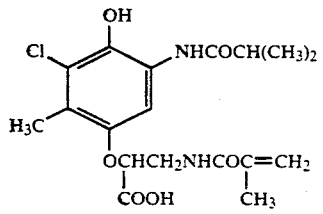
M-14
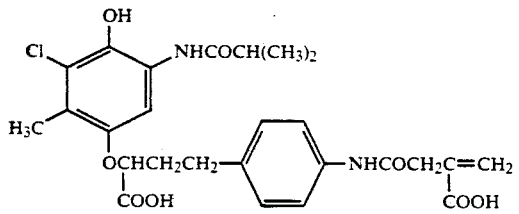
M-15
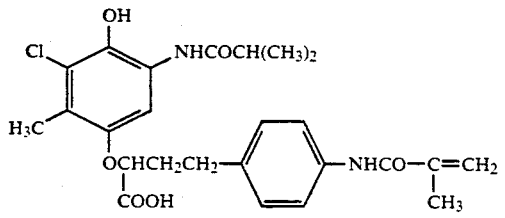
Specific examples of the compound of formula (XI) are listed below for illustrative purposes only:
M-16
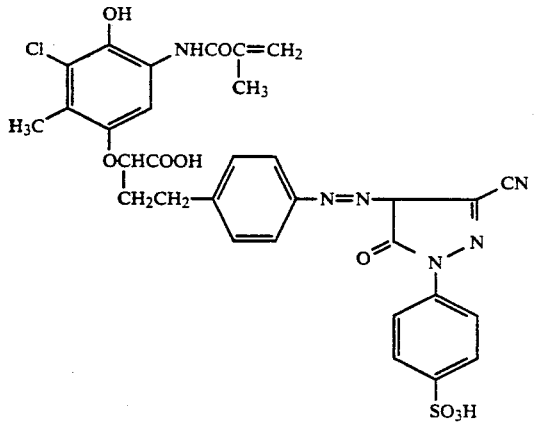

-continued

M-17

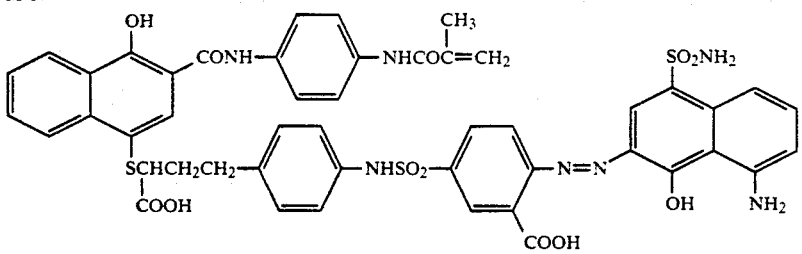

M-18

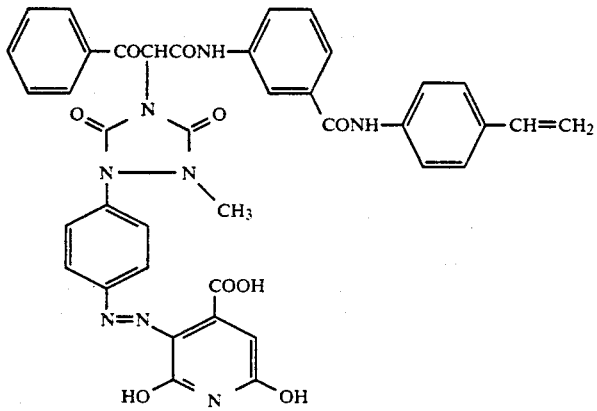

The polymers having a recurring unit derived from a monomer that is represented by formula (X) or (XI) may be homopolymers consisting of a recurring which is made of only one monomer represented by formula (X) or XI), or copolymers consisting of two or more of the monomers represented by formula (X) or (XI), or copolymers consisting of a monomer of formula (X) or (XI) and one or more comonomers having an ethylenically unsaturated group.

Illustrative comonomers having an ethylenically unsaturated group that are capable of forming copolymers with monomers represented by formula (X) or (XI) include: acrylate esters, methacrylate esters, vinyl esters, olefins, styrenes, crotonic acid esters, itaconic acid diesters, maleic acid diesters, fumaric acid diesters, acrylamides, allyl compounds, vinyl ethers, vinyl ketones, vinyl heterocyclic compounds, glycidyl esters, unsaturated nitriles, polyfunctional monomers and various unsaturated acids.

Others examples include: acrylic acid, methacrylic acid, itaconic acid, maleic acid, monoalkyl esters of itaconic acid, monoalkyl esters of maleic acid, citraconic acid, styrenesulfonic acid, vinylbenzylsulfonic acid, vinylsulfonic acid, acryloyloxyalkylsulfonic acids, methacryloyloxyalkylsulfonic acids, acrylamindoalkylsulfonic acids, methacrylamidoalkylsulfonic acids, aryloxyloxyalkylphosphates, methacryloyloxyalkylphosphates, and sodium 3-allyloxy-2-hydroxypropanesulfonate having two hydrophilic groups. The acids mentioned above may be inform of salts with an alkali metal (e.g., Na or K) or ammonium ion.

Other usable comonomers are the crosslinking monomers described in U.S. Pat. Nos. 3,459,790, 3,438,708, 3,554,987, 4,215,195, and 4,247,673 and Unexamined Published Japanese Patent Application No. 205735/1982.

In forming copolymers from monomers represented by formula (X) or (XI) and the comonomers shown above, it is preferable that the recurring unit made of the monomer represented by formula (X) or (XI) amounts for 10–90 wt% of the total polymer, with the range of 30–70 wt% being more preferable.

Polymer couplers are generally produced by emulsion polymerization or solution polymerication and these methods may be employed to prepare the dye-providing polymers of the present invention having a recurring unit derived from a monomer that is represented by formula (X) or (XI). Such dye-providing polymers can also be attained by other polymerization techniques such as suspension polymerization and bulk polymerization. Therefore, the dye-providing polymers of the present invention are in no way limited by the method of their synthesis and encompass all types of polymers that contain monomers represented by formula (X) or (XI) such as homopolymers solely composed of such monomers, copolymers composed of two or more types of such monomers, and copolymers consisting of such monomers and at least one other polymerizable comonomer.

Typical examples of the dye-providing polymers of the present invention are specifically listed in Table 1 below but they should in no sense be taken as limiting.

TABLE 1

| Polymer No. | Dye-providing monomer type | Dye-providing monomer amount (g) | Comonomer type | Comonomer amount (g) | Weight average molecular weight | Residual monomer (%) |
|---|---|---|---|---|---|---|
| P-1 | M-4 | 30 | BA | 20 | 31800 | 0.1 |
| P-2 | M-10 | 20 | BA | 30 | 34900 | 0.1 |
| P-3 | M-15 | 25 | BA | 25 | 37200 | 0 |
| P-4 | M-2 | 30 | EM | 20 | 30300 | 0 |
| P-5 | M-23 | 25 | MM | 25 | 41700 | 0.1 |
| P-6 | M-13 | 35 | BA | 15 | 49000 | 0 |
| P-7 | M-17 | 30 | EM | 20 | 57000 | 0 |
| P-8 | M-4 | 30 | BA | 20 | 63000 | 0 |
| P-9 | M-8 | 30 | BA | 20 | 78000 | 0 |
| P-10 | M-10 | 30 | BA | 20 | 86000 | 0 |

TABLE 1-continued

| Polymer No. | Dye-providing monomer type | Dye-providing monomer amount (g) | Comonomer type | Comonomer amount (g) | Weight average molecular weight | Residual monomer (%) |
|---|---|---|---|---|---|---|
| P-11 | M-3 | 25 | BA | 25 | 98000 | 0 |
| P-12 | M-15 | 30 | MA | 20 | 132000 | 0 |
| P-13 | M-14 | 30 | ST | 20 | 154000 | 0 |
| P-14 | M-18 | 30 | BA | 20 | 197000 | 0 |
| P-15 | M-6 | 15 | MA | 35 | 263000 | 0 |
| P-16 | M-8 | 30 | ST | 20 | 301000 | 0 |
| P-17 | M-4 | 25 | BA | 25 | 593000 | 0 |
| P-18 | M-15 | 30 | MA | 20 | 714000 | 0 |
| P-19 | M-6 | 30 | BA | 20 | 950000 | 0 |
| P-20 | M-13 | 20 | BA | 30 | 1260000 | 0 |
| P-21 | M-9 | 25 | BA | 25 | 1960000 | 0 |
| P-22 | M-7 | 30 | BA | 20 | 2510000 | 0 |
| P-23 | M-11 | 20 | BA | 30 | 4200000 | 0 |
| P-24 | M-3 | 30 | MM | 20 | 5100000 | 0 |
| P-25 | M-4 | 25 | MA | 25 | 8500000 | 0 |
| P-26 | M-10 | 30 | BA | 20 | 120000000 | 0 |

BA, n-butyl acrylate; MA, methyl acrylate; MM, methyl methacrylate; EM, ethyl methacrylate; ST, styrene; residual monomer, the content of unreacted dye-providing monomer.

Examples of polymerization for synthesizing several of the dye-providing polymers of the present invention are shown below.

Polymerization 1:

synthesis of copolymer (P-1) from monomer M-4 and n-butyl acrylate

Thirty grams of monomer M-4 and 20 g of n-butyl acrylate were dissolved in 500 ml of dioxane and the solution was heated at 85° C. while being purged with a nitrogen gas. At a controlled temperature of 85° C., 300 mg of 2,2'-azobisisobutyronitrile was added and reaction was carried out for 5 hours. After completion of the reaction, the reaction mixture was poured into 2,500 ml of water and the resulting solid precipitate was recovered by filtration. This precipitate was dissolved in 500 ml of dioxane and the solution was poured into 2,500 ml of water, the precipitate being subsequently separated by filtration. The solid product was dried to obtain 48 g of the end polymer, P-1.

Polymerization 2:

synthesis of copolymer (P-10) from monomer M-10 and n-butyl acrylate

Thirty grams of monomer M-10 and 20 g of n-butyl acrylate were dissolved in 250 ml of dioxane and the solution was heated at 80° C. while being purged with a nitrogen gas. At a controlled temperature of 80° C., 500 mg of 4,4'-azobis-4-cyanovaleric acid was added and reaction was carried out for 5 hours. After completion of the reaction, the reaction mixture was poured into 2,500 ml of water and the resulting solid precipitate was separated by filtration. This precipitate was dissolved in 250 ml of dioxane and the solution was poured into 2,500 ml of water, the precipitate being subsequently separated by filtration. The solid product was dried to obtain 47 g of the end polymer, P-10.

Polymerization 3:

synthesis of copolymer (P-12) from monomer M-15 and methyl acrylate

Thirty grams of monomer M-15 and 20 g of methyl acrylate were dissolved in 200 ml of dioxane and the solution was heated at 78° C. while being purged with a nitrogen gas. At a controlled temperature of 78° C., 500 mg of 4,4'-azobis4-cyanovaleric acid was added and reaction was carried out for 5 hours. After completion of the reaction, the reaction mixture was poured into 2,000 ml of water and the resulting solid precipitate was separated by filtration. This precipitate was dissolved in 200 ml of dioxane and the solution was poured into 2,000 ml of water, the precipitate being subsequently separated by filtration. The solid product was dried to obtain 47 g of the end polymer, P-12.

Polymerization 4:

synthesis of copolymer (P-19) from monomer M-6 and n-butyl acrylate

Thirty grams of monomer M-6 and 20 g of n-butyl acrylate were dissolved in 125 ml of dimethylformamide and the solution was heated at 85° C. while being purged with a nitrogen gas. At a controlled temperature of 85° C., 500 mg of 2,2'-azobisisobutyronitrile was added and reaction was carried out for 5 hours. After completion of the reaction, the reaction mixture was poured into 1,250 ml of water and the resulting solid precipitate was separated by filtration. This precipitate was dissolved in 125 ml of dimethylformamide and the solution was poured into 1,250 ml of water, the precipitate being subsequently separated by filtration. The solid product was dried to obtain 47 g of the end polymer, P-19.

Polymerization 5:

synthesis of copolymer (P-21) from monomer M-9 and n-butyl acrylate

Twenty-five grams of monomer M-9 and 25 g of n-butyl acrylate were dissolved in 125 ml of dimethylformamide and the solution was heated at 80° C. while being purged with a nitrogen gas. At a controlled temperature of 80° C., 500 mg of 2,2'-azobisisobutyronitrile was added and reaction was carried out for 5 hours. After completion of the reaction, the reaction mixture was poured into 1,250 ml of water and the resulting solid precipitate was separated by filtration. This precipitate was dissolved in 125 ml of dimethylformamide and the solution was poured into 1,250 ml of water, the precipitate being subsequently separated by filtration. The solid product was dried to obtain 48 g of the end polymer, P-21.

Polymerization 6:

synthesis of copolymer (P-17) from monomer M-4 and n-butyl acrylate

Twenty-five grams of monomer M-4 and 25 g of n-butyl acrylate were dissolved in 250 ml of dimethylformamide and the solution was heated at 80° C. while being purged with a nitrogen gas. At a controlled temperature of 80° C., 500 mg of 2,2'-azobisisobutyronitrile was added and reaction was carried out for 5 hours. After completion of the reaction, the reaction mixture was poured into 2,500 ml of water and the resulting solid precipitate was separated by filtration. This precipitate was dissolved in 250 ml of dimethylformamide and the solution was poured into 2,500 ml of water, the precipitate being subsequently separated by filtration. The solid product was dried to obtain 46 g of the end polymer, P-17.

Polymerization 7:

synthesis of copolymer (P-22) from monomer M-11 and methyl methacrylate

Thirty grams of monomer M-11 and 20 g of methyl methacrylate were dissolved in 125 ml of N,N-dimethylacetamide and the solution was heated at 78° C. while being purged with a nitrogen gas. At a controlled temperature of 78° C., 500 mg of dimethyl azobisisobutyrate was added and reaction was carried out for 5 hours. After completion of the reaction, the reaction mixture was poured into 1,250 ml of water and the resulting solid precipitate was separated by filtration. This precipitate was dissolved in 125 ml of N,N'-dimethylacetamide and the solution was poured into 1,250 ml of water, the precipitate being subsequently separated by filtration. The solid product was dried to obtain 48 g of the end polymer, P-22.

Polymerization 8:

Synthesis of copolymer (P-23) from monomer M-13 and n-butyl acrylate

Twenty grams of monomer M-13 and 30 g of n-butyl acrylate were dissolved in 170 ml of dimethylformamide and the solution was heated at 72° C. while being purged with a nitrogen gas. At a controlled temperature of 72° C., 500 mg of 4,4'-azobis-4-cyanovaleric acid was added and reaction was carried out for 8 hours. After completion of the reaction, the reaction mixture was poured into 1,700 ml of water and the resulting solid precipitate was separated by filtration. This precipitate was dissolved in 170 ml of dimethylformamide and the solution was poured into 1,700 ml of water, the precipitate being subsequently separated by filtration. The solid product was dried to obtain 48 g of the end polymer, P-23.

Polymerization 9:

synthesis of copolymer (P-25) from monomer M-4 and methyl acrylate

Twenty-five grams of monomer M-4 and 25 g of methyl acrylate were dissolved in 125 ml of dimethylformamide and the solution was heated at 65° C. while being purged with a nitrogen gas. At a controlled temperature of 65° C., 500 mg of 4,4'-azobis-4-cyanovaleric acid was added and reaction was carried out for 10 hours. After completion of the reaction, the reaction mixture was poured into 1,250 ml of water and the resulting solid precipitate was separated by filtration. This precipitate was dissolved in 125 ml of dimethylformamide and the solution was poured into 1,250 ml of water, the precipitate being subsequently separated by filtration. The solid product was dried to obtain 48 g of the end polymer, P-25.

Polymerization 10:

synthesis of copolymer (P-26) from monomer M-10 and n-butyl acrylate

Thirty grams of monomer M-10 and 20 g of n-butyl acrylate were dissolved in 125 ml of dimethylformamide and the solution was heated at 60° C. while being purged with a nitrogen gas. At a controlled temperature of 60° C., 500 mg of 2,2'-azobisisobutyronitrile was added and reaction was carried out for 10 hours. After completion of the reaction, the reaction mixture was poured into 1,250 ml of water and the resulting solid precipitate was separated by filtration. This precipitate was dissolved in 125 ml of dimethylformamide and the solution was poured into 1,250 ml of water, the precipitate being subsequently separated by filtration. The solid product was dried to obtain 46 g of the end polymer, P-26.

The dye-providing polymers of the present invention may be employed, either independently or in combination, for a particular color. A single dye-providing polymer is preferably used in an amount of 0.05–100 g/m$^2$, more preferably 1.0–30 g/m$^2$.

The light-sensitive silver halide used in the present invention may be spectrally sensitized for a desired wavelength range with the sensitizing dyes of the present invention or with other dyes that are known to be usable as sensitizing dyes. The sensitizing dyes are used in amounts which preferably range from $1\times10^{-4}$ to 1 mole, more preferably from $1\times10^{-4}$ to $1\times10^{-1}$ mole, per mole of the light-sensitive silver halide.

The present invention is applicable to every type of light-sensitive material that forms image by heat development, such as a light-sensitive material of the black-and-white type which forms silver image by thermal development or the color type which employs dye-providing materials. Light-sensitive materials of the color type include those which are intended to produce monochromatic colors based on black or other single color-forming dye-providing materials, as well as those which are designed to produce full color based on the formation of yellow, cyan and magenta colors. Light-sensitive materials of the color type are typically processed by a method that ends with the transfer of only dye image to a receiving member. The present invention produces particularly advantageous results when it is applied to light-sensitive materials of the color type.

In accordance with the present invention, a heat-developable light-sensitive material of the black-and-white type which forms silver image is prepared basically by incorporating (1) a light-sensitive silver halide, (2) a reducing agent, (3), a binder and optionally, (4) an organic silver salt, in a light-sensitive layer on a support. If the light-sensitive material is of the color type which forms a dye image, the basic structure consists of (1) a light-sensitive silver halide, (2) a reducing agent, (3) a binder, (5) a dye-providing material and, optionally (4) an organic silver salt, which are incorporated in a light-sensitive layer on a support. However, these components need not be incorporated in a single layer, and they may be incorporated in two or more photographic layers so long as they remain reactive with one another. For instance, a light-sensitive layer is divided into two layers, with components (1) to (4) being incorporated in one sublayer and component (5) in the other sublayer which is adjacent said first sublayer.

The light-sensitive layer may be divided into two layers such as a high-sensitivity layer and a low-sensitivity layer, or it may be divided into three or more layers. The light-sensitive layer may be combined with one or more light-sensitive layers that are sensitive to light of other colors. Furthermore, said layer may be provided with a variety of photographic layers such as a topcoat, an undercoat, a backing layer, an intermediate layer and a filter layer.

Coating solutions are prepared not only for the thermally developable light-sensitive layer but also for other photographic layers such as a protective layer, an intermediate layer, an undercoat, and a backing layer and are applied by dip coating, air-knife coating, curtain coating, hopper coating (see U.S. Pat. No. 3,681,294) or any other appropriate coating techniques to make a light-sensitive material.

If necessary, two or more layers may be applied simultaneously by employing the methods described in U.S. Pat. No. 2,761,791 and British Pat. No. 837,095.

The components described above which are employed in the photographic layers of the thermally developable light-sensitive material of the present invention are coated onto a support for a dry thickness which preferably ranges from 1 to 1,000 μm, more preferably from 3 to 20 μm.

The heat-developable light-sensitive material of the present invention may incorporate a variety of organic silver salts as required for the purpose of achieving improved sensitivity and developability.

Illustrative organic silver salts suitable for use in the heat-developable photographic material of the present invention are described in the following patents:

Japanese Patent Publication Nos. 4921/1968, 26582/1969, 18416/1970, 12700/1970 and 22185/1970; Unexamined Published Japanese Patent Application Nos. 52626/1974, 31728/1977, 137321/1977, 141222/1977, 36224/1978 and 37610/1978; U.S. Pat. Nos. 3,330,633, 3,794,496, 4,105,451, 4,123,274 and 4,168,980; Japanese Patent Publication Nos. 26582/1969, 12700/1970, 18416/1970, 22185/1970; and Unexamined Published Japanese Patent Application Nos. 31728/1977, 137321/1977, 118638/1983 and 118639/1983. Among the organic silver salts described in these patents, those containing an imino group are preferred, and silver salts of benzotriazole derivatives are more preferred. Particularly preferred silver salts are those of sulfobenzotriazole derivatives.

The aforementioned organic silver salts may be used either independently or in combination. Isolated forms may be used after being dispersed in binders by suitable means. Alternatively, organic silver salts prepared in suitable binders may be directly used without being isolated.

The organic silver salts are preferably used in amounts of 0.01–500 moles, more preferably 0.1–100 moles, per mole of the light-sensitive silver halide.

The heat developable photographic material of the present invention may employ reducing agents that are commonly used in the field of thermally developable photographic materials. Examples are p-phenylenediamine and p-aminophenol based developing agents, phosphoroamidophenol and sulfonamidophenol based developing agents, and hydrazone based color developing agents of the types described in U.S. Pat. Nos. 3,531,286, 3,761,270, and 3,764,328; Research Disclosure Nos. 12146, 15108 and 15127; and Unexamined Published Japanese Patent Application No. 27132/1981. Precursors for color developing agents of the types described in U.S. Pat. Nos. 3,342,599, and 3,719,492; and Unexamined Published Japanese Patent Application Nos. 135628/1978 and 79035/1979 may be used with advantage.

Particularly preferred reducing agents are those which are represented by formula (A) as shown in Unexamined Published Japanese Patent Application No. 146133/1981:

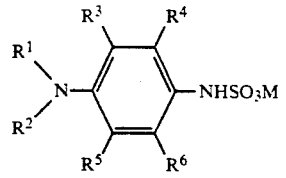

(A)

If the dye-providing material is one of the compounds shown in Unexamined Published Japanese Patent Application Nos. 179840/1982, 58543/1983, 152440/1984 and 154445/1984 (i.e., a compound that releases a dye upon oxidation, a compound that loses its ability to release a dye upon oxidation, or a compound that releases a dye upon reduction), or if it is desired to produce solely a silver image in the absence of any dye-providing material, the following reducing agents may be employed: phenols, sulfonamidophenols, polyhydroxybenzenes, naphthols, hydroxybinaphthyls, methylenebisnaphthols, methylenebisphenols, ascorbic acids, 3-pyrazolidones, pyrazolones, hydrazones and paraphenylenediamines.

These reducing agents may be used either independently or in combination. The amount of the reducing agent used depends on the type of each of the light-sensitive silver halide, organic silver salt and other additives used. Usually, the reducing agent is used in an amount of 0.01–1,500 moles, preferably 0.1–200 moles, per mole of the light-sensitive silver halide.

Binders that are used in the heat developable photographic material of the present invention include polyvinyl butyral, polyvinyl acetate, ethyl cellulose, polymethyl methacrylate, cellulose acetate butyrate, polyvinyl alcohol, polyvinylpyrrolidone, gelatin and phthalated gelatin. These synthetic and natural high-molecular weight substances may be used either independently or in combination.

A particularly preferable combination is that of gelatin or derivatives thereof and a hydrophilic polymer such as polyvinylpyrrolidone or polyvinyl alcohol. A more preferable binder is the one described in Japanese Patent Application No. 104249/1983.

The binder is generally used in an amount of 0.05–50 g/m$^2$, preferably 0.1–10 g/m$^2$, per layer.

Bases that may be used with the heat developable photographic material of the present invention include synthetic plastic films made of polyethylene, cellulose acetate, polyethylene terephthalate and polyvinyl chloride; paper bases such as photographic raw paper, printing paper, baryta paper and resin coated paper; and bases having a reflective layer formed on the aforementioned plastic films.

Besides the aforementioned components, the heat developable photographic material of the present invention may incorporate other various additives. An exemplary additive is a development accelerator selected from among the alkali releasing agents (e.g., urea and guanidium trichloroacetate) described in U.S. Pat. Nos. 3,220,840, 3,531,285, 4,012,260, 4,060,420, 4,088,496 and 4,207,392; Research Disclosure Nos. 15733, 15734 and 15776; Unexamined Published Japanese Patent Application Nos. 130745/1981 and 132332/1981, the organic acid described in Japanese Patent Publication No. 12700/1970; the non aqueous polar solvent compounds having —CO—, —$SO_2$— or —SO— group as shown in U.S. Pat. No. 3,667,959; the melt former described in U.S. Pat. No. 3,438,776; and the polyalkylene glycols described in U.S. Pat. No. 3,666,477 and Unexamine Published Japanese Patent Application No. 19525/1976. Another additive is a toning agent selected from among the compounds described in Unexamined Published Japanese Patent Application Nos. 4928/1971, 6077/1971, 5019/1974, 5020/1974, 91215/1974, 107727/1974, 2524/1975, 67132/1975, 67641/1975, 114217/1975, 33722/1977, 99813/1977, 1020/1978, 55115/1978, 76020/1978, 125014/1978, 156523/1979, 156524/1979, 156525/1979, 156526/ 1979, 4060/1980, 4061/1980 and 32015/1980, as well as German Patent Nos. 2,140,406, 2,147,063 and 2,220,618, U.S. Pat. Nos. 3,080,254, 3,847,612, 3,782,941, 3,994,732, 4,123,282 and 4,201,582.

Also useful are the 3-amino-5-mercapto-1,2,4-triazoles and 3-acylamino-5-mercapto-1,2,4-triazoles shown in Unexamined Published Japanese Patent Application Nos. 189628/ 1983 and 193460/1983.

Illustrative antifoggants are shown in the following patents: Japanese Patent Publication No. 11113/1972; Unexamined Published Japanese Patent Application Nos. 90118/1974, 10724/1974, 97613/1974, 101019/1975, 130720/1974, 123331/1975, 47419/1976, 57435/1976, 78227/1976, 104338/1976, 19825/1978, 20923/1978, 50725/1976, 3223/1976, 42529/1976, 81124/1976, 51821/1976 and 93149/1980; British Patent No. 1,455,271; U.S. Pat. Nos. 3,885,968, 3,700,457, 4,137,079 and 4,138,265; and German Patent No. 2,617,907.

Other antifoggants that can be used with advantage are the hydroquinone derivatives (e.g., di-t-octylhydroquinone and dodecanylhydroquinone) shown in Japanese Patent Application No. 56506/1984, and a combination of hydroquinone derivatives and benzotriazole derivatives (e.g., 4-sulfobenzotriazole and 5-carboxybenzotriazole) as described in Japanese Patent Application No. 66380/1984.

An agent that serves to prevent printing-out after processing may also be used as a stabilizer, and the hydrocarbon halides described in Unexamined Published Japanese Patent Application Nos. 45228/1973, 119624/1975, 120328/1975 and 46020/1978 may be employed as such agents.

Post-treatment may be performed using sulfur-containing compounds as described in Japanese Patent Publication No. 5393/1971, and Unexamined Published Japanese Patent Application Nos. 54329/1975 and 77034/1975.

The thermally developable light-sensitive material of the present invention may also contain an isothiuronium based stabilizer of the types described in U.S. Pat. Nos. 3,301,678, 3,506,444, 3,824,103 and 3,844,788, or an activator/stabilizer precursor of the types described in U.S. Pat. Nos. 3,669,670, 4,012,260 and 4,060,420.

A water releasing agent such as sucrose or $NH_4Fe(SO_4)_2 \cdot 12H_2O$ may also be employed. If desired, thermal development may be carried out with water being supplied as shown in Unexamined Published Japanese Patent Application No. 132332/1981.

In addition to the components described above, the thermally developable light-sensitive material of the present invention may incorporate various additives (e.g., anti-halation dyes, brighteners, hardening agents, antistats, plasticizers and leveling agents) and coating aids.

If the heat developable light-sensitive material of the present invention is of the color type, dye-providing materials are employed. The dye-providing materials that can be used in the present invention are not limited to the aforementioned dye-providing polymers of the present invention. Any dye-providing material can be used in the present invention so long as it participates in the reduction reaction of light-sensitive silver halides and/or optionally used organic silver salts and if it is capable of forming or releasing a diffusible dye as a function of this reaction. The dye-providing materials used in the present invention are classified as the negative-acting type which works as a positive function of said reaction (i.e., forming a negative dye image when a negative-acting silver halide is used) and the positive-acting type which works as a negative function of said reaction (i.e., forming a positive dye image when a negative-acting silver halide is used). The negative-acting dye-providing material is further classified as follows:

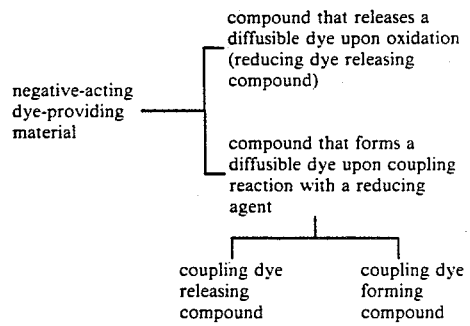

Each type of dye-providing material is hereunder described in greater detail.

An illustrative reducing dye releasing compound may be represented by the following general formula (B):

$$\text{Car—NHSO}_2\text{—Dye} \quad \text{(B)}$$

where Car is a reducing substrate (i.e., carrier) that is oxidized to release a dye in the reduction of a light-sensitive silver halide and/or an optionally used organic silver salt; and Dye is a diffusible dye residue.

Specific examples of this reducing dye releasing compound are given in Unexamined Published Japanese Patent Application Nos. 179840/1982, 1165537/1983, 60434/1984, 65839/1984, 71046/1984, 87450/1984, 88730/1984, 123837/1984, 1984 and 165055/1984.

Another example of the reducing dye releasing compound may be represented by the following general formula (C):

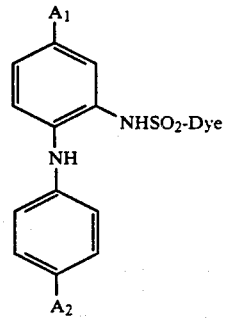

(C)

where $A_1$ and $A_2$ are each a hydrogen atom, a hydroxyl group or an amino group; and Dye has the same meaning as Dye in formula (B).

Specific examples of the compound (B ) are shown in Unexamined Published Japanese Patent Application No. 124329/1984.

An illustrative coupling dye releasing compound may be represented by the following general formula (D):

$$Cp_1—J_{n1}Dye \quad (D)$$

where $Cp_1$ is a coupler residue which is an organic group that is capable of reacting with the oxidized product of a reducing agent to release a diffusible dye; J is a divalent linkage which separates from $Cp_1$ upon reaction with the oxidized product of a reducing agent; $n_1$ is 0 or 1; and Dye has the same definition as given in connection with formula (B). In formula (D), $Cp_1$ is preferably substituted by a variety of ballast groups in order to render the coupling dye releasing compound nondiffusible. The type of ballast group depends on the form of the light-sensitive material employed and is selected from the group consisting of an organic group having no less than 8 carbon atoms (preferably no less than 12 carbon atoms), a hydrophilic group such as sulfo or carboxy, and a group having both 8 or more (preferably 12 or more) carbon atoms and a hydrophilic group such as sulfo or carboxy. Another and particularly preferable ballast group is a polymer chain.

Specific examples of the compound of formula (D) are given in Unexamined Published Japanese Patent Application Nos 186744/1982, 122596/1982, 160698/1982, 174834/1984, 224883/1982 and 159159/1984, and Japanese Patent Application No. 104901/1984.

An illustrative coupling dye forming compound may be represented by the following general formula (E):

$$Cp_2—F—B— \quad (E)$$

where $Cp_2$ is a coupler residue which is an organic group capable of forming a diffusible dye upon reaction (coupling reaction) with the oxidized product of a reducing agent; F is a divalent linkage; and B is a ballast group.

The molecular weight of the coupler residue $Cp_2$ is preferably 700 or below, more preferably 500 or below, in order to ensure the formation of a desired diffusible dye. The ballast group B is preferably the same as the ballast group defined for formula (D). A particularly preferable ballast group is one having both at least 8 (preferably 12 or more) carbon atoms and a hydrophilic group such as a sulfo or carboxyl group. A polymer chain is a most preferable ballast group.

A preferable example of the coupling dye forming compound having a polymer chain is a polymer having a recurring unit derived from a monomer represented by the following general formula (F):

$$Cp_2—F—Y_l—Z—L) \quad (F)$$

where $Cp_2$ and F are the same as defined in formula (E); Y is an alkylene group, an arylene group or an aralkylene group; l is 0 or 1; Z is a divalent organic group; and L is an ethylenically unsaturated group or a group having an ethylenically unsaturated group.

Specific examples of the coupling dye forming compounds represented by formulas (E) and (F) are shown in Unexamined Published Japanese Patent Application Nos. 124339/1984 and 181345/1984; and Japanese Patent Application Nos. 109293/1983, 179657/1984, 181604/1984, 182506/1984 and 182507/1984. More specific examples are listed below:

Dye-providing polymers

①

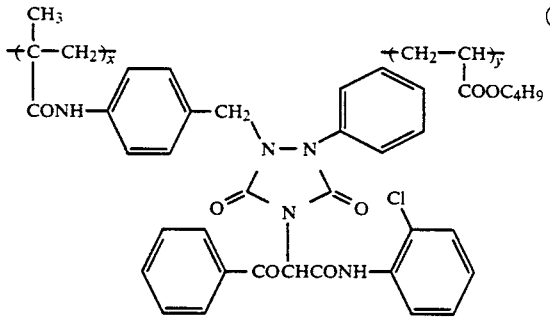

x: 60 wt %
y: 40 wt %

②

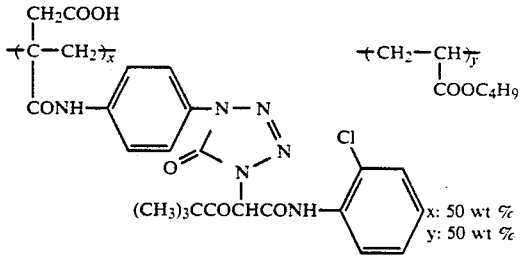

x: 50 wt %
y: 50 wt %

③

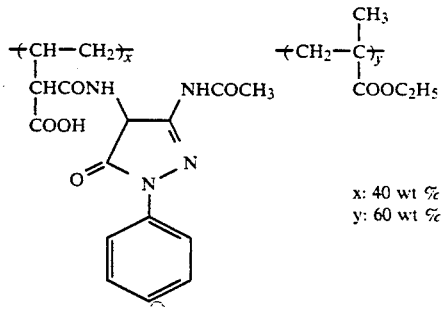

x: 40 wt %
y: 60 wt %

④

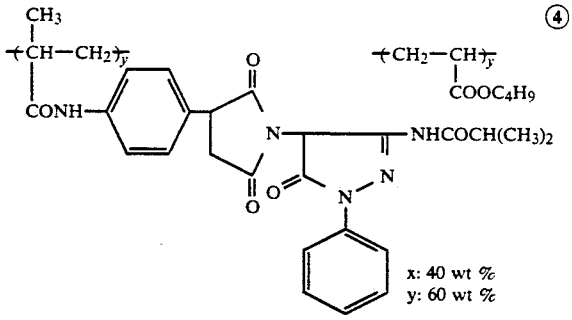

x: 40 wt %
y: 60 wt %

⑤

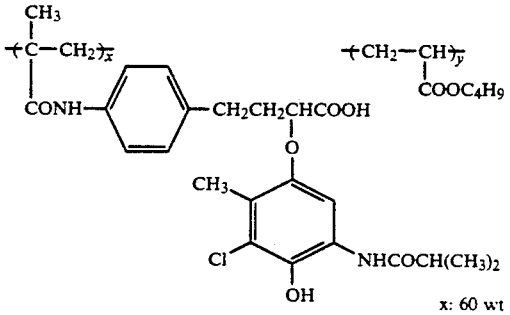

x: 60 wt %
y: 40 wt %

-continued

Dye-providing polymers

⑥

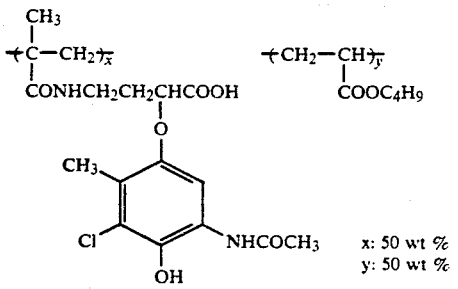

⑦

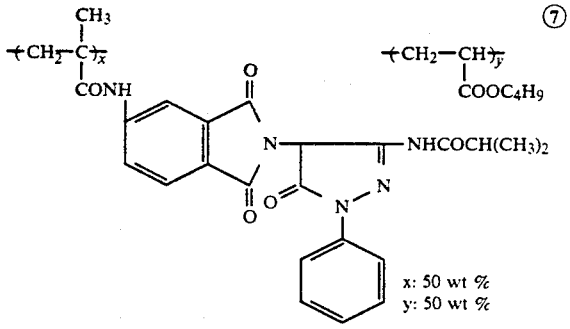

⑧

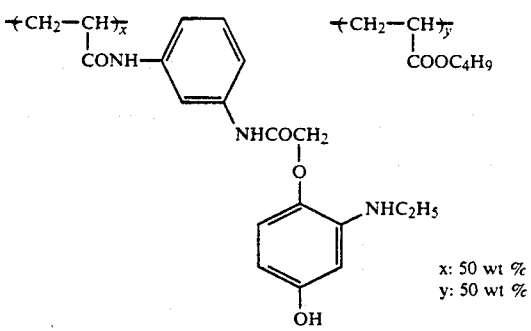

In formulas (D), (E) and (F), the coupler residue signified by $Cp_1$ or $Cp_2$ may be the same as that defined for $Cp_1$ and $Cp_2$ in connection with formulas (X) and (XI).

The substituents in $Cp_1$ and $Cp_2$ are selected in accordance with the object of using $Cp_1$ and $Cp_2$ and, as already mentioned, one of the substituents in $Cp_1$ is preferably a ballast group, and substituents in $Cp_2$ are preferably selected such that it has a molecular weight of 700 or less, more preferably 500 or less, in order to provide a dye having enhanced diffusibility.

An illustrative positive-acting dye providing material is an oxidizable dye releasing compound represented by the following general formula (G):

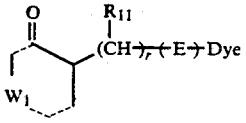

(G)

where $W_1$ signifies the atomic group necessary for forming a quinone ring (which may have a substituent thereon); $R_{11}$ is an alkyl group or a hydrogen atom; E is

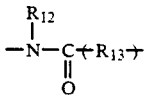

(where $R_{12}$ is an alkyl group or a hydrogen atom, and $R_{13}$ is an oxygen atom or

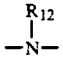

or —$SO_2$—; r is 0 or 1; and Dye has the same meaning as defined for formula (B);

Specific examples of this compound are shown in Unexamined Published Japanese Patent Application Nos. 166954/1984 and 154445/1984.

Another example of the positive-acting dye providing material is a compound that is oxidized to lose its dye-releasing ability, as typified by a compound represented by the following general formula (H):

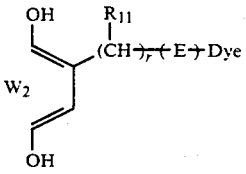

(H)

where $W_2$ signifies the atomic group necessary for forming a benzene ring (which may have a substituent thereon); and $R_{11}$, r, E and Dye are the same as defined in formula (G).

Specific examples of this compound are shown in Unexamined Published Japanese Patent Application Nos. 124329/1984 and 154445/1984.

Still another example of the positive-acting dye providing materials a compound that is represented by the following general formula (J):

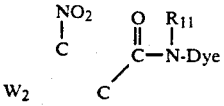

(J)

where $W_2$, $R_{11}$ and Dye are the same as defined in formula (H).

Specific examples of this compound are shown in Unexamined Published Japanese Patent Application No. 154445/1984.

The diffusible dye residue signified by Dye in formulas (B), (C), (D), (G), (H) and (J) is hereunder described in greater detail. In order to ensure the diffusibility of a dye, the molecular weight of Dye is preferably 800 or less, more preferably 600 or less. Examples of the diffusible dye residue that satisfy this requirement are azo, azomethine, anthraquinone, naphthoquinone, styryl, nitro, quinoline, carbonyl and phthalocyanine dye residues. The spectral absorption of these dye residues may be temporarily shifted toward a shorter wavelength in order to regenerate the desired image color during thermal development or subsequent transfer. In order to provide an image with enhanced resistance to light, these dye residues may be rendered chelatable as described in Unexamined Published Japanese Patent Application Nos. 48765/1984 and 124337/1984.

These dye-providing materials may be used either independently or in combination. The amount of the dye-providing materials used is in no way critical and may be properly determined in consideration of various factors such as the type of dye-providing material, the mode of their use(whether they are used independently or in combination) or the arrangement of photographic layers in the light-sensitive material of the present invention (i.e., whether they are single-layered or multiple-layered). As a guide, the dye-providing materials are used in amounts ranging from 0.005 to 50 g/m$^2$, preferably from 0.1 to 10 g/m$^2$.

The dye-providing materials used in the present invention may be incorporated in photographic layers in a heat-developable light-sensitive material by any suitable methods; in one method, the dye-providing material is first dissolved in a low-boiling point solvent (e.g., methanol, ethanol or ethyl acetate) or high-boiling point solvent (e.g., dibutyl phthalate, dioctyl phthalate or tricresyl phosphate) and subsequently dispersed by ultrasonic wave application; the dye providing material may be dissolved in an aqueous alkaline solution (e.g., 10% NaOH solution) and neutralized with a mineral acid (e.g., HCl or $NHO_3$); alternatively, the dye providing material is dispersed in an aqueous solution of a suitable polymer (e.g., gelatin, polyvinyl butyral or polyvinylpyrrolidone) by means of a ball mill.

The heat developable photographic material of the present invention may be exposed by a variety of means.

Any of the heating methods that can be applied to ordinary heat developable photographic materials may be employed in the present invention; they include, for example, contact with a heated block or plate, contact with hot rollers or drum, passage through a hot atmosphere, use of high-frequency heating, and the use of the Joule heat produced by application of an electric current or a strong magnetic field to an electroconductive layer provided in the photographic material of the present invention or in a heat transfer image receiving element. Heating pattern is not limited to any particular type; preheating may be followed by another heating, short heating at high temperatures or prolonged heating at low temperatures may be performed to realize continuous temperature elevation and decline or such heating may be carried out through cycles, or discontinuous heating may be employed. The simpler the heating pattern, the better. Exposure and heating may proceed simultaneously.

If the heat developable photographic material of the present invention is of the black-and-white type which will form a silver image, it is subjected to imagewise exposure and may be directly developed by mere heating in the temperature range of 80°-250° C., preferably 100°-200° C., for a period of 1 to 240 seconds, preferably 1.5 to 120 seconds. Prior to exposure, the photographic material may be heated in the temperature range of 70°-200° C.

The heat developed photographic material carrying a silver image may be directly displayed and kept in storage. If a particularly prolonged storage is required, the unreacted silver salt is preferably removed. For this purpose, a bleach bath, fix bath or a bleach-fix bath employed in the ordinary wet photographic process (e.g., the processing methods described in Unexamined Published Japanese Patent Application Nos. 54329/1975, 77034/1975, 328/1976 and 80226/1976) may be utilized. Alternatively, the bleach-fixing sheet of the types described in Unexamined Published Japanese Patent Application No. 136733/1984, and Research Disclosure Nos. 16407, 16408 and 16414 may be employed.

In a preferred embodiment, the heat developable photographic material of the present invention is of the color type using a dye providing material; in this case, the exposed photographic material is superposed on an image-receiving element (to be described later in this specification) in such a manner that the light-sensitive layer in the photographic material is in contact with the image-receiving element, and by heating the assembly in the temperature range of 80°-200° C. (preferably 120°-170° C.) for a period of 1-180 seconds (preferably 1.5-120 seconds), color development takes place as the developed image transfers onto the image-receiving element. Prior to exposure, the photographic material may be heated in the temperature range of 70°-180° C.

It suffices that the image-receiving element used in the present invention fulfills the function of receiving the image that has been released or formed by heat development. This image-receiving element is preferably made of any of the mordants used in dye diffusion transfer photographic materials, or of a heat-resistant organic high-molecular weight material of the type described in Unexamined Published Japanese Patent Application No. 207250/1982 that has a glass transition point of not lower than 40° C. but not higher than 250° C.

Specific examples of the mordants include nitrogen-containing secondary and tertiary amines, nitrogen-containing heterocyclic compounds, and quaternary cationic compounds thereof; the vinylpyridine polymers and vinylpyridinium cation polymers described in U.S. Pat. Nos. 2,548,564, 2,484,430, 3,148,061 and 3,756,814; the dialkylamino containing polymer described in U.S. Pat. No. 2,675,316; the aminoguanidine derivative described in U.S. Pat. No. 2,882,156; the covalent bonded reactive polymer described in Unexamined Published Japanese Patent No. 137333/1979; the mordants cross-linkable with gelatin, etc., as described in U.S. Pat. Nos. 3,625,694, 3,859,096, British Patent Nos. 1,277,453 and 2,011,012; the aqueous sol type mordants described in U.S. Pat. Nos. 3,958,995, 2,721,852 and 2,798,063; the water-insoluble mordant disclosed in Unexamined Published Japanese Patent Application No. 61228/1975; as well as the mordants disclosed in U.S. Pat. No. 3,788,855, German Patent Application (OLS) No. 2,843,320, Unexamined Published Japanese Patent Application Nos. 30328/1978, 155528/1977, 125/1978, 1024/1978, 74430/1979, 124726/1979, 22766/1980, U.S. Pat. Nos. 3,642,482, 3,488,706, 3,557,066, 3,271,147 and 3,271,148, Japanese Patent Publication Nos. 29418/1980, 36414/1981 and 12139/1982, Research Disclosure No. 12045 (1974).

A particularly useful mordant is a polymer containing an ammonium salt, especially the amino group containing polymer described in U.S. Pat. No. 3,709,690.

A typical image-receiving layer for use in dye diffusion transfer photography is prepared by applying to a base a mixture of gelatin and a polymer containing an ammonium salt.

The polymer may be applied to a base after it is dissolved in an appropriate solvent; a film-like image-receiving layer formed of the polymer may be laminated on a base; instead of being applied to a base, the polymer may be used as the sole component of an element (such as in the form of a film) that serves as both an image-receiving layer and base.

An image-receiving layer may also be composed of a transparent base overlaid with an image-receiving layer and an opacifying layer (reflective layer) containing $TiO_2$ or any other suitable material dispersed in gelatin. In this case, the opacifying layer on the image-receiving layer offers a reflective color transfer image that can be viewed through the transparent base.

(Best Mode for Working the Invention)

The advantages of the present invention are hereinafter described in greater detail with reference to working examples, which are given here for illustrative purposes only.

EXAMPLE 1

Preparation of Silver Bromide Emulsion

Comparative silver bromide emulsion 1-A was prepared by the following procedures. To solution (A) having 20 g of ossein gelatin and ammonia dissolved in 1,000 ml of distilled water and which was held at 50° C., solution (B) containing 1.1 mole of potassium bromide in 500 ml of water and solution (C) containing 1 mole of silver nitrate and ammonia in 500 ml of water were added simultaneously at a controlled pAg in a mixer-/agitator of the type shown in Unexamined Published Japanese Patent Application Nos. 92523/1982 and 92524/1982. The shape and size of the emulsion grains being formed were adjusted by controlling the pH, pAg and the rates of addition of solutions (B) and (C). As a result, a silver bromide emulsion was attained. The silver halide grains in the emulsion were octahedral in shape with an average size of 0.3 μm and 8% monodispersity. This emulsion was washed with water and desalted. The yield of the emulsion was 800 ml. Preparation of silver iodobromide emulsions:

Four additional comparative silver halide emulsions, 1-B, 1-C, 1-D and 1-E, having different silver iodide contents were prepared by the following procedures. Solution (A) was first prepared by dissolving 20 g of ossein gelatin and ammonia in 1,000 ml of distilled water. To solution (A) which was held at 50° C., solution (B) which was an aqueous solution containing predetermined amounts of potassium iodide and potassium bromide (6.64 g and 131 g, respectively, for emulsion 1-B; 11.6 g and 131 g for emulsion 1-C; 19.9 g and 125 g for emulsion 1-D; 33.2 g and 119 g for emulsion 1-E) and 500 ml of solution (C) which was an aqueous solution containing 1 mole of silver nitrate and ammonia were added simultaneously, with the pAg held at a constant value, by means of a mixer/agitator of the type described in Unexamined Published Japanese Patent Application Nos. 92523/1982 and 92524/1982. The shape and size of the emulsion grains being formed were adjusted by controlling the pH, pAg and the rates of addition of solutions (B) and (C). As a result, four silver iodobromide emulsions were obtained. They had octahedral grains with 9% monodispersity having different AgI contents. These emulsions were washed with water and desalted. The yield of each emulsion was The so prepared comparative silver halide emulsions, 1-A to 1-E, had the average grain sizes and silver iodide contents shown in Table 1-1.

TABLE 1-1

| Emulsion | Average size (μm) | AgI content (mol %) |
|---|---|---|
| 1-A | 0.3 | 0 |
| 1-B | 0.3 | 4 |
| 1-C | 0.3 | 7 |
| 1-D | 0.3 | 12 |
| 1-E | 0.3 | 20 |

Preparation of Core/Shell Type Silver Iodobromide Emulsion

Twelve core/shell type emulsions, 1-F to 1-Q, having different silver iodide contents and average grain sizes were prepared by the following procedures.

To solution (A) having 20 g of ossein gelatin and ammonia in distilled water and which was held at 50° C., 500 ml of solution (B) and 500 ml of solution (C) which was an aqueous solution containing 1 mole of silver nitrate and ammonia were added simultaneously at a controlled pAg in a mixer/agitator of the type shown in Unexamined Published Japanese Patent Application Nos. 92523/1982 and 92524/1982. Solution (B) was an aqueous solution containing predetermined amounts of potassium iodide and potassium bromide: 11.6 g and 131 g, respectively for each of emulsions 1-F to 1-K, and 33.2 g and 119 g, respectively, for each of emulsions 1-L to 1-Q. The shape and size of the core emulsion grains being formed were adjusted by controlling the pH, pAg and the rates of addition of solutions (B) and (C). As a result, 12 core emulsions comprising octahedral grains with 8% monodispersity were obtained. The only differences were about the average grain size and the content of silver iodide.

By repeating the same procedures except for the concentrations of potassium iodide and potassium bromide in solution (B), a silver halide shell was coated on each of the so prepared core silver halide grains. The concentrations of potassium iodide and potassium bromide for the respective emulsions were as follows: 0 g and 131 g, respectively, for emulsion 1-F; 3.32 g and 131 g for emulsion 1-G; 6.64 g and 131 g for emulsion 1-H; 9.96 g and 131 g for emulsion 1-I; 3.32 g and 131 g for emulsion 1-J; 3.32 g and 131 g for emulsion 1-K; 0 g and 131 g for emulsion 1-L; 3.32 g and 131 g for emulsion 1-M; 6.64 g and 131 g for emulsions 1-N; 9.96 g and 131 g for emulsion 1-O; 3.32 g and 131 g for emulsion 1-P; and 3.32 g and 131 g for emulsion 1-Q. As a result, 12 core/shell type emulsions were prepared; they comprised grains which were of the same octahedral shape but which had different average sizes and silver iodide contents.

These emulsions were washed with water and desalted. The yield of each emulsion was 800 ml. The average grain size and silver iodide content of each of the core/shell type silver halide emulsions, 1-F to 1-Q, are shown in Table 1-2below.

TABLE 1-2

| Emulsion | Core AgI content (mol %) | Shell thickness (μm) | Shell AgI content (mol %) | Average grain size (μm) |
|---|---|---|---|---|
| 1-F | 7 | 0.04 | 0 | 0.3 |
| 1-G | 7 | 0.04 | 2 | 0.3 |
| 1-H | 7 | 0.04 | 4 | 0.3 |
| 1-I | 7 | 0.04 | 6 | 0.5 |
| 1-J | 7 | 0.05 | 2 | 0.5 |
| 1-K | 7 | 0.10 | 2 | 0.3 |
| 1-L | 20 | 0.04 | 0 | 0.3 |
| 1-M | 20 | 0.04 | 2 | 0.3 |

TABLE 1-2-continued

| Emulsion | Core AgI content (mol %) | Shell thickness (μm) | Shell AgI content (mol %) | Average grain size (μm) |
|---|---|---|---|---|
| 1-N | 20 | 0.04 | 4 | 0.3 |
| 1-O | 20 | 0.04 | 6 | 0.3 |
| 1-P | 20 | 0.05 | 2 | 0.5 |
| 1-Q | 20 | 0.10 | 2 | 0.5 |

Preparation of Organic Silver Salt Dispersion (1)

5-Methylbenzotriazole was reacted with silver nitrate in a mixed solvent of water and alcohol; 28.8 g of the resulting 5-methylbenzotriazole silver, 16.0 g of poly(N-vinylpyrrolidone) and 1.33 g of sodium 4-sulfobenzotriazole were dispersed in water with an alumina ball mill and thereafter adjusted to pH 5.5 to prepare a dispersion (1) of organic silver salt in a yield of 200 ml.

Preparation of Light-Sensitive Silver Halide Dispersion

Each of the 17 silver halide emulsions, 1-A to 1-Q, was subjected to sulfur sensitization with sodium thiosulfate in the presence of a sensitizing dye (1) having the structure shown below and 4-hydroxy-6-methyl-1,3,3a,7-tetrazaindene, so as to prepare a dispersion of light-sensitive silver halide having the following formulation:

| | |
|---|---|
| silver halide (in terms of silver) | 381 g |
| gelatin | 85 g/2820 ml |

Sensitizing dye (1):

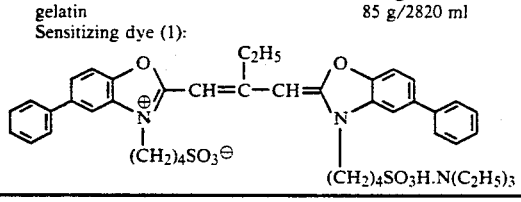

Preparation of Dispersion (1) of Dye-Providing Material

A dye-providing material (35.5 g) identified by No. 7 in the list of illustrative compounds and 5.00 g of a hydroxybenzene compound having the structure shown below were dissolved in 200 ml of ethyl acetate. The solution was mixed with 124 ml of an aqueous solution of 5 wt% Alkanol XC (Du Pont) and 720 ml of an aqueous solution containing 30.5 g of phenylcarbamoylated gelatin (Type 17819PC of Rousselot Inc.) and the resulting mixture was dispersed with an ultrasonic homogenizer. After the ethyl acetate was distilled off, the pH of the dispersion was adjusted to 5.5 and its volume adjusted to 795 ml to make dispersion (1) of the dye-providing material.

Hydroquinone compound:

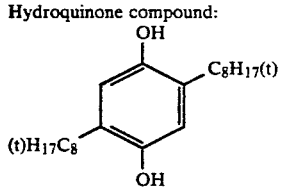

Preparation of Dispersion (1) of Reducing Agent

A reducing agent (23.3 g) identified by R-11 below, 1.10 g of a development accelerator having the formula given below, 14.6 g of poly(N-vinylpyrrolidone) and 0.50 g of a fluorine-based surfactant having the formula shown below were dissolved in water. The pH of the solution was adjusted to 5.5 and its volume to 250 ml to make a dispersion of the developer.

Reducing agent (R-11):

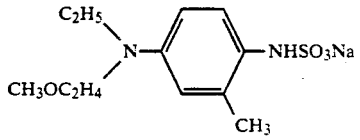

Development accelerator:

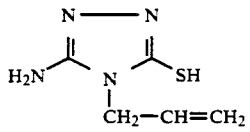

Surfactant:

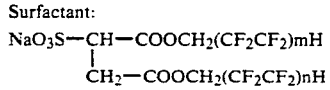

(m, n = 2 or 3)

Preparation of Heat-Developable Light-Sensitive Material (1)

Previously prepared dispersion (1) of organic silver salt (12.5 ml), 6.00 ml of one of the previously prepared silver halide dispersions, 39.8 ml of dispersion (1) of dye-providing material and 12.5 ml of dispersion (1) of reducing agent were mixed. To the mixture, 2.50 ml of a solution of hardening agent [the product obtained by reacting tetra(vinylsulfonylmethyl)methane with taurine at a weight ratio of 1:1 and dissolving the reaction mixture in a 1% aqueous solution of phenylcarbamoylated gelatin to attain a 3 wt% concentration of tetra(vinylsulfonylmethyl)methane] and 3.80 g of a hot solvent (polyethylene glycol 300 of Kanto Chemical Co., Inc.) were added. The resulting coating solution was applied to a 180 μm thick subbed photographic polyethylene terephthalate film for a silver deposit of 1.76 g/m$^2$. The applied light-sensitive layer was further coated with a protective layer made of a mixture of phenylcarbamoylated gelatin (Type 17819PC of Rousellot Inc.) and poly(N-vinylpyrolidone).

Preparation of Image-Receiving Member (1)

An image-receiving member (1) was prepared by coating a tetrahydrofuran solution of polyvinyl chloride (n=1,100; product of Wako Pure Chemical Industries, Ltd.) on photographic baryta paper to attain a polyvinyl chloride deposit of 12 g/m$^2$.

Each of the heat-developable light-sensitive materials previously prepared was given an exposure of 1,600 C.M.S. through a step wedge, superposed on the image-receiving member, and thermally developed at 150° C. for 1 minute in a thermal developer (Developer Module 277 of 3M). Immediately thereafter, the light-sensitive material was stripped from the image-receiving member, which had carried a negative image of magenta color.

The reflection density of the negative image formed on each of the samples was measured with a densitometer (PDA-65 of Konishiroku Photo Industry Co., Ltd.) in order to determine data for relative sensitivity and minimum density (fog). The results are shown in Table 1-3, wherein the "relative sensitivity" is the reciprocal of the exposure necessary to provide a density of fog+0.3 and is indicated in terms of a relative value, with the value for sample No. 1-1 being taken as 100.

TABLE 1-3

| Emulsion No. | Dispersion No. | AgI content of silver halide (mol %) core | shell | Average grain size (μm) | Relative sensitivity | Fog |
|---|---|---|---|---|---|---|
| Comparative samples | | | | | | |
| 1-1 | 1-A | 0 | | 0.3 | 100 | 0.21 |
| 1-2 | 1-B | 4 | | 0.3 | 210 | 0.42 |
| 1-3 | 1-C | 7 | | 0.3 | 260 | 0.51 |
| 1-4 | 1-D | 12 | | 0.3 | 270 | 0.56 |
| 1-5 | 1-E | 20 | | 0.3 | 220 | 0.62 |
| Samples of the Invention | | | | | | |
| 1-6 | 1-F | 7 | 0 | 0.3 | 255 | 0.14 |
| 1-7 | 1-G | 7 | 2 | 0.3 | 310 | 0.18 |
| 1-8 | 1-H | 7 | 4 | 0.3 | 360 | 0.20 |
| 1-9 | 1-I | 7 | 6 | 0.3 | 300 | 0.22 |
| 1-10 | 1-J | 7 | 2 | 0.5 | 550 | 0.21 |
| 1-11 | 1-K | 7 | 2 | 0.5 | 560 | 0.19 |
| 1-12 | 1-L | 20 | 0 | 0.3 | 245 | 0.28 |
| 1-13 | 1-M | 20 | 2 | 0.3 | 295 | 0.31 |
| 1-14 | 1-N | 20 | 4 | 0.3 | 330 | 0.34 |
| 1-15 | 1-O | 20 | 6 | 0.3 | 280 | 0.37 |
| 1-16 | 1-P | 20 | 2 | 0.5 | 520 | 0.32 |
| 1-17 | 1-Q | 20 | 2 | 0.5 | 535 | 0.29 |

As the data in Table 1-3 shows, samples of heat-developable light-sensitive material, No. 1-6 to No. 1-17, which employed silver halide emulsions incorporating the core/shell type silver halide grains of the present invention had superior characteristics (i.e., high photographic sensitivity and low fog) over samples, No. 1-1 to No. 1-5, employing the comparative silver halide emulsions.

EXAMPLE 2

Each of the silver halide emulsions, 1-A to 1-Q, prepared in Example 1 was subjected to sulfur sensitization with sodium thiosulfate in the presence of a sensitizing dye (2) having the structure shown below and 4-hydroxy-6-methyl-1,3,3a,7-tetrazaindene, so as to prepare 17 light-sensitive silver halide dispersions, 1-A' to 1-Q', having the following formulation:

| | |
|---|---|
| silver halide (in terms of silver) | 381 g |
| gelatin | 85 g/2820 ml |
| Sensitizing dye (2): | |

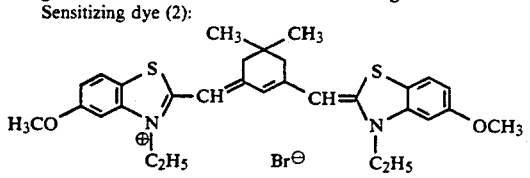

Preparation of Dispersion (2) of Dye-Providing Material

Thirty grams of a dye-providing material A having the structure shown below was dissolved in 30.0 g of tricresyl phosphate and 90.0 ml of ethyl acetate. The solution was mixed with 460 ml of an aqueous gelatin solution containing the same surfactant as used in Example 1; the mixture was dispersed with an ultrasonic homogenizer and the ethyl acetate was distilled off. By addition of water to make a total volume of 500 ml, dispersion (2) of the dye providing material was produced.

Dye providing material (A)

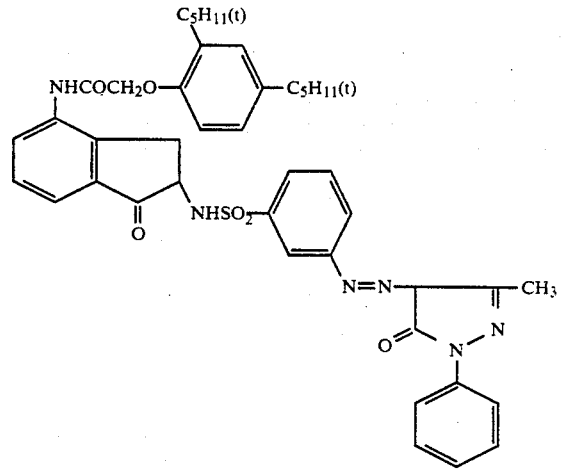

Preparation of Thermally Developable Light-Sensitive Material (2)

Forty milliliters of each of the previously prepared light-sensitive silver halide dispersions, 1-A' to 1-Q' was mixed with 25.0 ml of the dispersion of organic silver salt prepared in Example 1 and 50.0 ml of the above-prepared dispersion of dye-providing material (2). To the resulting mixture were added 4.20 g of a hot solvent (polyethylene glycol 300 of Kanto Chemical Co., Inc.), 1.5 ml of a methanol solution of 10 wt% 1-phenyl-4,4-dimethyl-3-pyrazolidone, 3.00 ml of the same solution of hardening agent as used in Example 1, and 20.0 ml of a solution of 10 wt% guanidinetrichloroacetic acid in a mixture of water and alcohol. The resulting coating solution was applied to a 180 μm thick subbed photographic polyethylene terephthalate film for a silver deposit of 2.50 g/m$^2$.

Preparation of Image-Receiving Member (2)

An image-receiving member was prepared by successively coating the following layers on a 100 μm thick transparent polyethylene terephthalate film:

(1) polyacrylic acid layer (7.00 g/m$^2$);
(2) acetylcellulose layer (4.00 g/m$^2$); and
(3) layer made of a 1:1 copolymer of styrene and N-benzyl-N,N-dimethyl-N-(3-maleimidopropyl)ammonium chloride and gelatin (copolymer, 3.00 g/m$^2$; gelatin, 3.00 g/m$^2$).

Each of the samples of thermally developable light-sensitive material (2) was given an exposure of 1,6000 C.M.S. through a step wedge, heated on a heat block for 1 minute at 150° C., superimposed on the image-receiving member (2) while it was submerged in water, and the two members were compressed together at 500–800 g/cm$^2$ for 30 seconds at 50° C. Immediately thereafter, the two members were stripped apart from each other. The transmission density of the yellow transparent image formed on the surface of the image-receiving element was measured with a densitometer (PDA-65 of Konishiroku Photo Industry Co., Ltd.). The respective values of relative sensitivity and minimum density (fog) attained for each sample are shown in Table 1-4, wherein the "relative sensitivity" is the reciprocal of the exposure necessary to provide a density of fog+0.3 and is expressed in terms of a relative value, with the value for sample No. 18 being taken as 100.

TABLE 1-4

| Emulsion No. | Dispersion No. | AgI content of silver halide (mol %) core | shell | Average grain size (μm) | Relative sensitivity | Fog |
|---|---|---|---|---|---|---|
| Comparative samples | | | | | | |
| 1-18 | 1-A' | 0 | | 0.3 | 100 | 0.18 |
| 1-19 | 1-B' | 4 | | 0.3 | 200 | 0.36 |
| 1-20 | 1-C' | 7 | | 0.3 | 250 | 0.44 |
| 1-21 | 1-D' | 12 | | 0.3 | 265 | 0.52 |
| 1-22 | 1-E' | 20 | | 0.3 | 215 | 0.59 |
| Samples of the Invention | | | | | | |
| 1-23 | 1-F' | 7 | 0 | 0.3 | 235 | 0.12 |
| 1-24 | 1-G' | 7 | 2 | 0.3 | 300 | 0.16 |
| 1-25 | 1-H' | 7 | 4 | 0.3 | 345 | 0.18 |
| 1-26 | 1-I' | 7 | 6 | 0.3 | 290 | 0.20 |
| 1-27 | 1-J' | 7 | 2 | 0.5 | 520 | 0.19 |
| 1-28 | 1-K' | 7 | 2 | 0.5 | 545 | 0.17 |
| 1-29 | 1-L' | 20 | 0 | 0.3 | 235 | 0.25 |
| 1-30 | 1-M' | 20 | 2 | 0.3 | 280 | 0.28 |
| 1-31 | 1-N' | 20 | 4 | 0.3 | 310 | 0.31 |
| 1-32 | 1-O' | 20 | 6 | 0.3 | 265 | 0.34 |
| 1-33 | 1-P' | 20 | 2 | 0.5 | 500 | 0.29 |
| 1-34 | 1-Q' | 20 | 2 | 0.5 | 520 | 0.24 |

As the data in Table 1 - 4 shows, samples of heat-developable light-sensitive material, No. 1-23 to No. 1-34, which employed silver halide emulsions incorporating the core/shell type silver halide grains of the present invention had superior characteristics (i.e., high photographic sensitivity and low fog) over samples, No. 1-18 to No. 1-22, employing the comparative silver halide emulsions.

EXAMPLE 3

Preparation of Core/Shell Type Silver Iodobromide Emulsions:

Twelve core/shell type emulsions having different silver iodide contents and grain sizes were prepared by the following procedures.

To solution (A) having 20 g of ossein gelatin and ammonia dissolved in 1,000 ml of distilled water and which was held at 50° C., 500 ml of solution (B) which was aqueous solution containing predetermined amounts of potassium iodide and potassium bromide and 500 ml of solution C which was an aqueous solution containing 1 mole of silver nitrate and ammonia were added simultaneously at a controlled pAg in a mixer-/agitator of the type shown in Unexamined Published Japanese Patent Application Nos. 92523/1982 and 92524/1982. The shape and size of the core emulsion grains being formed were adjusted by controlling the pH, pAg and the rates of addition of solutions (B) and (C). As a result, twelve core emulsions comprising octahedral grains with 8% monodispersity were obtained. The only differences were about the average grain size and the content of silver iodide.

By repeating the same procedures as above, a silver halide shell was coated on each of the so prepared core silver halide grains. As a result, twelve core/shell emulsions were prepared; they comprised grains which were of the same octahedral shape but which had different average sizes and silver iodide contents.

These emulsions were washed with water and desalted. The yield of each emulsion was 800 ml. The characteristics of the twelve emulsions, 2-A to 2-L, are summarized in Table 2-1.

TABLE 2-1

| Emulsion No. | Core AgI content (mol %) | Shell thickness (μm) | Shell AgI content (mol %) | Average grain size (μm) |
|---|---|---|---|---|
| 2-A | 7 | 0.04 | 0 | 0.3 |
| 2-B | 7 | 0.04 | 2 | 0.3 |
| 2-C | 7 | 0.04 | 4 | 0.3 |
| 2-D | 7 | 0.04 | 6 | 0.3 |
| 2-E | 7 | 0.05 | 2 | 0.5 |
| 2-F | 7 | 0.10 | 2 | 0.5 |
| 2-G | 20 | 0.04 | 0 | 0.3 |
| 2-H | 20 | 0.04 | 2 | 0.3 |
| 2-I | 20 | 0.04 | 4 | 0.3 |
| 2-J | 20 | 0.04 | 6 | 0.3 |
| 2-K | 20 | 0.05 | 2 | 0.5 |
| 2-L | 20 | 0.10 | 2 | 0.5 |

To 800 ml of each emulsion, 12 mg of sodium thiosulfate was added and the mixture was stirred for 1 hour at 50° C. to achieve chemical ripening.

Using the resulting dispersions of light-sensitive silver halide, samples of heat-developable light-sensitive material were prepared as in Example 1 except that polyethylene glycol 300 (product of Kanto Chemical Co., Inc ) was replaced by 3.5 g of one of the hot solvents shown in Table 2-2 below. The samples were then processed for heat development as in Example 1. The results are also shown in Table 2-2.

TABLE 2-2

| Sample No. | Silver halide dispersion | Hot solvent | Dmax | Dmin |
|---|---|---|---|---|
| 2-1 | 2-A | polyethylene glycol | 2.24 | 0.27 |
| 2-2 | 2-B | | 2.31 | 0.30 |
| 2-3 | 2-C | | 2.30 | 0.29 |
| 2-4 | 2-D | | 2.29 | 0.32 |
| 2-5 | 2-E | | 2.04 | 0.30 |
| 2-6 | 2-F | | 2.06 | 0.31 |
| 2-7 | 2-G | | 2.26 | 0.28 |
| 2-8 | 2-H | | 2.32 | 0.27 |
| 2-9 | 2-I | | 2.30 | 0.28 |
| 2-10 | 2-J | | 2.31 | 0.29 |
| 2-11 | 2-K | | 2.01 | 0.28 |
| 2-12 | 2-L | | 2.05 | 0.29 |
| 2-13 | 2-A | | 2.24 | 0.12 |
| 2-14 | 2-B | | 2.30 | 0.13 |
| 2-15 | 2-C | (4) | 2.32 | 0.16 |
| 2-16 | 2-D | | 2.28 | 0.17 |
| 2-17 | 2-E | | 2.00 | 0.16 |
| 2-18 | 2-F | | 2.05 | 0.17 |
| 2-19 | 2-G | | 2.24 | 0.16 |
| 2-20 | 2-H | | 2.26 | 0.15 |
| 2-21 | 2-I | (4) | 2.28 | 0.14 |
| 2-22 | 2-J | | 2.31 | 0.15 |
| 2-23 | 2-K | | 2.03 | 0.16 |
| 2-24 | 2-L | | 2.00 | 0.16 |
| 2-25 | 2-A | | 2.20 | 0.16 |
| 2-26 | 2-B | (7) | 2.29 | 0.15 |
| 2-27 | 2-C | | 2.29 | 0.15 |
| 2-28 | 2-B | | 2.25 | 0.14 |
| 2-29 | 2-C | (12) | 2.28 | 0.14 |
| 2-30 | 2-H | | 2.25 | 0.15 |
| 2-31 | 2-A | | 2.01 | 0.13 |
| 2-32 | 2-B | | 2.06 | 0.14 |
| 2-33 | 2-C | | 2.08 | 0.15 |
| 2-34 | 2-D | | 2.06 | 0.16 |
| 2-35 | 2-E | | 1.78 | 0.14 |
| 2-36 | 2-F | (17) | 1.80 | 0.15 |
| 2-37 | 2-G | | 2.00 | 0.14 |
| 2-38 | 2-H | | 2.03 | 0.14 |
| 2-39 | 2-I | | 2.03 | 0.15 |
| 2-40 | 2-J | | 2.06 | 0.13 |
| 2-41 | 2-K | | 1.80 | 0.14 |

TABLE 2-2-continued

| Sample No. | Silver halide dispersion | Hot solvent | Dmax | Dmin |
|---|---|---|---|---|
| 2-42 | 2-L | | 1.76 | 0.13 |
| 2-43 | 2-A | | 1.97 | 0.13 |
| 2-44 | 2-B | (18) | 2.05 | 0.15 |
| 2-45 | 2-C | | 2.06 | 0.16 |
| 2-46 | 2-B | | 2.02 | 0.13 |
| 2-47 | 2-C | (32) | 2.03 | 0.12 |
| 2-48 | 2-H | | 2.00 | 0.15 |
| 2-49 | 2-A | | 2.20 | 0.13 |
| 2-50 | 2-B | | 2.27 | 0.15 |
| 2-51 | 2-C | | 2.28 | 0.16 |
| 2-52 | 2-D | | 2.25 | 0.18 |
| 2-53 | 2-E | | 1.98 | 0.16 |
| 2-54 | 2-F | (43) | 2.02 | 0.16 |
| 2-55 | 2-G | | 2.21 | 0.14 |
| 2-56 | 2-H | | 2.24 | 0.15 |
| 2-57 | 2-I | | 2.24 | 0.15 |
| 2-58 | 2-J | | 2.27 | 0.16 |
| 2-59 | 2-K | | 2.01 | 0.16 |
| 2-60 | 2-L | | 1.97 | 0.15 |
| 2-61 | 2-A | | 2.18 | 0.15 |
| 2-62 | 2-B | (40) | 2.27 | 0.17 |
| 2-63 | 2-C | | 2.25 | 0.16 |
| 2-64 | 2-B | | 2.22 | 0.13 |
| 2-65 | 2-C | (59) | 2.24 | 0.14 |
| 2-66 | 2-H | | 2.22 | 0.16 |

As the data in Table 2-2 shows, heat-developable light-sensitive materials that had particularly high developability and which yet experienced a small degree of fogging could be attained by combining the hot solvents of the present invention with core/shell type light-sensitive silver halide grains that had AgI contents of 4–40 mol% and which contained less AgI in the surface layer than in the internal phase. The advantage resulting from the combined use was particularly great when the light-sensitive silver halide grains of the present invention had average sizes of 0.4 μm or below.

EXAMPLE 4

Silver halide emulsions, 2-A, 2-B, 2-C and 2-D, prepared in Example 3 were sulfur-sensitized as in Example 2 to make four dispersions of light-sensitive silver halide, 2-A', 2-B', 2-C' and 2-D'. Using these dispersions, samples of heat-developable light-sensitive material were prepared as in Example 2 except that polyethylene glycol 300 of Kanto Chemical Co., Inc. was replaced by 4.20 g of one of the hot solvents shown in Table 2-5 below. The samples were then processed for heat development as in Example 2. The results are also shown in Table 2-3.

TABLE 2-3

| Sample No. | Silver halide dispersion | Hot solvent | Dmax | Dmin |
|---|---|---|---|---|
| 2-67 | 2-A' | | 1.98 | 0.16 |
| 2-68 | 2-B' | (7) | 2.04 | 0.17 |
| 2-69 | 2-C' | | 2.04 | 0.16 |
| 2-70 | 2-D' | | 2.00 | 0.18 |
| 2-71 | 2-A' | | 1.95 | 0.14 |
| 2-72 | 2-B' | (4) | 1.99 | 0.16 |
| 2-73 | 2-C' | | 1.98 | 0.14 |
| 2-74 | 2-D' | | 1.99 | 0.15 |
| 2-75 | 2-A' | | 1.97 | 0.15 |
| 2-76 | 2-B' | (12) | 2.03 | 0.16 |
| 2-77 | 2-C' | | 2.01 | 0.15 |
| 2-78 | 2-D' | | 2.02 | 0.17 |
| 2-79 | 2-A' | | 1.73 | 0.14 |
| 2-80 | 2-B' | (18) | 1.76 | 0.15 |
| 2-81 | 2-C' | | 1.77 | 0.15 |
| 2-82 | 2-D' | | 1.75 | 0.16 |
| 2-83 | 2-A' | | 1.68 | 0.14 |
| 2-84 | 2-B' | (17) | 1.75 | 0.13 |

TABLE 2-3-continued

| Sample No. | Silver halide dispersion | Hot solvent | Dmax | Dmin |
|---|---|---|---|---|
| 2-85 | 2-C' | | 1.74 | 0.12 |
| 2-86 | 2-D' | | 1.75 | 0.13 |
| 2-87 | 2-A' | | 1.70 | 0.15 |
| 2-88 | 2-B' | (32) | 1.76 | 0.15 |
| 2-89 | 2-C' | | 1.77 | 0.13 |
| 2-90 | 2-D' | | 1.75 | 0.16 |
| 2-91 | 2-A' | | 1.92 | 0.14 |
| 2-92 | 2-B' | (40) | 1.98 | 0.16 |
| 2-93 | 2-C' | | 1.97 | 0.15 |
| 2-94 | 2-D' | | 1.96 | 0.15 |
| 2-95 | 2-A' | | 1.89 | 0.13 |
| 2-96 | 2-B' | (43) | 1.97 | 0.14 |
| 2-97 | 2-C' | | 1.95 | 0.13 |
| 2-98 | 2-D' | | 1.94 | 0.14 |
| 2-99 | 2-A' | | 1.90 | 0.15 |
| 2-100 | 2-B' | (59) | 1.98 | 0.16 |
| 2-101 | 2-C' | | 1.96 | 0.14 |
| 2-102 | 2-D' | | 1.96 | 0.16 |

As the data in Table 2-3 shows, the use of hot solvents in combination with light-sensitive silver halide grains in accordance with the present invention was also effective in producing heat-developable light-sensitive materials of high developability and small thermal fogging even when they were of the type employing reducing dye-providing materials.

EXAMPLE 5

Preparation of Tabular Silver Iodobromide Emulsions

Six silver iodobromide emulsions, No. 3-1 to No. 3-6, that contained tabular silver halide grains having different combinations of grain size, aspect ratio and AgI content were prepared by the following procedures.

A silver nitrate solution was added over a period of 10 seconds to a stirred 2% gelatin solution (A) that contained potassium bromide and which was held at 55° C. In this step, 5% of the total amount of silver nitrate to be used was consumed. In the next step, solution (B) which was an aqueous solution containing predetermined amounts of potassium iodide and potassium bromide and a silver nitrate solution (C) were added at accelerated rates by the doublejet method, with the pBr being maintained at a constant level. The shape and aspect ratio (diameter to thickness ratio) of the emulsion grains being formed were adjusted by controlling the pBr and the rates of addition of solutions (B) and (C). As a result, tabular silver halide emulsions having different aspect ratios and AgI contents were attained. These emulsions were then washed with water and desalted. The yield of each emulsion was 800 ml; it contained 1 mole of silver.

The grain sizes, aspect ratios and AgI contents of the emulsions, No. 3-1 to No. 3-6, thus prepared, as well as the KI and KBr concentrations in solution (B) employed are shown in Table 3-1.

TABLE 3-1

| Emulsion No. | Grain size (μm) | Aspect ratio | AgI content (mol %) | Concentrations in solution (B) (g/500 ml) KI | KBr |
|---|---|---|---|---|---|
| 3-1 | 0.6 | 12 | 5 | 8.3 | 140 |
| 3-2 | 0.6 | 12 | 10 | 16.6 | 140 |
| 3-3 | 0.6 | 12 | 15 | 24.9 | 140 |
| 3-4 | 0.6 | 12 | 20 | 33.2 | 130 |
| 3-5 | 0.8 | 14 | 10 | 16.6 | 140 |
| 3-6 | 0.8 | 14 | 20 | 33.2 | 130 |

Preparation of Core/Shell Type Silver Iodobromide Emulsions

Six core/shell type emulsions, No. 3-7 to No. 3-12, having different AgI contents and average grain sizes were prepared by the following procedures.

To solution (A) having 20 g of ossein gelatin and ammonia dissolved in 1,000 ml of distilled water and which was held at 50° C., 500 ml of solution (B) which was an aqueous solution containing predetermined amounts of potassium iodide and potassium bromide (11.6 g and 131 g, respectively, for emulsion Nos. 3-7 to 3-10; and 33.2 g and 119 g for emulsion Nos. 3-11 and 3-12) and 500 ml of solution (C) which was an aqueous solution containing 1 mole of silver nitrate and ammonia were added simultaneously at a controlled pAg in a mixer/agitator of the type shown in Unexamined Published Japanese Patent Application Nos. 92523/1982 and 92524/1982. The shape and size of the emulsion grains being formed were adjusted by controlling the pH, pAg and the rates of addition of solutions (B) and (C), As a result, core emulsions were attained. They had octahedral grains with 8% monodispersity. The only differences were those of average size and AgI content.

By repeating the same procedures except for the concentrations of potassium iodide and potassium bromide in solution (B), a silver halide shell was coated on each of the so prepared core silver halide grains. The concentrations of potassium iodide and potassium bromide for the respective emulsions were as follows: 0 g and 131 g, respectively, for emulsion 3-7; 3.32 g and 131 g for emulsion 3-8; 6.64 g and 131 g for emulsion 3-9; 3.32 g and 131 g for emulsion 3-10; 3.32 g and 131 g for emulsion 3-11; 9.96 g and 131 g for emulsion 3-12. As a result, six core/shell type silver halide emulsions were obtained; they comprised grains which were of the same octahedral shape but which had different average sizes and silver iodide contents These emulsions were washed with water and desalted. The yield of each emulsion was 800 ml. The average grain size and silver iodide content of each of the core/shell type silver halide emulsions, No. 3-7 to No. 3-12, are shown in Table 3-2 below.

TABLE 3-2

| Emulsion No. | Core AgI content (mol %) | Shell thickness (μm) | Shell AgI content (mol %) | Average grain size (μm) |
|---|---|---|---|---|
| 3-7 | 7 | 0.04 | 0 | 0.2 |
| 3-8 | 7 | 0.04 | 2 | 0.2 |
| 3-9 | 7 | 0.04 | 4 | 0.2 |
| 3-10 | 7 | 0.10 | 2 | 0.3 |
| 3-11 | 20 | 0.04 | 2 | 0.2 |
| 3-12 | 20 | 0.04 | 6 | 0.2 |

The so prepared emulsions were sulfur-sensitized by the same method as employed in Example 1. Thereafter, tabular silver halide emulsions (Nos. 3-1, 3-2, 3-4 and 3-5) were combined with core/shell type silver halide emulsions (Nos. 307 to 3-12) in equal proportions so as to prepare 24 dispersions containing the combinations of light-sensitive silver halides shown in Table 3-3 below. Using these dispersions, 24 samples of heat-developable light-sensitive material, No. 3-1 to No. 3-24, were prepared. These samples were thermally developed as in Example 1 to obtain negative magenta images.

The reflection density of each of the negative images obtained was measured as in Example 1 and the maximum density and relative sensitivity of each image are shown in Table 3-3.

TABLE 3-3

| | Light-sensitive silver halide dispersion | | | | | | | | |
|---|---|---|---|---|---|---|---|---|---|
| | tabular silver halide | | | core/shell type silver halide | | | | | |
| Sample No. | Emulsion No. | AgI content (mol %) | Average grain size (μm) | Emulsion No. | Core AgI content (mol %) | Shell AgI content (mol %) | Average grain size (μm) | Dmax | Relative sensitivity |
| Samples of the invention | | | | | | | | | |
| 3-1 | 3-1 | 5 | 0.6 | 3-7 | 7 | 0 | 0.2 | 2.23 | 100 |
| 3-2 | 3-2 | 10 | 0.6 | 3-7 | 7 | 0 | 0.2 | 2.25 | 160 |
| 3-3 | 3-4 | 20 | 0.6 | 3-7 | 7 | 0 | 0.2 | 2.25 | 180 |
| 3-4 | 3-5 | 10 | 0.8 | 3-7 | 7 | 0 | 0.2 | 2.24 | 200 |
| 3-5 | 3-1 | 5 | 0.6 | 3-8 | 7 | 2 | 0.2 | 2.25 | 105 |
| 3-6 | 3-2 | 10 | 0.6 | 3-8 | 7 | 2 | 0.2 | 2.27 | 160 |
| 3-7 | 3-4 | 20 | 0.6 | 3-8 | 7 | 2 | 0.2 | 2.26 | 185 |
| 3-8 | 3-5 | 10 | 0.8 | 3-8 | 7 | 2 | 0.2 | 2.25 | 210 |
| 3-9 | 3-1 | 5 | 0.6 | 3-9 | 7 | 4 | 0.2 | 2.25 | 110 |
| 3-10 | 3-2 | 10 | 0.6 | 3-9 | 7 | 4 | 0.2 | 2.26 | 165 |
| 3-11 | 3-4 | 20 | 0.6 | 3-9 | 7 | 4 | 0.2 | 2.26 | 185 |
| 3-12 | 3-5 | 10 | 0.8 | 3-9 | 7 | 4 | 0.2 | 2.25 | 210 |
| 3-13 | 3-1 | 5 | 0.6 | 3-10 | 7 | 2 | 0.3 | 2.26 | 110 |
| 3-14 | 3-2 | 10 | 0.6 | 3-10 | 7 | 2 | 0.3 | 2.27 | 170 |
| 3-15 | 3-4 | 20 | 0.6 | 3-10 | 7 | 2 | 0.3 | 2.27 | 190 |
| 3-16 | 3-5 | 10 | 0.8 | 3-10 | 7 | 2 | 0.3 | 2.26 | 210 |
| 3-17 | 3-1 | 5 | 0.6 | 3-11 | 20 | 2 | 0.2 | 2.26 | 110 |
| 3-18 | 3-2 | 10 | 0.6 | 3-11 | 20 | 2 | 0.2 | 2.28 | 165 |
| 3-19 | 3-4 | 20 | 0.6 | 3-11 | 20 | 2 | 0.2 | 2.28 | 185 |
| 3-20 | 3-5 | 10 | 0.8 | 3-11 | 20 | 2 | 0.2 | 2.27 | 215 |
| 3-21 | 3-1 | 5 | 0.6 | 3-12 | 20 | 6 | 0.2 | 2.25 | 110 |
| 3-22 | 3-2 | 10 | 0.6 | 3-12 | 20 | 6 | 0.2 | 2.27 | 165 |
| 3-23 | 3-4 | 20 | 0.6 | 3-12 | 20 | 6 | 0.2 | 2.27 | 185 |
| 3-24 | 3-5 | 10 | 0.8 | 3-12 | 20 | 6 | 0.2 | 2.26 | 215 |

As the data in Table 3-3 shows, the photographic characteristics (i.e., relative sensitivity and maximum density) of heat-developable light-sensitive materials employing the core/shell type light-sensitive silver halide grains of the present invention can be further improved by mixing said core/shell type grains with tabular silver halide grains.

EXAMPLE 6

Each of the silver halide emulsions, Nos. 3-1, 3-2, 3-4, and 3-18 to 3-11, that were prepared in Example 5 was sulfur-sensitized as in Example 2 and they were combined with themselves in the manner shown in Table 3-4 below so as to prepare dispersions containing silver halides. In these dispersions, the tabular silver halide emulsions were mixed with the light-sensitive silver halide emulsions of the present invention in equal proportions.

Using the so prepared dispersions of light-sensitive silver halides, samples of thermally developable light-sensitive material were formed as in Example 2. They were processed for heat development as in Example 2 to obtain the results which are also shown in Table 3-4, wherein the "relative sensitivity" is the reciprocal of the exposure necessary to provide a density of fog+0.3 and is expressed in terms of a relative value, with the value for sample No. 3-25 being taken as 100.

TABLE 3-4

| | Light-sensitive silver halide dispersion | | | | | | | | |
|---|---|---|---|---|---|---|---|---|---|
| | tabular silver halide | | | core/shell type silver halide | | | | | |
| Sample No. | Emulsion No. | AgI content (mol %) | Average grain size (μm) | Emulsion No. | Core AgI content (mol %) | Shell AgI content (mol %) | Average grain size (μm) | Dmax | Relative sensitivity |
| Comparative samples | | | | | | | | | |
| 3-25 | 3-1 | 5 | 0.6 | — | — | — | — | 1.92 | 100 |
| 3-26 | 3-2 | 10 | 0.6 | — | — | — | — | 1.93 | 150 |
| 3-27 | 3-4 | 20 | 0.6 | — | — | — | — | 1.91 | 180 |
| Samples of the invention | | | | | | | | | |
| 3-28 | 3-1 | 5 | 0.6 | 3-8 | 7 | 2 | 0.2 | 2.15 | 105 |
| 3-29 | 3-2 | 10 | 0.6 | 3-8 | 7 | 2 | 0.2 | 2.16 | 160 |
| 3-30 | 3-4 | 20 | 0.6 | 3-8 | 7 | 2 | 0.2 | 2.16 | 180 |
| 3-31 | 3-1 | 5 | 0.6 | 3-9 | 7 | 4 | 0.3 | 2.14 | 105 |
| 3-32 | 3-2 | 10 | 0.6 | 3-9 | 7 | 4 | 0.3 | 2.15 | 160 |
| 3-33 | 3-4 | 20 | 0.6 | 3-9 | 7 | 4 | 0.3 | 2.15 | 185 |
| 3-34 | 3-1 | 5 | 0.6 | 3-10 | 7 | 2 | 0.2 | 2.15 | 100 |
| 3-35 | 3-2 | 10 | 0.6 | 3-10 | 7 | 2 | 0.2 | 2.16 | 155 |
| 3-36 | 3-4 | 20 | 0.6 | 3-10 | 7 | 2 | 0.2 | 2.17 | 180 |
| 3-37 | 3-1 | 5 | 0.6 | 3-11 | 20 | 2 | 0.2 | 2.17 | 100 |
| 3-38 | 3-2 | 10 | 0.6 | 3-11 | 20 | 2 | 0.2 | 2.17 | 150 |
| 3-39 | 3-4 | 20 | 0.6 | 3-11 | 20 | 2 | 0.2 | 2.16 | 180 |

As the data in Table 3-4 shows, the samples of the present invention, No. 3-28 to No. 3-39, incorporating both tabular silver halide grains and the light-sensitive silver halide grains of the present invention exhibited better photographic characteristics (i.e., high relative sensitivity and maximum density) than the comparative samples, No. 3-25 to No. 3-27, incorporating only the tabular silver halide grains.

EXAMPLE 7

Preparation of Silver Bromide Emulsion

Comparative silver bromide emulsion 4-A was prepared by the following procedures. To solution (A) having 20 g of ossein gelatin and ammonia dissolved in 1000 ml of distilled water and which was held at 50° C., solution (B) containing 1.1 mole of potassium bromide in 500 ml of water and solution (C) containing 1 mole of silver nitrate and ammonia in 500 ml of water were added simultaneously at a controlled pAg in a mixer-/agitator of the type shown in Unexamined Published Japanese Patent Application Nos. 92523/1982 and 92524/1982. The shape and size of the emulsion grains being formed were adjusted by controlling the pH, pAg and the rates of addition of solutions (B) and (C). As a result, a silver bromide emulsion was attained. The silver halide grains in the emulsion were octahedral in shape with an average size of 0.3 μm and 8% monodispersity. This emulsion was washed with water and desalted. The yield of the emulsion was 800 ml. Preparation of core/shell type silver iodobromide emulsions:

Two core/shell type emulsions, 4-B and 4-C, comprising light-sensitive silver halides with different silver iodide contents and average grain sizes were prepared by the following procedures.

To solution (A) having 20 g of ossein gelatin and ammonia dissolved in 1,000 ml of distilled water and which was held at 50° C., 500 ml of solution (B) which was an aqueous solution containing predetermined amounts of potassium iodide and potassium bromide (11.62 g and 131 g, respectively for emulsion 4-B; and 33.2 g and 119 g for emulsion 4-C) and 500 ml of solution (C) which was an aqueous solution containing 1 mole of silver nitrate and ammonia were added simultaneously at a controlled pAg in a mixer/agitator of the type shown in Unexamined Published Japanese Patent Application Nos. 92523/1982 and 92524/1982. The shape and size of the core emulsion grains being formed were adjusted by controlling the pH, pAg and the rates of addition of solutions (B) and (C). As a result, two core emulsions comprising octahedral grains with 8% monodispersity were obtained. The only differences were those of grain size and AgI content.

By repeating the same procedures except for the concentrations of potassium iodide and potassium bromide in solution (B) (i.e., 3.32 g and 131 g, respectively, for each of emulsions 4-B and 4-C), a silver halide shell was coated on each of the so prepared core silver halide grains. As a result, two core/shell type silver halide emulsions were prepared; they comprised grains which were of the same octahedral shape but which had different average sizes and AgI contents. These emulsions were washed with water and desalted. The yield of each emulsion was 800 ml.

The average grain size and AgI content of each of the core/shell type silver halide emulsions, 4-B and 4-C, are shown in Table 4-1 below.

TABLE 4-1

| Emulsion | Core AgI content (mol %) | Shell thickness (μm) | Shell AgI content (mol %) | Average grain size (μm) |
|---|---|---|---|---|
| 4-B | 7 | 0.04 | 2 | 0.3 |
| 4-C | 20 | 0.04 | 2 | 0.3 |

Using these silver halide emulsions, dispersions of light-sensitive silver halides were prepared as in Example 1 except that sensitizing dyes which were within the scope of the present invention were employed. Using the so prepared silver halide dispersions, samples of heat-developable light-sensitive material were prepared as in Example 1. Exposed samples of light-sensitive material of the same type were developed with a developing solution (for its formulation, see below) at 20° C. for 3 minutes, and subsequently processed through steps of stopping, fixing, washing and drying so as to obtain a black-and-white image.

The sensitivities of the black-and-white images obtained and those of magenta transfer images produced as a result of heat development are shown below in Table 4-2, wherein the "sensitivity" is the reciprocal of the exposure necessary to provide a density of fog+0.2 and is expressed in terms of a relative value, with the value for the black-and-white image obtained from comparative sample No. 4-1 being taken as 100.

| Formulation of developing solution | |
|---|---|
| Metol | 2 g |
| Anhydrous sodium sulfite | 40 g |
| Hydroquinone | 4 g |
| Sodium carbonate (monohydrate) | 28 g |
| Potassium bromide | 1 g |
| Water | to make 1,000 ml |

TABLE 4-2

| Emulsion No. | Dispersion No. | Sensitizing dye of the invention (VI) (mmol/mol AgX) | Sensitizing dye of the invention (VII) (mmol/mol AgX) | Sensitivity after black-and-white development | Sensitivity after thermal color development | Magenta Dmax |
|---|---|---|---|---|---|---|
| Comparative samples | | | | | | |
| 4-1 | 4-A | VI-3 (0.20) | VII-7 (0.20) | 100 | 70 | 2.23 |
| 4-2 | 4-A | VI-3 (0.40) | — | 94 | 61 | 2.19 |
| 4-3 | 4-A | — | VII-7 (0.40) | 81 | 43 | 2.18 |
| Samples of the Invention | | | | | | |
| 4-4 | 4-B | VI-3 (0.20) | VII-7 (0.20) | 151 | 145 | 2.18 |
| 4-5 | 4-B | VI-3 (0.40) | — | 133 | 94 | 2.25 |
| 4-6 | 4-B | — | VII-7 (0.40) | 102 | 72 | 2.23 |
| 4-7 | 4-C | VI-3 (0.20) | VII-7 (0.20) | 154 | 149 | 2.19 |
| 4-8 | 4-C | VI-3 (0.40) | — | 136 | 96 | 2.20 |
| 4-9 | 4-C | — | VII-7 (0.40) | 108 | 78 | 2.17 |

EXAMPLE 8

Sensitizing dyes (VI) and (VII) of the present invention and the silver halide emulsions of the present invention were combined in the manner shown in Table 4-3 below. Thereafter, as in Example 7, dispersions of light-sensitive silver halides were prepared by performing sulfur sensitization with sodium thiosulfate in the presence of 4-hydroxy-6-methyl-1,3,3a,7-tetrazaindene.

Using these silver halide dispersions, samples of heat-developable light-sensitive material were prepared as in Example 2 and processed for heat development as in Example 2 so as to obtain the results shown in Table 4-3.

Exposed samples of light-sensitive material of the same type were subjected to black-and-white development as in Example 7 so as to produce a black-and-white image.

The sensitivities of the black-and-white images obtained and those of yellow transfer images produced as a result of thermal development are shown below in Table 4-3, wherein the "sensitivity" is the reciprocal of the exposure necessary to provide a density of fog+0.2 and is expressed in terms of a relative value, with the value for the black-and-white image obtained from comparative sample No. 4-10 being taken as 100.

TABLE 4-3

| Emulsion No. | Dispersion No. | Sensitizing dye of the invention (VI) (mmol/mol AgX) | Sensitizing dye of the invention (VII) (mmol/mol AgX) | Sensitivity after black-and-white development | Sensitivity after thermal color development | Yellow Dmax |
|---|---|---|---|---|---|---|
| Comparative samples | | | | | | |
| 4-10 | 4-A | VI-2 (0.20) | VII-5 (0.20) | 100 | 76 | 2.09 |
| 4-11 | 4-A | VI-2 (0.40) | — | 71 | 53 | 2.14 |
| 4-12 | 4-A | — | VII-5 (0.40) | 57 | 31 | 2.11 |
| Samples of | | | | | | |

TABLE 4-3-continued

| Emulsion No. | Dispersion No. | Sensitizing dye of the invention (VI) (mmol/mol AgX) | Sensitizing dye of the invention (VII) (mmol/mol AgX) | Sensitivity after black-and-white development | Sensitivity after thermal color development | Yellow Dmax |
|---|---|---|---|---|---|---|
| the Invention | | | | | | |
| 4-13 | 4-B | VI-2 (0.20) | VII-5 (0.20) | 124 | 121 | 2.17 |
| 4-14 | 4-C | VI-2 (0.20) | VII-5 (0.20) | 128 | 124 | 2.18 |

As the data in Table 4-3 shows, the use of sensitizing dye (VI) and/or (VII) in combination with silver halide emulsions containing the light-sensitive silver halide grains of the present invention is also effective in providing heat-developable light-sensitive materials that feature high-sensitivity characteristics (i.e., a small degree of desensitization due to heat development and improved effect of sensitization on light-sensitive silver halides) even if the dye-providing material is employed is of reducing type.

EXAMPLE 9

Preparation of Silver Bromide Emulsion

Comparative silver bromide emulsion 5-A was prepared by the following procedures. To solution (A) having 20 g of ossein gelatin and ammonia dissolved in 1000 ml of distilled water and which was held at 50° C., solution (B) containing 1.1 moles of potassium bromide in 500 ml of water and solution (C) containing 1 mole of silver nitrate and ammonia in 500 ml of water were added simultaneously at a controlled pAg in a mixer-/agitator of the type shown in Unexamined Published Japanese Patent Application Nos. 92523/1982 and 92524/1982. The shape and size of the emulsion grains being formed were adjusted by controlling the pH, pAg and the rates of addition of solutions (B) and (C). As a result, a silver bromide emulsion was attained. The silver halide grains in the emulsion were octahedral in shape with an average size of 0.3 μm and 8% monodispersity. This emulsion was washed with water and desalted. The yield of the emulsion was 800 ml.

Preparation of Silver Iodobromide Emulsions

Two comparative emulsions, 5-B and 5-C, having different silver iodide contents were prepared by the following procedures.

As in the preparation of emulsion 5-A, solution (A) was first prepared by dissolving 20 g of ossein gelatin and ammonia in 1000 ml of distilled water. To solution (A) held at 50° C., 500 ml of solution B which was an aqueous solution containing predetermined amounts of potassium iodide and potassium bromide (6.64 g and 130.9 g, respectively, for emulsion 5-B, and 11.62 g and 130.9 g for emulsion 5-C), and 500 ml of solution (C) which was an aqueous solution containing 1 mole of silver nitrate and ammonia were added simultaneously, with the pAg held at a constant value. The shape and size of the emulsion grains being formed were adjusted by controlling the pH, pAg and the rates of addition of solutions (B) and (C). As a result, comparative emulsions, 5-B and 5-C were obtained. They had octahedral grains with 9% monodispersity. The only difference between the two emulsions was about the content of silver iodide. Both emulsions were washed with water and desalted. The yield of each emulsion was 800 ml.

Preparation of Core/Shell Type Silver Iodobromide Emulsions

Three core/shell type emulsions having different silver iodide contents and grain sizes were prepared by the following procedures. To solution (A) having 20 g of ossein gelatin and ammonia dissolved in 1000 ml of distilled water and which was held at 50° C., 500 ml of solution (B) which was an aqueous solution containing predetermined amounts of potassium iodide and potassium bromide (11.62 g and 130.9 g, respectively, for emulsion 5-D; 11.62 g of potassium iodide 130.9 g of potassium iodide for emulsion 5-E; and 24.9 g and 119.0 g, respectively for emulsion 5-F) and solution (C) which was an aqueous solution containing 1 mole of silver nitrate and ammonia were added simultaneously at a controlled pAg in a mixer/agitator of the type shown in Unexamined Published Japanese Patent Application Nos. 92523/1982 and 92524/1982. The shape and size of the core emulsion grains being formed were adjusted by controlling the pH, pAg and the rates of addition of solutions (B) and (C). As a result, three core emulsions were attained; they comprised grains which were of the same octahedral shape but which had different sizes and silver iodide contents. Each emulsion had 8% monodispersity.

By repeating the same procedures as above, a silver halide shell was coated on each of the so prepared core silver halide grains so as to prepare three core/shell type emulsions, 5-D to 5-F; the emulsions comprised grains which were of the same octahedral shape but which had different average sizes and silver iodide contents. These emulsions were washed with water and desalted. The yield of each emulsion was 800 ml.

The characteristics of the six emulsions, 5-A to 5-F, are summarized in Table 5-1 below.

TABLE 5-1

| Emulsion | AgI content (mol %) core | AgI content (mol %) shell | Shell thickness (μm) | Grain size (μm) |
|---|---|---|---|---|
| 5-A | 0 | | — | 0.3 |
| 5-B | 4 | | — | 0.3 |
| 5-C | 7 | | — | 0.3 |
| 5-D | 7 | 2 | 0.04 | 0.3 |
| 5-E | 7 | 2 | 0.05 | 0.5 |
| 5-F | 20 | 4 | 0.04 | 0.3 |

Using the emulsions, 5-A to 5-F, samples of heat-developable light-sensitive material were prepared as in Example 1 except that the hydroquinone compounds were replaced by the hydroxybenzene derivatives shown in Table 5-2 below. The samples were then processed for thermal development as in Example 1. The results obtained are shown in Table 5-2. Hydroxybenzene derivative (VIII-5) was added in the form of a solution in hot water.

TABLE 5-2

| Sample No. | Emulsion | Hydroxybenzene derivative | Dmin | Dmax | Relative sensitivity |
|---|---|---|---|---|---|
| 5-1 (Comparative sample) | 5-A | — | 0.23 | 1.93 | 100 |
| 5-2 (Sample of the invention) | 5-E | — | 0.26 | 1.94 | 448 |
| 5-3 (Sample of the invention) | 5-F | — | 0.27 | 1.95 | 332 |
| 5-4 (Comparative sample) | 5-A | (VIII-4) | 0.19 | 1.90 | 99 |
| 5-5 (Comparative sample) | 5-B | (VIII-4) | 0.38 | 1.88 | 179 |
| 5-6 (Sample of the invention) | 5-D | (VIII-4) | 0.19 | 1.92 | 330 |
| 5-7 (Sample of the invention) | 5-E | (VIII-4) | 0.21 | 1.91 | 519 |
| 5-8 (Sample of the invention) | 5-F | (VIII-4) | 0.20 | 1.93 | 402 |
| 5-9 (Sample of the invention) | 5-D | (a) | 0.43 | 1.98 | 205 |
| 5-10 (Sample of the invention) | 5-D | (VIII-5) | 0.20 | 1.96 | 336 |
| 5-11 (Sample of the invention) | 5-D | (VIII-6) | 0.20 | 1.90 | 328 |
| 5-12 (Sample of the invention) | 5-D | (IX-2) | 0.20 | 1.90 | 332 |
| 5-13 (Sample of the invention) | 5-D | (IX-3) | 0.19 | 1.92 | 331 |

In Table 5-2, the "relative sensitivity" is the reciprocal of the exposure necessary to provide a density of fog+0.3 and is expressed in terms of a relative value, with the value for sample No. 5-1 being taken as 100.

Compound (a) listed in Table 5-2 was used as a comparative compound with respect to the present invention and had the following structure:

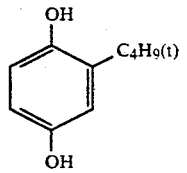

(a)

As the data in Table 5-2 shows, sample Nos. 5-6 to 5-8 and Nos. 5-10 to 5-13 that employed emulsions, 5-D, 5-E and 5-F, in combination with the hydroxybenzene derivatives of the present invention exhibited superior characteristics because they had not only high sensitivities but also low minimum densities (fog). However, sample No. 5-9 that employed compound (a), which was known as an auxiliary developing agent for incorporation in a heat-developable light-sensitive layer and which had a chemical structure similar to those of the hydroxybenzene derivatives of the present invention, experienced an increased amount of fog. Sample Nos. 5-4 and 5-5 which employed emulsions, A and B, respectively which were outside the scope of the present invention did not have satisfactorily high relative sensitivities.

EXAMPLE 10

Preparation of Light-Sensitive Silver Halide Dispersion (2)

The emulsions prepared in Example 9 were subjected to sulfur sensitization with sodium thiosulfate in the presence of a sensitizing dye (3) having the structure shown below and 4-hydroxy-6-methyl-1,3,3a,7-tetrazaindene, so as to prepare dispersions of light-sensitive silver halide having the following formulation:

| | |
|---|---|
| silver halide (in terms of silver) | 381 g |
| gelatin | 85 g/2820 ml |
| Sensitizing dye (3): | |

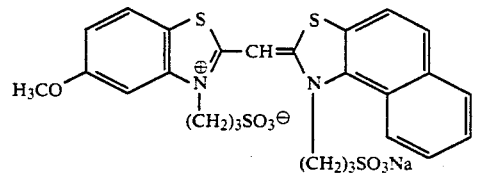

Preparation of Dispersion (2) of Dye-Providing Material

Thirty grams of a dye-providing material (A) and 7.5 mmol of one of the hydroxybenzene derivatives shown in Table 5-3 below were dissolved in 30.0 g of tricresyl phosphate and 90.0 ml of ethyl acetate. The solution was mixed with 460 ml of an aqueous gelatin solution containing the same surfactant as used in Example 1 and the resulting mixture was dispersed with an ultrasonic homogenizer. After the ethyl acetate was distilled off, water was added to make 500 ml of a dispersion (2) of dye-providing material. In carrying out these procedures, hydroxybenzene derivative (VIII-5) shown in Table 5-3 was used in the form of a solution in hot water.

Preparation of Heat-Developable Light-Sensitive Material (2)

One of the previously prepared dispersions (2) of light-sensitive silver halide (40.0 ml), 25.0 ml of dispersion (1) of organic silver salt and 50.0 ml of dispersion (2) of dye-providing material were mixed. To the mixture, 4.20 ml of a hot solvent (polyethylene glycol 300 of Kanto Chemical Co., Inc.), 3.00 ml of the same hardening agent as used in Example 1, and 20.0 ml of a 10 wt% solution of guanidine trichloroacetic acid in a mixed solvent of water and alcohol were added. The resulting coating solution was applied to a 180 μm thick subbed photographic polyethylene terephthalate film for a silver deposit of 2.50 g/m². By these procedures, samples of heat-developable light-sensitive material, No. 5-14 to No. 5-27 (see Table 5-3) were prepared.

Preparation of Image-Receiving Member (2)

An image-receiving member (2) was prepared by successively coating the following layers onto a 100 μm thick transparent polyethylene terephthalate film:

(1) a layer made of a polyacrylic acid (7.00 g/m²);
(2) a layer made of acetylcellulose (4.00 g/m²);
(3) a layer made of a 1:1 copolymer of styrene and N-benzyl-N,N-dimethyl-N-(3-maleimidopropyl)ammonium chloride and gelatin (copolymer, 3.00 g/m²; gelatin, 3.00 g/m²).

The heat-developable light-sensitive material (2) was given an exposure of 1,600 C.M.S. through a step wedge, heated on a heat block for 1 minute at 150° C., superposed on the image-receiving member (2) while it was submerged in water, and the two members were compressed together at 500–800 g/cm² for 30 seconds at 50° C. Immediately thereafter, the two members were stripped apart from each other. The transmission density of the yellow transparent image formed on the surface of the image-receiving element was measured with a densitometer (PDA-65 of Konishiroku Photo Industry Co., Ltd.). The values of minimum density, maximum density and relative sensitivity attained for each of samples No. 5-14 to No. 5-27 are shown in Table 5-3 below.

TABLE 5-3

| Sample No. | Emulsion | Hydroxybenzene derivative of the invention | Dmin | Dmax | Relative sensitivity |
|---|---|---|---|---|---|
| Comparative samples | | | | | |
| 5-14 | 5-C | — | 0.24 | 1.90 | 100 |
| 5-15 | 5-E | — | 0.27 | 1.90 | 428 |
| 5-16 | 5-F | — | 0.28 | 1.93 | 321 |
| 5-17 | 5-C | (VIII-1) | 0.20 | 1.88 | 96 |
| Samples of the invention | | | | | |
| 5-18 | 5-D | (VIII-1) | 0.22 | 1.89 | 316 |
| 5-19 | 5-E | (VIII-1) | 0.22 | 1.89 | 507 |
| 5-20 | 5-F | (VIII-1) | 0.23 | 1.91 | 380 |
| 5-21 | 5-F | (VIII-5) | 0.21 | 1.93 | 386 |
| 5-22 | 5-F | (VIII-6) | 0.21 | 1.88 | 383 |
| 5-23 | 5-F | (VIII-8) | 0.22 | 1.88 | 329 |
| 5-24 | 5-F | (IX-2) | 0.23 | 1.87 | 379 |
| 5-25 | 5-F | (IX-3) | 0.21 | 1.90 | 387 |
| 5-26 | 5-F | (IX-11) | 0.20 | 1.89 | 385 |
| 5-27 (Comparative sample) | 5-F | (b) | 0.58 | 2.07 | 368 |

In Table 5-3, the "relative sensitivity" is the reciprocal of the exposure necessary to provide a density of fog+0.3 and is expressed in terms of a relative value, with the value for sample No. 5-14 being taken as 100.

Compound (b) listed in Table 5-3 was used as a comparative compound with respect to the present invention and had the following structure:

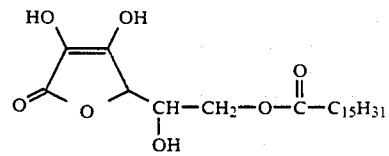

(b)

As the data in Table 5-3 shows, the use of emulsion 5-D, 5-E or 5-F (all of which are the emulsions prepared in accordance with the present invention) in combination with the hydroxybenzene derivatives of the present invention is also effective in providing heat-developable light-sensitive materials that feature superior characteristics (i.e., high sensitivity, low minimum density and satisfactory maximum density) even if the dye-providing material employed is of the type which releases a hydrophilic dye upon heat-initiated reaction with a light-sensitive silver halide. However, sample No. 5-27 which employed a comparative compound (b) experienced an increase in the amount of fogging. Sample No. 5-17 employing emulsion 5-C which was outside the scope of the present invention did not have a satisfactorily high relative sensitivity. It was therefore clear the samples employing the silver halide grains and hydroxybenzene derivatives which were within the scope of the present invention attained high sensitivities and yet exhibited great anti-fogging effects without undergoing any substantial decrease in maximum density.

EXAMPLE 11

Preparation of Organic Silver Salt Dispersion

5-Methylbenzotriazole was reacted with silver nitrate in a mixed solvent of water and alcohol; 28.8 g of the resulting 5-methylbenzotriazole silver, 16.0 g of poly(N-vinylpyrrolidone) and 1.33 g of sodium 4-sulfobenzotriazole were dispersed in water with an alumina ball mill and thereafter adjusted to pH 5.5 to prepare a dispersion of organic silver salt in a yield of 200 ml.

Preparation of Silver Bromide Emulsion

Comparative silver bromide emulsion was prepared by the following procedures. To solution A having 20 g of ossein gelatin and ammonia dissolved in 1000 ml of distilled water and which was held at 50° C., solution B containing 1.1 mole of potassium bromide in 500 ml of water and solution C containing 1 mole of silver nitrate and ammonia in 500 ml of water were added simultaneously at a controlled pAg in a mixer/agitator of the type shown in Unexamined Published Japanese Patent Application Nos. 92523/1982 and 92524,/1982. The shape and size of the emulsion grains being formed were adjusted by controlling the pH, pAg and the rates of addition of solutions B and C. As a result, a silver bromide emulsion was attained. The silver halide grains in the emulsion were octahedral in shape with an average size of 0.3 μm and 8% coefficient of variation in size distribution. This emulsion was washed with water and desalted. The yield of the emulsion was 800 ml. This emulsion is hereinafter referred to as emulsion 6-A.

Preparation of Core/Shell Type Silver Iodobromide Emulsions

Four core/shell type emulsions comprising light-sensitive silver halides with different silver iodide contents and grain sizes were prepared by the following procedures. As in the preparation of emulsion 6-A, solution A was first prepared by dissolving 20 g of ossein gelatin and ammonia in 1000 ml of distilled water. To solution A held at 50° C., 500 ml of solution B which was an aqueous solution containing potassium iodide and potassium bromide and 500 ml of solution C which was an aqueous solution containing 1 mole of silver nitrate and ammonia were added simultaneously at a controlled pAg in a mixer/agitator of the type shown in Unexamined Published Japanese Patent Application No. 92523/1982 and 92524/1982. The shape and size of the emulsion grains being formed were adjusted by controlling the pH pAg and the rates of addition of solutions B and C. As a result, core emulsions that were of the same octahedral shape but which had different grain sizes and AgI contents were prepared. The coefficient of variation in grain size distribution was 8% for each core emulsion.

By repeating the same procedures as above, a silver halide shell was coated on each of the so prepared core silver halide grains. As a result, four core/shell type emulsions, 6-B to 6-E, were obtained; they comprised grains which were of the same octahedral shape but which had different sizes and AgI contents.

These emulsions were washed with water and desalted. The yield of each emulsion was 800 ml.

The grain sizes and AgI contents of the so prepared core/shell emulsions are shown in Table 6-1 below.

TABLE 6-1

| Emulsion No. | Core AgI content (%) | Shell thickness (μm) | Shell AgI content (mol %) | Final grain size (μm) |
|---|---|---|---|---|
| 6-B | 7 | 0.04 | 2 | 0.3 |
| 6-C | 7 | 0.04 | 4 | 0.3 |
| 6-D | 7 | 0.04 | 6 | 0.3 |
| 6-E | 7 | 0.04 | 2 | 0.5 |

Each of the silver halide emulsions thus prepared was subjected to sulfur sensitization with sodium thiosulfate in the presence of a sensitizing dye having the structure shown below and 4-hydroxy-6-methyl-1,3,3a,7-tetrazaindene, so as to prepare a dispersion of light-sensitive silver halide having the following formulation:

| | |
|---|---|
| silver halide (in terms of silver) | 381 g |
| gelatin | 85 g/3530 ml |

-continued

Sensitizing dye:

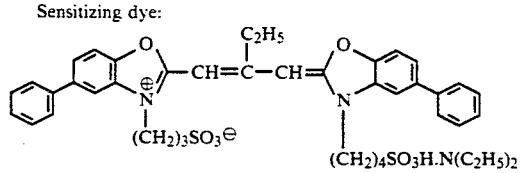

Preparation of Dispersion of Dye-Providing Material

Dye-providing polymer (P-3 or P-1) weighing 35.5 g and 5.00 g of a hydroquinone compound having the structure shown below were dissolved in 200 ml or ethyl acetate. The solution was mixed with 124 ml of an aqueous solution of 5 wt% Alkanol XC (Du Pont) and 720 ml of an aqueous solution containing 30.5 g of phenylcarbamoylated gelatin (Type 17819PC of Rousselot Inc.) and the resulting mixture was dispersed with an ultrasonic homogenizer. After the ethyl acetate was distilled off, the pH of the dispersion was adjusted to 5.5 and its volume adjusted to 795 ml to make a dispersion of the dye-providing polymer.

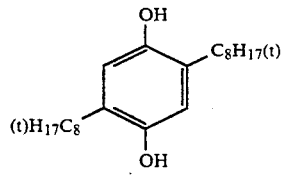

Developing Solution

A reducing agent (23.3 g) identified by (R-11), 1.10 g of a development accelerator having the formula given below, 14.6 g of poly(N-vinylpyrrolidone) and 0.50 g of a fluorine-based surfactant having the formula shown below were dissolved in water. The pH of the solution was adjusted to 5.5 and its volume to 250 ml to make a dispersion of the developer.

Development accelerator:

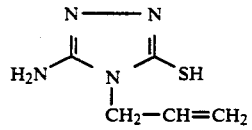

Surfactant:

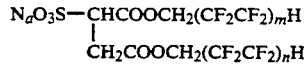

(m,n = 2 or 3)

Preparation of Heat-Developable Light-Sensitive Material

Previously prepared dispersion of organic silver salt (12.5 ml), 6.00 ml of one of the previously prepared silver halide emulsions, 39.8 ml of one of the dispersions of dye-providing polymer, and 12.5 ml of the developing solution were mixed. To the mixture, 2.50 ml of a solution of hardening agent [as produced by reacting tetra(vinylsulfonylmethyl)methane with taurine at a weight ratio of 1:1 and dissolving the reaction mixture in a 1% aqueous solution of phenylcarbamoylated gelatin to attain a 3 wt% concentration of tetra(vinylsulfonylmethyl)methane] and 3.80 g of a hot solvent (polyethylene glycol 300 of Kanto Chemical Co., Inc.) were added. The resulting coating solution was applied to a 180 μm thick subbed photographic polyethylene terephthalate film for a silver deposit of 1.76 g/m². The applied light-sensitive layer was further coated with a protective layer made of a mixture of phenylcarbamoylated gelatin (Type 17819PC of Rousselot Inc.) and poly(N-vinylpyrrolidone).

Preparation of Image-Receiving Member

An image-receiving member was prepared by coating a tetrahydrofuran solution of polyvinyl chloride (n=1,100; product of Wako Pure Chemical Industries, Ltd.) on photographic baryta paper to attain a polyvinyl chloride deposit of 12 g/m².

Each of the thermally developable light-sensitive materials previously prepared was given an exposure of 1,600 C.M.S. through a step wedge, superposed on the image-receiving member, and thermally developed at 150° C. for 1 minute in a thermal developer (Developer Module 277 of 3M). Immediately thereafter, the light-sensitive material was stripped away from the image-receiving member, which had carried a negative image of magenta color.

The maximum density and minimum density (fog) of the negative image formed on each of the samples were measured with a densitometer (PDA-65 of Konishiroku Photo Industry -Co., Ltd.). The results are shown in Table 6-2.

TABLE 6-2

| Sample No. | | Silver halide emulsion | Dye-providing polymer | Dmin | Dmax |
|---|---|---|---|---|---|
| 6-1 | (comparative sample) | 6-A | P-3 | 0.16 | 2.02 |
| 6-2 | (sample of the invention) | 6-B | P-3 | 0.08 | 1.98 |
| 6-3 | (sample of the invention) | 6-C | P-3 | 0.08 | 2.00 |
| 6-4 | (sample of the invention) | 6-D | P-3 | 0.07 | 1.96 |
| 6-5 | (comparative sample) | 6-E | P-3 | 0.10 | 1.84 |
| 6-6 | (sample of the invention) | 6-A | P-12 | 0.17 | 1.92 |
| 6-7 | (sample of the invention) | 6-B | P-12 | 0.08 | 1.93 |
| 6-8 | (sample of the invention) | 6-C | P-12 | 0.07 | 1.89 |
| 6-9 | (sample of the invention) | 6-D | P-12 | 0.05 | 1.88 |
| 6-10 | (sample of the invention) | 6-E | P-12 | 0.09 | 1.76 |

As the data in Table 6-2 shows, a further decrease in the amount of thermal fogging can be achieved by using the light-sensitive silver halide grains of the present invention in combination with one of the dye-providing polymers which have weight average molecular weights of 30,000 or more in accordance with the present invention.

We claim:

1. A heat-developable light-sensitive photographic material including a light-sensitive silver halide emulsion comprising core/shell type light-sensitive silver halide grains which contain 4–20 mol % of silver iodide, said shell having a first silver iodide content at least 2% lower than said core, said core having a second silver iodide content between 4 and 20 mol %, said first silver iodide content being between 0 and 6 mol %; a thickness of said shell being 6 to 20% of that of the silver halide grains, said core/shell type silver halide grains having a spread in grain size distribution of not more than 15%;

a reducing agent; and at least one of the compounds represented by Formulas (I) to (V) being incorporated in a silver halide emulsion layer containing said light-sensitive silver halide grains and/or in at least one hydrophilic colloidal layer adjacent said silver halide emulsion layer:

$$[R_1]-(OH)_n \quad (I)$$

where $R_1$ is a straight-chained, branched or cyclic n-valent hydrocarbon or ether residue having 3 to 10 carbon atoms; and n is an integer of 3 to 10;

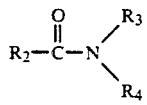
(II)

where $R_2$, $R_3$ and $R_4$ are each a hydrogen atom, an alkyl group having 1 to 12 carbon atoms, or an aryl or heterocyclic group having 6 to 12 carbon atoms;

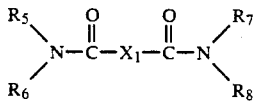
(III)

where $R_5$, $R_6$, $R_7$ and $R_8$ are each a hydrogen atom, an alkyl group having 1 to 12 carbon atoms, or an aryl or heterocyclic group having 6 to 12 carbon atoms, and $X_1$ is a simple linkage or a divalent group;

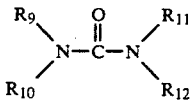
(IV)

where $R_9$, $R_{10}$, $R_{11}$ and $R_{12}$ are each a hydrogen atom, an alkyl group having 1 to 12 carbon atoms, an acyl group or an aryl group having 6 to 12 carbon atoms; provided that one of $R_9$ and $R_{10}$ may combine with one of $R_{11}$ and $R_{12}$ to form a ring; and

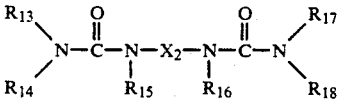
(V)

where $R_{13}$, $R_{14}$, $R_{16}$, $R_{17}$ and $R_{18}$ are each a hydrogen atom, an alkyl group having 1 to 12 carbon atoms, an acyl group or an aryl group having 6 to 12 carbon atoms; and $X_2$ is a simple linkage or a divalent group;

at least one compound represented by Formula (VI) being incorporated in combination with said at least one of the compounds represented by General Formula (I) to (V) in said silver halide emulsion layer containing said light-sensitive silver halide grains:

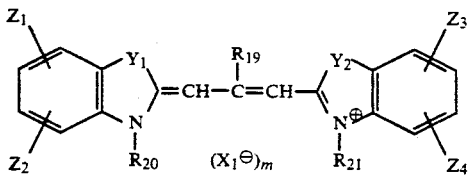

(VI)

where $R_{19}$ is a hydrogen atom, an alkyl group, an aryl group or a heterocyclic group; $R_{20}$ and $R_{21}$ are each an alkyl group; $Y_1$ and $Y_2$ are each an oxygen atom, a sulfur atom or a selenium atom; $Z_1$, $Z_2$, $Z_3$, and $Z_4$ are each a hydrogen atom, a halogen atom, a hydroxyl group, an alkoxy group, an acyl group, an alkoxycarbonyl group, an alkoxycarbonylamino group, an acylamino group, an aryl group, an alkyl group or a cyano group, provided that $Z_1$ and $Z_2$ and/or $Z_3$ and $Z_4$ may combine with each other to form a ring; $X_1^{\ominus}$ is an anion; and m is 0 or 1.

2. The material of claim 1 wherein said silver halide emulsion layer further comprises at least one compound represented by the following general formula (VII)

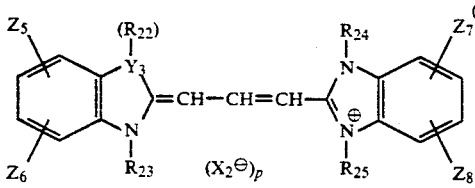

(VII)

where $R_{22}$, $R_{23}$, $R_{24}$ and $R_{25}$ are each a hydrogen atom, an alkyl group, an aryl group or an alkenyl group; $Y_3$ is a nitrogen atom, a sulfur atom or a selenium atom, provided that $R_{22}$ is absent if $Y_3$ is a sulfur atom or a selenium atom; $Z_5$, $Z_6$, $Z_7$ and $Z_8$ are each a hydrogen atom, a halogen atom, a hydroxyl group, an alkoxy group, an acyl group, an acylamido group, an acyloxy group, an alkoxycarbonyl group, an aryloxycarbonyl group, a carbamoyl group, an alkoxycarbonylamino group, an aryl group, an alkyl group, a cyano group, a sulfonyl group or a heterocylic group, provided that $Z_5$ and $Z_6$ and/or $Z_7$ and $Z_8$ may combine with each other to form a ring; $X_2^{\ominus}$ is an anion; and p is 0 or 1.

3. The material of claim 1 wherein said spread distribution is not more than 10%.

4. The material of claim 2 wherein said spread distribution is not more than 10%.

5. A heat-developable light-sensitive material according to claim 1 wherein the silver halide emulsion layer containing said light-sensitive silver halide grains further contains tabular light-sensitive silver halide grains having a diameter-to-thickness ratio of 5 or more.

6. A heat-developable light-sensitive material according to claim 2 wherein said compound of formula (VI) is represented by the following general formula (VI') and said compound of formula (VII) is represented by the following general formula (VII'):

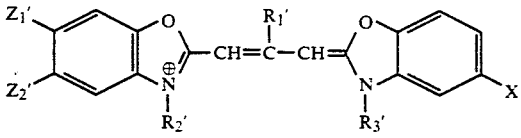

(VI')

where $R_1'$ is an alkyl group; $R_2'$ and $R_3'$ each signifies an alkyl group, provided that at least one of $R_2'$ and $R_3'$ is an alkyl group having a sulfo group or a sulfo-containing group; $Z_1'$ and $Z_2'$ are each a hydrogen atom, a halogen atom, an aryl group, an alkyl group or an alkoxy group, provided that $Z_1'$ and $Z_2'$ may combine with each other to form a ring; and X is a halogen atom;

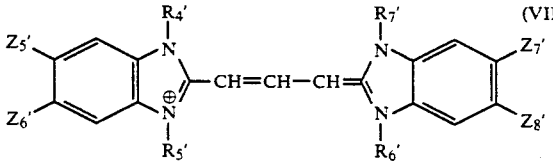

(VII')

where $R_4'$, $R_5'$, $R_6'$ and $R_7'$ each signifies an alkyl group, an aryl group or an alkenyl group, provided that at least one of $R_5'$ and $R_6'$ is an alkyl group having a sulfo group or a sulfo-containing group; $Z_5'$, $Z_6'$, $Z_7'$ and $Z_8'$ each signifies a halogen atom, an acylamido group, an acyloxy group, an alkoxycarbonyl group, an aryloxycarbonyl group, an aminocarbonyl group, a sulfonyl group, a cyano group, an alkyl group, an aryl group or a heterocyclic group.

7. A heat-developable light-sensitive material according to claim 1 wherein a compound represented by the following general formula (VIII) and/or a compound represented by the following general formula (IX) is incorporated in the silver halide emulsion layer containing said light-sensitive silver halide grains:

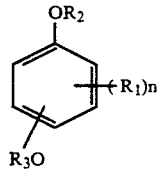

(VIII)

where $R_1$ is a halogen atom, an alkyl group, an aryl group, an acyl group, an alkyloxycarbonyl group, an aryloxycarbonyl group, an alkylsulfonyl group, an arylsulfonyl group, an alkylamino group, an arylamino group, a carbamoyl group, an acylamino group, an alkoxy group, a sulfamoyl group, an alkylsulfonylamino group, an arylsulfonylamino group, a sulfonic acid group or a salt thereof, a carboxylic acid group or a salt thereof, a nitro group, or a hydroxyl group; $R_2$ and $R_3$ are each a hydrogen atom or a protective group that is eliminated upon decomposition; and n is an integer of 1 to 4;

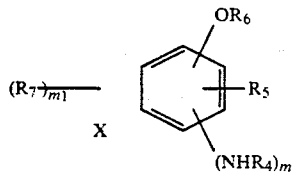

(IX)

where $R_4$ is a hydrogen atom, an alkyl group, an acyl group, an alkylsulfonyl group, an arylsulfonyl group, an alkylaminosulfonyl group or an arylaminosulfonyl group; $R_5$ is a hydrogen atom, a halogen atom, an alkyl group, an aryl group, an alkoxy group, an acylamino group or a sulfamoyl group; X is $(R_5)_2$ or the atomic group necessary for forming a carbon ring, provided that when Z is $(R_5)_2$, $R_5$ may be the same or different; $R_6$ is a hydrogen atom or a protective group that will be eliminated upon decomposition; $R_7$ is a group having no less than 7 carbon atoms; m is an integer of 0 to 2; and n is 0 or 1.

8. A heat-developable light-sensitive material according to claim 1 which has at least said light-sensitive silver halide grains, a dye-providing material, a reducing agent and a binder on a support, said dye-providing material is a polymer with a weight average molecular weight of at least 30,000 that has a recurring unit derived from a monomer that is represented by the following general formula (X) or (XI):

$$(Q—X_nCp_1 \quad (X)$$

$$(Q—Cp_2—X_nDye \quad (XI)$$

where Q is an ethylenically unsaturated group or a group having an ethylenically unsaturated group; $Cp_1$ and $Cp_2$ each signifies an organic group that reacts with the oxidized product of a reducing agent to form or release a diffusible dye; X is a divalent linkage which is bound to the active site of $Cp_1$ or $Cp_2$; n is 0 or 1; and Dye stands for a diffusible dye residue.

* * * * *